US006491461B1

(12) United States Patent
Nakajima et al.

(10) Patent No.: US 6,491,461 B1
(45) Date of Patent: Dec. 10, 2002

(54) TAPE PRINTING APPARATUS, TAPE CARTRIDGE AND TAPE PRINTING APPARATUS INCLUDING THE TAPE CARTRIDGE, AND TAPE CUTTING DEVICE

(75) Inventors: Kenichi Nakajima, Shimosuwa-machi (JP); Shinobu Nakazawa, Omachi (JP); Takaaki Ozawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/538,160

(22) Filed: Mar. 29, 2000

(30) Foreign Application Priority Data

| | | |
|---|---|---|
| Mar. 31, 1999 | (JP) | 11-093474 |
| Mar. 31, 1999 | (JP) | 11-093475 |
| Mar. 31, 1999 | (JP) | 11-093476 |
| Mar. 31, 1999 | (JP) | 11-093477 |

(51) Int. Cl.[7] ..... B41J 29/02

(52) U.S. Cl. ..... 400/693; 400/691; 400/692; 400/693.1; 242/335; 242/347

(58) Field of Search ..... 400/693.1, 693, 400/692, 691, 611–621; 242/347, 347.1, 347.2, 335; 360/132

(56) References Cited

U.S. PATENT DOCUMENTS

| | | | | |
|---|---|---|---|---|
| 4,226,547 A | | 10/1980 | Bradshaw et al. | 400/613 |
| 4,347,537 A | * | 8/1982 | Schoettle et al. | 360/132 |
| 4,982,909 A | * | 1/1991 | Pagano | 242/347.2 |

FOREIGN PATENT DOCUMENTS

| | | |
|---|---|---|
| EP | 0-894635 | 2/1999 |
| JP | 53-110596 | 9/1978 |
| JP | 62-161580 | 7/1987 |
| JP | 05-016474 | 1/1993 |
| JP | 11-048540 | 2/1999 |

OTHER PUBLICATIONS

IBM Technical Disclosure Bulletin; Tape Cartridge, Apr. 1967; vol. No. 9, Issue No. 11, p. No. 1617.*

* cited by examiner

*Primary Examiner*—Andrew H. Hirshfeld
*Assistant Examiner*—Minh H. Chau
(74) *Attorney, Agent, or Firm*—Hogan & Hartson, LLP

(57) ABSTRACT

There are provided a tape cartridge which can be changed into a compact shape for storage or transport, or makes a printing tape and a laminating tape replaceable, and at the same time facilitating the handling of them, a tape cartridge capable of holding an unrolled portion extending over a relative long distance in a proper attitude, a tape cutting device including the tape cartridge, and a tape printing apparatus including any of the above tape cartridges or having a structure making itself free from spoiling the print quality. A casing of a tape cartridge accommodating at least one roll of tape such that the at least one roll of tape can be unrolled therefrom comprises a hinge mechanism arranged at a longitudinally intermediate portion thereof, for allowing the tape cartridge to be folded. A tape-holding member protrudes from a casing, for holding an end of an unrolled portion of a roll of tape rolled out from the casing for enabling the tape to be rolled out therefrom, thereby ensuring mounting of the roll of tape in the cartridge compartment with the unrolled portion rolled out from the casing. An unrolled portion of a roll of laminating tape is laminated onto an unrolled portion of a roll of a printing tape. A tape-supporting frame rotatably supporting at least one of these rolls of tapes is removably mounted in a casing for removably accommodating these rolls of tapes.

8 Claims, 31 Drawing Sheets

TAPE PRINTING APPARATUS, TAPE CARTRIDGE AND TAPE PRINTING APPARATUS INCLUDING THE TAPE CARTRIDGE, AND TAPE CUTTING DEVICE

BACKGROUND OF THE INVENTION

1. Field of the Invention

This invention relates to a tape cartridge removably mounted in a tape printing apparatus, a tape cartridge containing a printing tape and a laminating tape to be laminated on the printing tape, and a tape printing apparatus having the tape cartridge mounted therein, as well as a tape printing apparatus (printer) which carries out printing by an ink jet printing method.

2. Prior Art

Conventionally, a tape cartridge incorporating a printing tape and a laminating tape to be laminated on a printing surface of the printing tape was proposed by Japanese Utility Model Publication (Kokoku) No. 7-2203. The tape cartridge has a cartridge casing integrally formed therewith for containing the printing tape, the laminating tape, and an ink ribbon.

This type of tape cartridge suffers from a problem that if the tape cartridge is constructed such that it can contain tapes with an extremely large width, it needs a cartridge casing which is large in width, which inevitably increases the size of the tape cartridge itself. A large tape cartridge is bulky, so that it is not only difficult or troublesome to carry the tape cartridge, but also it takes much space for storing the same.

In the above-mentioned tape cartridge, the printing tape and the laminating tape are contained in the cartridge casing, as described above, and after printing is effected on the printing tape, the laminating tape is laminated on the printed portion of the printing tape, and then the laminated portion of the two tapes is sent out of the tape cartridge.

When the printing tape and the laminating tape are used up, the tape cartridge including the cartridge casing is discarded. This not only goes against the saving of resources but also pollutes the environment. This problem can be solved to some extent by providing a roll of printing tape and a roll of laminating which are not contained in a cartridge casing, for replacement of tapes. However, another problem arises that if lamination of the printing tape with the laminating tape is started without aligning leading portions of the two tapes one upon the other with accuracy, displacement between the two tapes increases according to an angle formed therebetween in the course of the lamination. Therefore, it is required to provide a printing tape and a laminating tape in a state in which the leading portions thereof are affixed to each other accurately without any displacement.

However, to provide the printing tape and laminating tape maintained in the above state, it is required to carry or transport the two tapes for replacement and mount the same in a cartridge casing without loosening the rolls thereof. Therefore, the carrying or transport and mounting of the tapes is expected to be troublesome.

Another tape cartridge of the above-mentioned kind was proposed e.g. by Japanese Laid Open Publication (Kokai) No. 3-166977. In the tape cartridge, a printing tape and a laminating tape laminated on an adhesive double coated tape are contained in a cartridge casing. The leading portions of the printing tape and the laminating tape are fed out of the casing in advance in a state affixed to each other, and the tape cartridge is mounted in a cartridge compartment of an apparatus body in this state. When the tape cartridge is mounted in the cartridge compartment, the laminated leading portion of the two tapes is brought to a cutter arranged in the apparatus body.

However, in the conventional tape cartridge, if the leading portion to be fed out of the cartridge casing is formed to have a small length, when a free end of the leading portion is erroneously brought into contact with anything during transport or storage, the leading portion can be pushed back into the cartridge casing, making tape feed impossible. On the other hand, if the leading portion is formed to have a large length, when the tape cartridge is being mounted in the apparatus body, the leading portion can be caught in component parts or the like in the apparatus body. In this case, the mounting itself is difficult, and the tapes can be mounted in the apparatus body with the leading portion folded.

A general type of printer (ink jet printer) which effects printing on paper by an ink jet printing method has paper feed rollers arranged therein at respective upstream and downstream locations in a direction of feeding of paper with respect to a print head. In this type of printer, at the start of paper feed, the paper fed by the feed roller on the upstream side is caught by the feed roller on the downstream side and further fed by the same. Accordingly, the upstream feed roller is rotated in synchronism with drive of the print head, and at the same time, the downstream feed roller is rotated in a slipping manner, whereby the paper is tensioned for printing.

However, there exist no types of a so-called tape printer (tape printing apparatus) which carry out printing on a tape by the ink jet printing method.

If the conventional ink jet printer is applied to a tape printing apparatus, it is assumed that a printed portion of a tape will be rubbed by a peripheral surface of the downstream feed roller when the roller performs slipping rotation, so that it would be impossible to prevent degradation of printing without using a special kind of tape which is excellent in ink-absorbing property.

Further, in a tape printing apparatus in which a printed portion of a printing tape is laminated with a laminating tape, it is assumed that displacement of the laminating tape with respect to the printing tape will occur when the downstream feed roller performs slipping rotation.

SUMMARY OF THE INVENTION

It is a first object of the invention to provide a tape cartridge which can be changed into a compact shape when it is transported or stored, and a tape printing device including the same.

It is second object of the invention to provide a tape cartridge which is capable of holding an unrolled portion extending over a relatively long distance in a proper attitude, and a tape cutting device including the tape cartridge.

It is a third object of the invention to provide a tape cartridge which makes a printing tape and a laminating tape replaceable, and at the same time facilitating the handing of them, including replacement of them, and a tape printing apparatus including the same.

It is a fourth object of the invention to provide a tape printing apparatus having a structure making itself free from spoiling the print quality.

To attain the first object, according to a first aspect of the invention, there is provided a tape cartridge including a casing accommodating at least one roll of tape such that the at least one roll of tape can be unrolled therefrom, wherein the casing comprises a hinge mechanism arranged at a longitudinally intermediate portion thereof, for allowing the tape cartridge to be folded.

According to this tap cartridge, it is possible to fold a tape cartridge having a large length extending in one direction, into a compact shape which is suitable for storage and transport.

Preferably, the at least one roll of tape comprises a first roll of tape and a second roll of tape, the first roll of tape and the second roll of tape being unrolled, and sent out from the casing in a state positioned one upon another, the tape cartridge including a first tape-accommodating block for accommodating the first roll of tape, a second tape-accommodating block for accommodating the second roll of tape, and a connecting block for connecting the first tape-accommodating block and the second tape-accommodating block, wherein the hinge mechanism is incorporated in the connecting block, for permitting the first tape-accommodating and the second tape-accommodating block to be folded to each other.

According to this preferred embodiment, the first tape-accommodating block and the second tape-accommodating block are constructed to be capable of being folded via the hinge mechanism incorporated in the connecting block. Therefore, when the first tape-accommodating block and the second tape-accommodating block are folded, the length along the longitudinal axis along which the first tape-accommodating block and the second tape-accommodating block extend is made short.

Preferably, when the first tape-accommodating block and the second tape-accommodating block are unfolded, space is formed as an recessed portion between the first tape-accommodating block and the second tape-accommodating block, and the first tape-accommodating block and the second tape-accommodating block can be folded in a direction of reducing the space.

According to this preferred embodiment, when the first tape-folding block and the second tape-folding block are folded to each other, the whole shape of the tape cartridge can be changed into a rather smooth shape.

More preferably, the first tape-accommodating block and the second tape-accommodating block has portions formed to have respective shapes complementary to each other, for being brought into contact with each other when the first tape-accommodating block and the second tape-accommodating block are folded.

According to this preferred embodiment, when the first tape-folding block and the second tape-folding block are folded to each other, the space is filled thereby making compact the whole shape of the tape.

Preferably, the first roll of tape has an unrolled portion unrolled from the first tape-accommodating portion and extending over the connecting block toward the second tape-accommodating portion, and the hinge mechanism has an axis of pivotal motion of the first tape-accommodating block and the second tape-accommodating block, the axis of pivotal motion being located outward of the unrolled portion with respect to a direction of folding of the unrolled portion occurring when the first tape-accommodating block and the second tape-accommodating block are folded.

According to this preferred embodiment, as the first tape-accommodating block and the second tape-accommodating block are folded, the leading end of the unrolled portion of the first roll of tape is moved toward the second tape-accommodating block, which prevents the leading end from being disengaged e.g. from a guide provided on the second tape-accommodating block, for holding the leading end.

Preferably, aid connecting block has a first connecting portion located on a first tape-accommodating block side and having a first pair of side portions, and a second connecting portion located on a second tape-accommodating block side and having a second pair of side portions, the first connecting portion and the connecting portion are connected to each other via the hinge mechanism, and the hinge mechanism comprises a pair of pins protruding inwardly from one pair of the first pair of side portions and the second pair of side portions, and a pair of pin-receiving recess respectively formed in another pair of the first pair of side portions and the second pair of side portions, and engaged with the pair of pins for permitting pivotal motion of the pair of the pins.

According to this preferred embodiment, the pins of the hinge mechanism are not required to extend over the width of the connecting block. Therefore, the hinge mechanism can be simplified in construction and the assembling of the same can be facilitated.

Preferably, the connecting block has a first connecting portion located on a first tape-accommodating block side and having a first end, and a second connecting portion located on a second tape-accommodating block side and having a second end, the first connecting portion and the connecting portion are connected to each other at the first end and the second end via the hinge mechanism such that the fist connecting portion and the second connecting portion can be folded to each other, and one of the first end and the second end has a locating recess, and another of the first end and the second having has a locating projection for being fitted in the locating recess when the first tape-accommodating block and the second tape-connecting block are unfolded.

According to this preferred embodiment, when the first tape-accommodating block and the second tape-accommodating block are unfolded, i.e. in a state extended for use, the locating projection of the connecting block is fitted in the locating recess of the same, whereby the first tape-accommodating block and the second tape-accommodating block are accurately positioned when in use. This makes it possible to laminate the unrolled portion of the first roll of tape and the unrolled portion of the second roll of tape to each other.

Preferably, the first roll of tape is a roll of printing tape having a printing surface for being printed, and the second roll of tape is a roll of laminating tape whose unrolled portion is laminated to the printing surface of an unrolled portion of the roll of printing tape.

According to this preferred embodiment, when the tape cartridge is in a folded state, the first roll of tape and the second roll of tape can be made close to each other, and when it is in use (in a unfolded or extended state), the first roll of tape and the second roll of tape can be arranged remote from each other in a manner corresponding to the configuration of the printing apparatus.

To attain the first object, according to a second aspect of the invention, there is provided a tape printing apparatus comprising a tape cartridge removably mounted therein, the tape cartridge including a casing accommodating at least one roll of tape such that the at least one roll of tape can be unrolled therefrom, wherein the casing comprises a hinge mechanism arranged at a longitudinally intermediate portion thereof, for allowing the tape cartridge to be folded.

According to this tape printing apparatus, the tape printing apparatus is capable of having the tape cartridge properly mounted therein by unfolding the tape cartridge, and having the same removed therefrom, allowing the same to be folded into a compact shape for storage.

To attain the second object, according to a third aspect of the invention, there is provided a tape cartridge for being mounted in a cartridge compartment of an apparatus using a roll of tape, comprising:

a casing for accommodating the roll of tape; and a tape-holding member protruding from the casing, for holding an end of an unrolled portion of the roll of tape rolled out from the casing for permitting the roll of tape to be rolled out from the casing, thereby ensuring that the roll of tape is mounted in the cartridge compartment in a state in which the roll of tape accommodated within the casing has the unrolled portion rolled out from the casing.

According to this tape cartridge, the tape-holding member protruding from the casing holds the end of the unrolled portion of the roll of tape rolled out from the casing. Therefore, it is possible to hold the unrolled portion in a proper attitude and at the same time prevent the unrolled portion from being retracted into the casing, during transport and storage of the tape cartridge and further when the tape cartridge is mounted in the cartridge compartment.

Preferably, the tape-holding member has a pressing portion for pressing the end of the unrolled portion, and a receiving portion for receiving the end of the unrolled portion pressed by the pressing portion.

According to this preferred embodiment, the leading end of the unrolled portion of the tape can be immovably held without causing any inconvenience of unrolling of the tape, and can be prevented from being drawn back into the casing.

Preferably the tape-holding member is mounted in the casing in a state urged in a direction of projecting out of the casing, such that the tape holding-member can be protruded from the casing and retracted therein.

According to this preferred embodiment, the tape-holding member protruding from the casing is given resistance to a shock.

To attain the second object, according to a fourth aspect of the invention, there is provided a tape cutting device comprising:

a cartridge compartment;

a tape cartridge for being mounted in the cartridge compartment, the tape cartridge having:

a casing for accommodating a roll of tape; and a tape-holding member protruding from the casing, for holding an end of an unrolled portion of the roll of tape rolled out from the casing for permitting the roll of tape to be rolled out from the casing, thereby ensuring that the roll of tape is mounted in the cartridge compartment in a state in which the roll of tape accommodated within the casing has the unrolled portion rolled out from the casing, the tape-holding member having a pressing portion for pressing the end of the unrolled portion, and a receiving portion for receiving the end of the unrolled portion pressed by the pressing portion, the tape-holding member being mounted in the casing in a state urged in a direction of projecting out of the casing, such that the tape holding-member can be protruded from the casing and retracted therein; and a cutting device facing the cartridge compartment, for cutting off the unrolled portion, the cutting device operating along a cutting line, wherein at least one of the pressing portion and the receiving portion has an outer end from which the unrolled portion extends out of the tape cartridge, and wherein the cutting line is parallel with and positioned close to the outer end of the at least one of the pressing portion and the receiving portion of the tape-holding member of the tape cartridge mounted in the cartridge compartment.

According to this tape cutting device, the leading end of the unrolled portion of the roll held by the tape-holding member can be brought close to the cutting line of the cutting device. Therefore, the tape-holding member can be made use of as means for holding the tape when the tape is cut. This makes it possible to accurately cut the tape along the cutting line.

Preferably, the cutting device has a fixed blade, a movable blade performing a cutting operation on the fixed blade, a tape retainer for pressing the leading portion of the unrolled portion via the tape-holding member on the fixed blade, in a state of the tape cartridge being mounted in the cartridge compartment.

According to this preferred embodiment, when the movable blade is operated against the fixed blade, the leading end of the unrolled portion can be immovably pressed on the fixed blade by the tape retainer via the tape-holding member. This makes it possible to cut off the tape with higher accuracy.

Preferably, the movable blade is a rotary cutter blade, and at the same time the cutting device further includes reciprocation means for causing the movable blade to reciprocated along the cutting line, and the tape retainer is caused to reciprocate ahead of the rotary cutter blade by the reciprocation means in a state pressing on the tape-holding member.

According to this preferred embodiment, by the use of the rotary cutter blade as the movable blade, even a wide tape can be accurately cut along the cutting line. Further, a cutting portion of the tape can be sequentially held by the tape retainer. This makes the cutting operation free from the problem of balance of pressure to be applied to the cutting portion, compared with a case where the whole width of the tape is retained by the tape retainer.

Preferably, the tape cutting device further includes a printing mechanism for printing on the unrolled portion of the roll of tape.

According to this preferred embodiment, the unrolled portion of the roll of tape is stably held by the tape-holding member. This makes it possible to perform printing with a constant print quality.

To attain the third object, according to a fifth aspect of the invention, there is provided a tape cartridge comprising:

a roll of printing tape;

a roll of laminating tape for having an unrolled portion thereof laminated onto an unrolled portion of the printing tape;

a casing for removably accommodating the roll of printing tape and the roll of laminating tape; and a tape-supporting frame rotatably supporting at least one of the roll of printing tape and the roll of laminating tape, the tape-supporting frame being removably mounted in the casing.

According to this tape cartridge, the roll of printing tape and the roll of laminating tape are removably accommodated within the casing. Therefore, when the tapes are used up, or damaged, they can be replaced by new ones. Further, at least one of the roll of printing tape and the roll of laminating tape is supported by the tape-supporting frame within the casing, these tapes can be removed together with tape-supporting frame. In doing this, since the at least one of the roll of printing tape and the roll of laminating tape is rotatably supported by the tape-supporting frame, the tape(s) supported is/are prevented from becoming loosened and it is easy to handle them, e.g. when they are mounted in the tape cartridge.

Preferably, the tape-supporting frame is in the form of a case.

According to this preferred embodiment, when the roll of printing tape and the roll of laminating tape are transported or stored, they can be protected by the tape-supporting frame.

Preferably, the tape-supporting frame has a tape type-discriminating portion for enabling a type of at least one of the roll of printing tape and the roll of laminating tape to be detected therefrom.

According to this preferred embodiment, it is not required to provide the tape type-discriminating portion on the tape itself (e.g. on the tape core), and the construction for tape type detection can be simplified. Further, the provision of the tape type-discriminating portion prevents the erroneous replacement of tapes.

Preferably, one of the casing and the tape-supporting frame is formed with a protruding portion for preventing erroneous mounting of the tape-supporting frame on the casing, and another of the casing and the tape-supporting frame is formed with a recess for having the protruding portion fitted therein.

According to this construction, the erroneous replacement of tapes can be prevented mechanically by the tape-supporting frame.

More preferably, the tape-supporting frame accommodates the roll of printing tape alone, and has a mounting portion for having the roll of laminating tape removably mounted thereon when the tape-supporting frame is not mounted on the casing.

According to this preferred embodiment, a roll of laminate tape available for replacement or removed from the tape cartridge can be mounted on the mounting portion of the tape-supporting frame, whereby the laminating tape can be prevented from rolling, thereby facilitating the handling of the same.

To attain the third object, according to a six aspect of the invention, there is provided a tape cartridge, comprising:

a roll of printing tape; and a casing for removably accommodating the roll of printing tape, the casing having:

a contacting member for contacting a peripheral surface of the roll of printing tape, and rolling on the peripheral surface as the roll of tape is unrolled, a support member for supporting the contacting member such that the contacting member can be moved in a direction of radius of the roll of printing tape, and an urging member for urging the contacting member toward the roll of printing tape via the support member.

According to this tape cartridge, the roll of printing tape can be pressed on by the contacting member, which prevents the printing tape from rotating by vibration, becoming loose within the casing, and being drawn back into the casing.

Preferably, the contacting member is a roller supported by the support member in a freely rotatable manner.

According to this preferred embodiment, the contacting member rolls on the printing tape rolled out as the printing proceeds. This makes it possible to prevent the printing surface of the printing tape from being damaged by the contacting member.

To attain the third object, according to a seventh aspect of the invention, there is provided a tape cartridge comprising:

a roll of printing tape;

a roll of laminating tape for having an unrolled portion thereof laminated onto an unrolled portion of the printing tape; and a casing for replaceably accommodating the roll of printing tape and the roll of laminating tape, the roll of printing tape and the roll of laminating tape having unrolled portions respectively having leading end portions, non-adhesive portions following the leading end portions and prevented from being affixed to each other, and lamination-starting portions following the non-adhesive portions, the roll of printing tape and the roll of laminating tape being supplied for replacement, with the leading end portions being provisionally laminated, and at same time, placed into a state initialized for use only when the roll of printing tape and the roll of laminating tape are mounted in the casing, and then the lamination-stating portions being affixed to be laminated, by pulling the leading portions over a predetermined length, wherein the case has an outer surface, and a guide formed on the outer surface in a straight line for guiding the unrolled portions of the roll of printing tape and the roll of laminating tape being rolled out.

According to this tape cartridge, the unrolled portions of the printing tape and the laminating tape for replacement have respective leading end portions for being provisionally affixed, non-adhesive portions, and lamination-starting portions, in a sequence from respective leading edges in the mentioned order. By pulling the provisionally laminated leading end portions in a straight line to cause lamination of the lamination-starting portions, it is possible to accurately position these tapes one upon the other and laminate them. By pulling the tapes in a manner guided by the guide provided on the casing, the tapes can be pulled in a straight line, and so even if this operation is entrusted to the user, these tapes can be accurately laminated.

To attain the third object, according to an eighth aspect of the invention, there is provided a tape cartridge comprising:

a roll of printing tape;

a roll of laminating tape for having an unrolled portion thereof laminated onto an unrolled portion of the printing tape; and a casing for accommodating the roll of printing tape and the roll of laminating tape, the laminating tape having:

a body of tape;

a tape core on which the body of tape is wound around to form a roll, the roll of the body of tape having opposite ends; and a pair of flanges arranged on the tape core for holding the opposite ends of the roll of the body of tape in a sandwiching manner.

Some laminating tapes can be unevenly coated with an adhesive due to manufacturing process. In such a case, the shape of the roll of laminating tape can be axially changed from a cylindrical shape to an oblique cone shape. According to the preferred embodiment, the roll of laminating tape is sandwiched by the pair of flanges, which prevents axial deformation of the shape of the roll of laminating from the cylindrical shape to the oblique cone shape.

To attain the third object, according to a ninth aspect of the invention, there is provided a tape printing apparatus including a tape cartridge for being removably mounted therein, the tape cartridge comprising:

a roll of printing tape;

a roll of laminating tape for having an unrolled portion thereof laminated onto an unrolled portion of the printing tape;

a casing for removably accommodating the roll of printing tape and the roll of laminating tape; and a tape-supporting frame rotatably supporting at least one of the roll of printing tape and the roll of laminating tape, the tape-supporting frame being removably mounted in the casing.

To attain the third object, according to a tenth aspect of the invention, there is provided a tape printing apparatus including a tape cartridge for being removably mounted therein, the tape cartridge comprising:

a roll of printing tape; and a casing for removably accommodating the roll of printing tape, the casing having:

a contacting member for contacting a peripheral surface of the roll of printing tape, and rolling on the peripheral surface as the roll of tape is unrolled, a support member for supporting the contacting member such that the contacting member can be moved in a direction of radius of the roll of printing tape, and an urging member for urging the contacting member toward the roll of printing tape via the support member.

To attain the third object, according to an eleventh aspect of the invention, there is provided a tape printing apparatus including a tape cartridge for being removably mounted therein, the tape cartridge comprising:

a roll of printing tape;

a roll of laminating tape for having an unrolled portion thereof laminated onto an unrolled portion of the printing tape; and a casing for replaceably accommodating the roll of printing tape and the roll of laminating tape, the roll of printing tape and the roll of laminating tape having unrolled portions respectively having leading end portions, non-adhesive portions following the leading end portions and prevented from being affixed to each other, and lamination-starting portions following the non-adhesive portions, the roll of printing tape and the roll of laminating tape being supplied for replacement, with the leading end portions being provisionally laminated, and at same time, placed into a state initialized for use only when the roll of printing tape and the roll of laminating tape are mounted in the casing, and then the lamination-stating portions being affixed to be laminated, by pulling the leading portions over a predetermined length, wherein the case has an outer surface, and a guide formed on the outer surface in a straight line for guiding the unrolled portions of the roll of printing tape and the roll of laminating tape being rolled out.

To attain the third object, according to a twelfth aspect of the invention, there is provided a tape printing apparatus including a tape cartridge for being removably mounted therein, the tape cartridge comprising:

a roll of printing tape;

a roll of laminating tape for having an unrolled portion thereof laminated onto an unrolled portion of the printing tape; and a casing for accommodating the roll of printing tape and the roll of laminating tape, the laminating tape having:

a body of tape;

a tape core on which the body of tape is wound around to form a roll, the roll of the body of tape having opposite ends; and a pair of flanges arranged on the tape core for holding the opposite ends of the roll of the body of tape in a sandwiching manner.

According to these tape printing apparatuses of the eighth to twelfth aspects of the invention, since the roll of printing tape and the roll of laminating tape accommodated within the tape cartridge are replaceable, the resource saving and the environmental safety can be achieved by the tape cartridge, and at the same time, running cost can be reduced.

To attain the fourth object, according to a fourteenth aspect of the invention, there is provided a tape printing apparatus comprising:

a printing block for carrying out printing on a printing tape by an ink jet printing method;

a feed roller arranged at a location downstream of the printing block in a direction of feeding of the printing tape, for feeding the printing tape in synchronism with printing operation of the printing block; and a tensioning device arranged at a location upstream of the printing block in the direction of feeding of the printing tape, for applying tension to the printing tape.

According to this tape printing apparatus, the feed roller feeds the printing tape in synchronism with printing operation of the printing block, and at the same time the tensioning applies tension to the printing tape being fed. That is, the printing tape being advanced in a strained state is printed in a desired manner. The feed roller which feeds the printing tape in synchronism with printing operation of the printing block is arranged at a location upstream of the printing block. Therefore, the feed roller does not undergo slipping rotation, and hence the peripheral surface of the feed roller does not rub on the printing surface.

To attain the fourth object, according to a fourteenth aspect of the invention, there is provided a tape printing apparatus for simultaneously advancing a printing tape and a laminating tape, for continuously laminating the laminating tape onto a printed portion of the printing tape, the tape printing apparatus comprising:

a printing block for printing on the printing tape by an ink jet printing method;

a laminating roller arranged at a location downstream of the printing block in a direction of feeding of the printing tape, for advancing the printing tape and the laminating tape while applying pressure onto the printing tape and the laminating tape placed one upon another, the laminating roller advancing the printing tape and the laminating tape in synchronism with printing operation of the printing block; and a tensioning device arranged at a location upstream of the printing block with the direction of feeding of the printing tape, for applying tension to the printing tape.

According to this tape printing apparatus, the laminating roller advances the printing tape and the laminating tape while applying pressure onto the printing tape and the laminating tape, in synchronism with printing operation of the printing block. At the same time, the tensioning device applies tension to the printing tape being fed, so that the printing block carries out printing on the printing tape being advanced in a strained state. The laminating roller, which advances the printing tape and the laminating tape in synchronism with printing operation of the printing block, is arranged at a location downstream of the printing block in a direction of feeding of the tape. Therefore, the laminating roller does not undergo slipping rotation, and hence the peripheral surface of the laminating roller does not rub on the printing surface.

Preferably, the tape printing apparatus includes a tape cartridge for accommodating the printing tape and the laminating tape, and an apparatus body for having the tape cartridge removably mounted therein, the laminating roller having a driving roller and a pressure roller arranged in a manner sandwiching the printing tape and the laminating tape placed one upon another, the pressure roller being incorporated in the tape cartridge.

According to this preferred embodiment, the pressure roller of the laminating roller is incorporated in the tape cartridge. Therefore, the axial length of the pressure roller can be made adjusted to the width of the laminating tape. That is, if the pressure roller is arranged on the body of the apparatus, it is required to adapt the pressure roller to a laminating tape having the maximum width out of various tapes having different widths, so that it becomes difficult to uniformly apply pressure on a narrow laminating tape. In this respect, according to this preferred embodiment, the pressure roller having a width adjusted to the width of the laminating roller is incorporated in the laminating roller, so that the apparatus is free from the above inconvenience.

Preferably, the printing tape has a printing surface and a non-printing surface, and the tensioning device has a printing surface-braking member for being brought into contact with the printing surface of the printing tape, and a non-printing surface-braking member for being brought into contact with the non-printing surface of the printing tape, the printing surface-braking member and the non-printing surface-braking member being arranged in a manner sandwiching the printing tape, the printing surface-braking member having a free roller which is freely rotatable and in rolling contact with the printing surface of the printing tape.

According to this preferred embodiment, out of the printing surface-braking member and the non-printing surface-braking member arranged in a manner sandwiching the printing tape, the non-printing surface-braking member performs substantial braking of the printing tape, whereas the printing surface-braking member is in rolling contact with the printing surface of the printing tape. This prevents the printing tape being advanced from being rubbed by the printing surface-braking member, and hence from being damaged by the same. Therefore, the defective printing caused by damage of the printing surface can be effectively prevented.

More preferably, the printing surface-braking member has an urging member for urging the free roller toward the non-printing surface-braking member.

According to this preferred embodiment, the uniform braking force can be applied to the printing tape.

Further preferably, the free roller and the urging member are incorporated in the tape cartridge, the tape printing apparatus including an apparatus body for having the tape cartridge removably mounted therein, wherein the free roller and the urging member being incorporated in the tape cartridge.

According to this preferred embodiment, the axial length of the free roller can be adjusted to the width of the printing tape, and the braking force can be applied to the printing tape in a manner adapted to the width of the printing tape. This makes it possible to always apply a constant and suitable braking force to any of printing tapes having different widths.

Still more preferably, the tape cartridge has a tape-receiving portion for receiving the printing tape urged by the urging member via the free roller when the tape cartridge is not mounted in the apparatus body.

According to this preferred embodiment, when the tape cartridge is removed from the apparatus body, the free roller holds the printing tape against the tape-receiving portion, thereby preventing roll out of the printing tape. This prevents the printing tape from rotating by vibration, becoming loose within the casing, and being drawn back into the casing.

The above and other objects, features, and advantages of the invention will become more apparent from the following detailed description taken in conjunction with the accompanying drawings.

DETAILED DESCRIPTION

The invention will now be described in detail with reference to the drawings showing a tape printing apparatus according to an embodiment thereof. The tape printing apparatus is an ink jet type that carries out color printing of desired characters and the like entered via a keyboard thereof on a printing tape by an ink jet printing method and cutting off the printed portion of the printing tape to thereby form a label. Further, this tape printing apparatus carries not only a printing tape but also a laminating tape thereon, whereby it is also possible to laminate the laminating tape to the printed portion of the printing tape and cut off the printing tape laminated with the laminating tape to thereby form a laminated label. The printing tape and the laminating tape are provided in a state contained in a tape cartridge.

Figure 1:
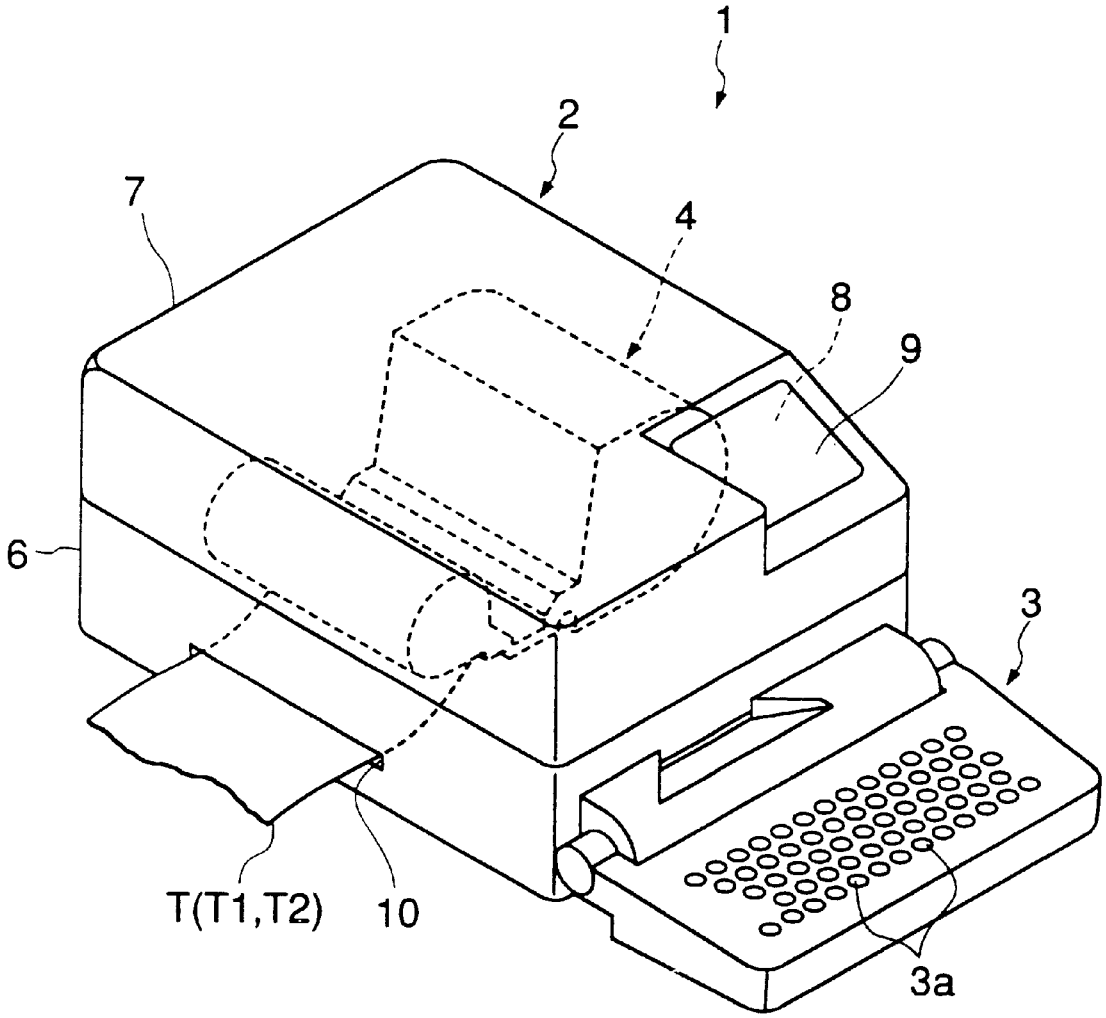
FIG. 1 is a perspective view of an appearance of a tape printing apparatus according to an embodiment of the invention.
Figure 2:
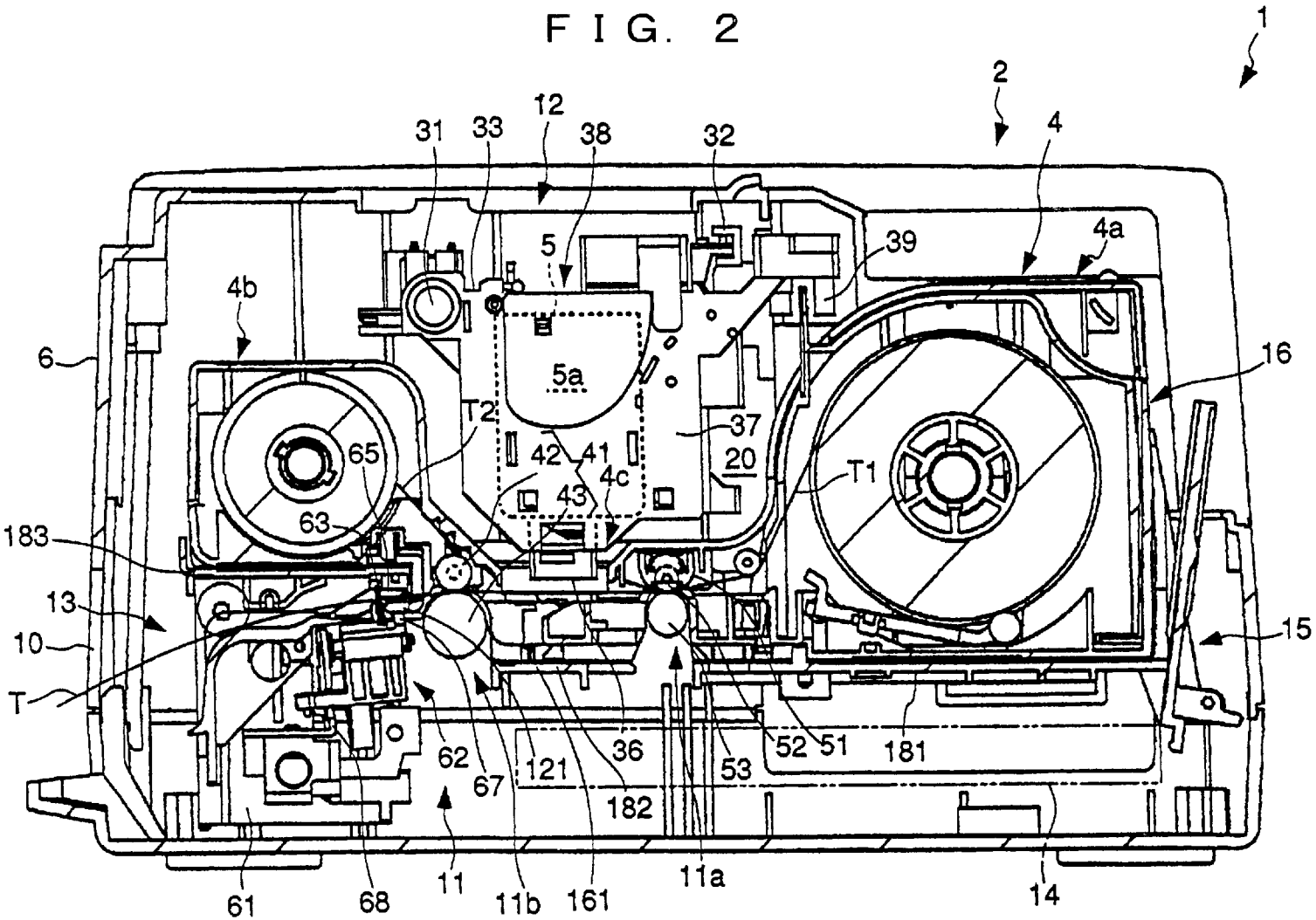
FIG. 2 is a cross-sectional view of the FIG. 1 tape printing apparatus.

FIG. 1 shows the tape printing apparatus in perspective, and FIG. 2 shows the same in cross section. As shown in the figures, the tape printing apparatus 1 is comprised of an apparatus body 2, a keyboard 3 mounted on a front portion of the apparatus body 2, a tape cartridge 4 containing a roll of printing tape T1 and a roll of laminating tape T2, and an ink cartridge 5 containing four colors of ink. The tape cartridge 4 and the ink cartridge 5 are removably mounted in the apparatus body 2.

On the top of the keyboard 3 are arranged various kinds of keys 3*a* which form means of inputting data into the tape printing apparatus 1. In this embodiment, the keyboard 3 is attached to the apparatus body 2 such that the keyboard 3 can be selectively brought to an upright position or to a horizontal position. When the apparatus 1 is used for printing, the keyboard 3 is brought to the horizontal position, whereas when the same is carried by the user, the keyboard 3 is brought to the upright or folded position.

The apparatus body 2 has an apparatus casing 6 upper part of which is formed by a lid 7 which can be opened and closed for inserting and removing (i.e. mounting and unmounting) the tape cartridge 4 and the ink cartridge 5. In a right-side front portion of the lid 7 is formed a small window 9 which corresponds in position to a liquid crystal display block 8 incorporated in the apparatus body 2 when the lid 7 is closed. In a side wall of the apparatus casing 6 is formed a tape exit 10 in the form of a slit through which the laminated printing tape T1 is sent out of the apparatus.

Inside the apparatus casing 6, there are arranged a tape feeder 11 for feeding the printing tape T1 and the laminating tape T2 and at the same time attaching the laminating tape T2 to the printing tape T1, a printing device 12 for applying color printing on the printing tape T1 by an ink jet printing method, a cutting device 13 for cutting off a portion of the printing tape T1 laminated with the laminating tape T2, and a circuit board 14 for controlling operations of these devices and carrying out information processing. Further, the apparatus casing 6 also contains an ejection mechanism 15 for securing the tape cartridge 4 in a position where the above devices can gain access thereto and releasing the same for removal (see FIG. 2).

The tape feeder 11, the printing device 12 and the cutting device 13 are controlled by a control circuit incorporated in the circuit board 14 such that they operate in a manner interlocked with each other. More specifically, after the lid 7 is opened, the tape cartridge 4 is set in the position where the devices can gain access thereto, by the use of the ejection mechanism 15. Then, after the lid 7 is closed, desired characters and the like are entered via the keyboard 3, and a print command is issued. When the tape feeder 11 is driven in response to the print command, the printing tape T1 is unwound from the tape cartridge 4 and printing based on key entries made via the keyboard 3 is effected on the printing tape T1 by the printing device 12. The printing device 12 is arranged such that it faces an intermediate portion of the tape cartridge 4 from above, for accessing the unwound portion of the printing tape T1.

During the printing operation, the printing tape T1 is fed forward, and at the same time the laminating tape T2 is unwound from the tape cartridge 4 to be continuously affixed to the printed portion of the printing tape T1. The printed portion of the printing tape T1 laminated with the laminating tape T2 is sent out by the tape feeder 11 via the tape exit 10. When a trailing edge of the printed portion with a trailing marginal area allowed therefor reaches the cutting position, the tape feeder 11 is stopped to allow the cutting device 13 to cut off the laminated printing tape T. Thus, a laminated label with desired characters and the like printed thereon is formed.

The tape cartridge 4 is of a type containing a printing tape T1 and a laminating tape T2 in a cartridge casing 16, in which a main holding block 4*a* for holding the printing tape T1 and an auxiliary holding block 4*b* for holding the laminating tape T2 are connected by a connecting block 4*c* at an intermediate location. When the tape cartridge 4 is not mounted in the apparatus body 2, it can be made compact by folding the auxiliary holding block 4*b* to the main holding block 4*a* as described in detail hereinafter. It should be noted that in addition to the above tape cartridge 4 containing the printing tape T1 and the laminating tape T2, a tape cartridge, not shown, of a type which is identical to the tape cartridge 4 in appearance, internal construction, and foldability, but different in that it contains the printing tape T1 alone can be provided for the tape printing apparatus 1 according to the embodiment.

Figure 3:
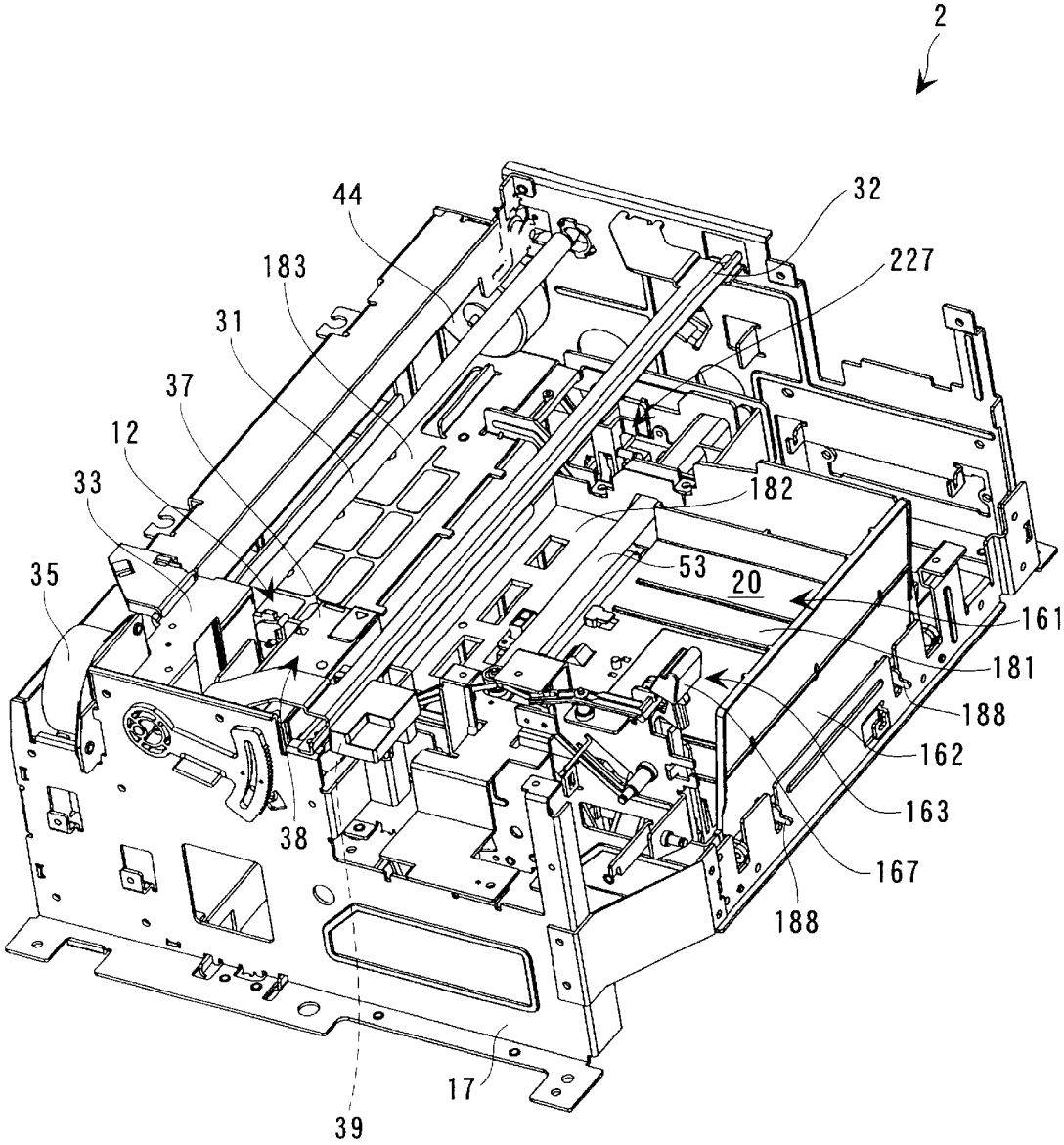
FIG. 3 is a perspective view of a body of the tape printing apparatus in a state in which an apparatus casing is removed.
Figure 4:
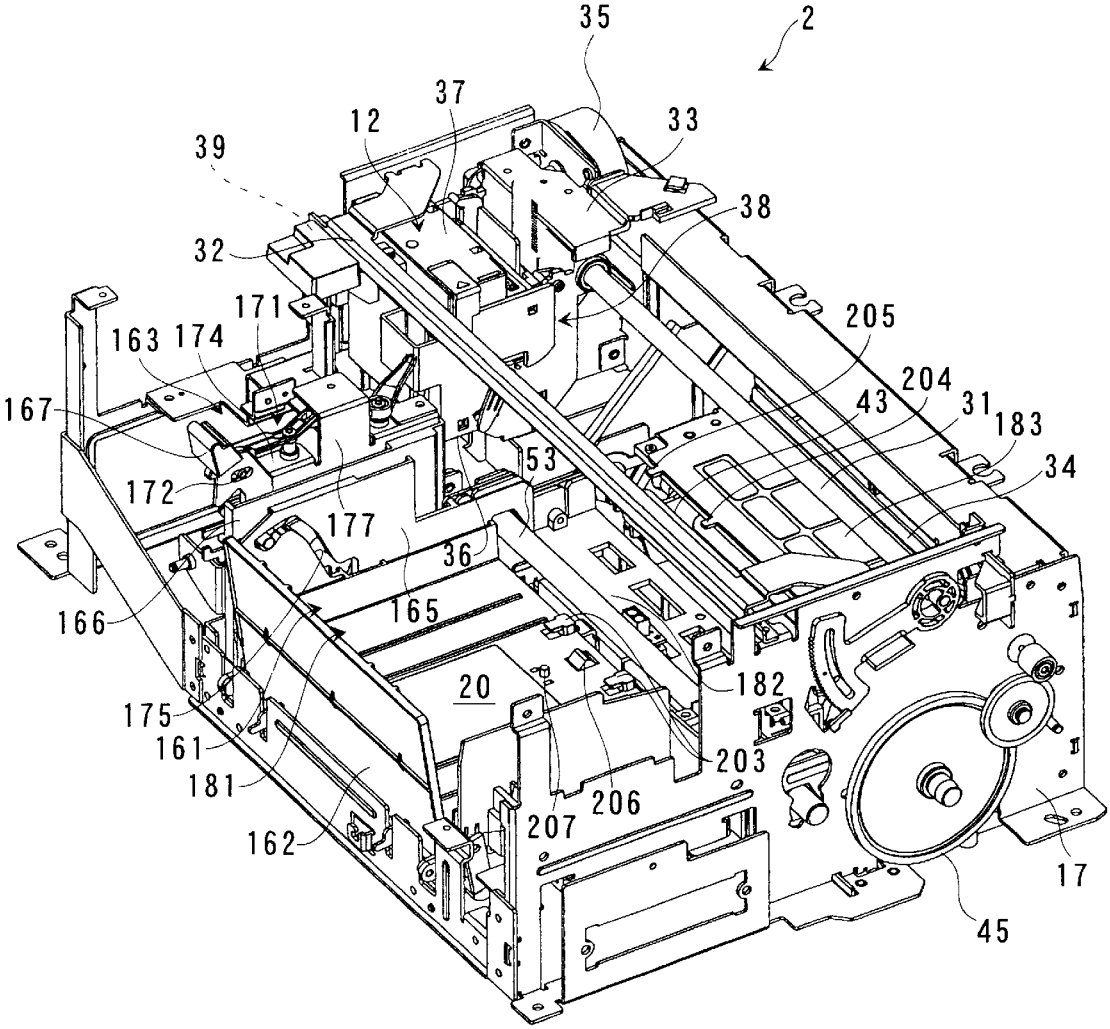
FIG. 4 is another perspective view of the body of the tape printing apparatus in a state in which the apparatus casing is removed.

As shown in FIGS. 2, 3, and 4, the printing device 12 includes a carriage guide shaft 31 having opposite lateral (left and right) ends (one and end face is shown in FIG. 2) thereof supported on a frame 17, a carriage guide bar 32 arranged in parallel with the carriage guide shaft 31, a carriage 33 slidably attached to the carriage guide shaft 31 and the carriage guide bar 32, a timing belt 34 which is driven in a forward or reverse direction to move the carriage 33 in the direction of the width of the printing tape T1 in a reciprocating manner, and a carriage motor 35 for driving the timing belt 34 in a forward or reverse direction. On the carriage 33 are integrally mounted a print head 36 at a lower portion thereof, and a cartridge holder 37 at an upper portion of the same, for holding the ink cartridge 5 therein. That is, the carriage 33, the print head 36, and the cartridge holder 37 form a print head unit 38.

It should be noted that differently from the above description of the whole tape printing apparatus made with reference to FIG. 1, the following description of the tape cartridge 4 and its component parts is made based on the assumption that a direction along a longer side of the tape cartridge in its unfolded state is referred to as a front-rear direction, with the auxiliary holding block-side end as a front side and the main holding block-side end as a rear side. Similarly, it is assumed that a direction orthogonal to the above-defined front-rear direction is referred to as a right-left direction, and hence the arrangement of right and left components should be construed based on the right-left direction thus defined.

The print head 36 is mounted on the carriage 33 in a manner facing downward, and the ink cartridge 5 is also held in the cartridge holder 37 in a manner facing downward. When the ink cartridge 5 is mounted in the cartridge holder 37, ink reservoirs 5*a* containing the inks of different colors, respectively, communicate with the print head 36, whereby ink is allowed to flow from the four ink reservoirs 5*a* to the print head 36. The ink reservoirs 5*a* are filled with yellow ink, cyan ink, magenta ink and black ink, respectively. Further, arranged on the carriage 33 is a photo interruptor 39, described in detail hereinafter, for sensing a type of the tape cartridge 4.

The tape feeder 11 has a printing tape-side tensioning mechanism la and a laminating tape-side tape feed mechanism 11*b* arranged on opposite sides of the printing device 12 in the direction of feeding of the printing tape T1. The tape feed mechanism 11*b* includes laminating roller means 41 comprised of a feed driven roller 42 and a feed drive roller 43 arranged at respective upper and lower positions in a manner rotatably supported on the frame 17, a feed motor 44 for rotating the feed drive roller 43, and a gear train 45 for transmitting torque from the feed motor 44 to the feed drive roller 43. The feed drive roller 43 is arranged in the apparatus body 2, while the feed driven roller 42 is arranged in the tape cartridge 4 (which will be described in detail hereinafter).

When the tape cartridge 5 is mounted in the body 2, the feed driven roller 42 presses the printing tape T1 and the laminating tape T2 in a manner sandwiching the same between the feed drive roller 43 and the feed driven roller 42 itself. The printing tape T1 and the laminating tape T2 are advanced in this state as the feed motor 44 rotates. More specifically, the printing tape T1 and the laminating tape T2 are fed forward with the printed portion of the former being laminated with the latter. It should be noted that the feed of the printing tape T1 and the reciprocation of the print head 36 correspond to the relationship between the main scanning direction and the sub scanning direction in printing technology. Therefore, the feed motor 44 and the carriage motor 35 operate in a manner interlocked with each other.

The tensioning mechanism 11*a* is comprised of a printing surface-side braking member 51 including a free roller 52, and a non-printing surface-side braking member 53. The two members 51 and 53 are arranged at respective upper and lower positions. The non-printing surface-side braking member 53 formed by a stationary roller brakes movement of the printing tape T1 which is being fed forward, in a manner sandwiching the same between the stationary roller and the free roller 52. The non-printing surface-side braking member 53 is arranged in the apparatus body 2, while the printing surface-side braking member 51 is arranged in the tape cartridge 4 (which will be described in detail hereinafter). It should be noted that the non-printing surface-side braking member 53 is not necessarily required to be formed by a stationary roller, but it may be formed by any element having a surface which is arcuate in cross section, for contact with the printing tape T1.

When the tape cartridge 4 is mounted in the apparatus body 2, the printing surface-side braking member (free roller 52) 51 presses the printing tape T1 against the non-printing surface-side braking member 53 in a sandwiching manner. When the tape feed mechanism 11*b* is driven to advance the printing tape T1 in this state, the free roller 52 is brought into rolling contact with the top surface (printing surface) of the tape T1, while the non-printing surface-side braking member 53 is brought into sliding contact with the underside surface (non-printing surface) of the same. As a result, the printing tape T1 is tensioned, and the print head 36 is brought into contact therewith for printing operation.

As described above, the printing tape T1 is advanced together with the laminating tape T2 by the laminating roller means 41 arranged at a location forward (downstream in the direction of feeding of the printing tape T1) of the print head 36 while being tensioned by the tensioning mechanism 11*a* arranged at a location rearward (upstream in the direction of feeding of the printing tape T1) of the same. This construction makes it possible to prevent slipping rotation of the laminating roller means 41 over the tapes T1 and T2 and resultant failure of adhesion of the laminating tape T2. Further, when a tape cartridge of the type containing no laminating tape T2 is mounted in the apparatus 1, it is possible to prevent the printed portion of the tape T1 from being scratched.

As far as the tensioning mechanism 11*a* is concerned, since the free roller 52 is brought into rotating contact with the top surface (printing surface) of the printing tape T1, the printing surface cannot be scratched at all even when the forward movement of the tape T1 is braked, which prevents degradation of printing due to damage to the printing surface. It should be noted that the laminating roller means (feed drive roller 43) 41 and the tensioning mechanism (non-printing surface-side braking member 53) 11*a* are arranged on an identical horizontal plane such that the printing tape T1 can be fed horizontally between them.

Figure 5:
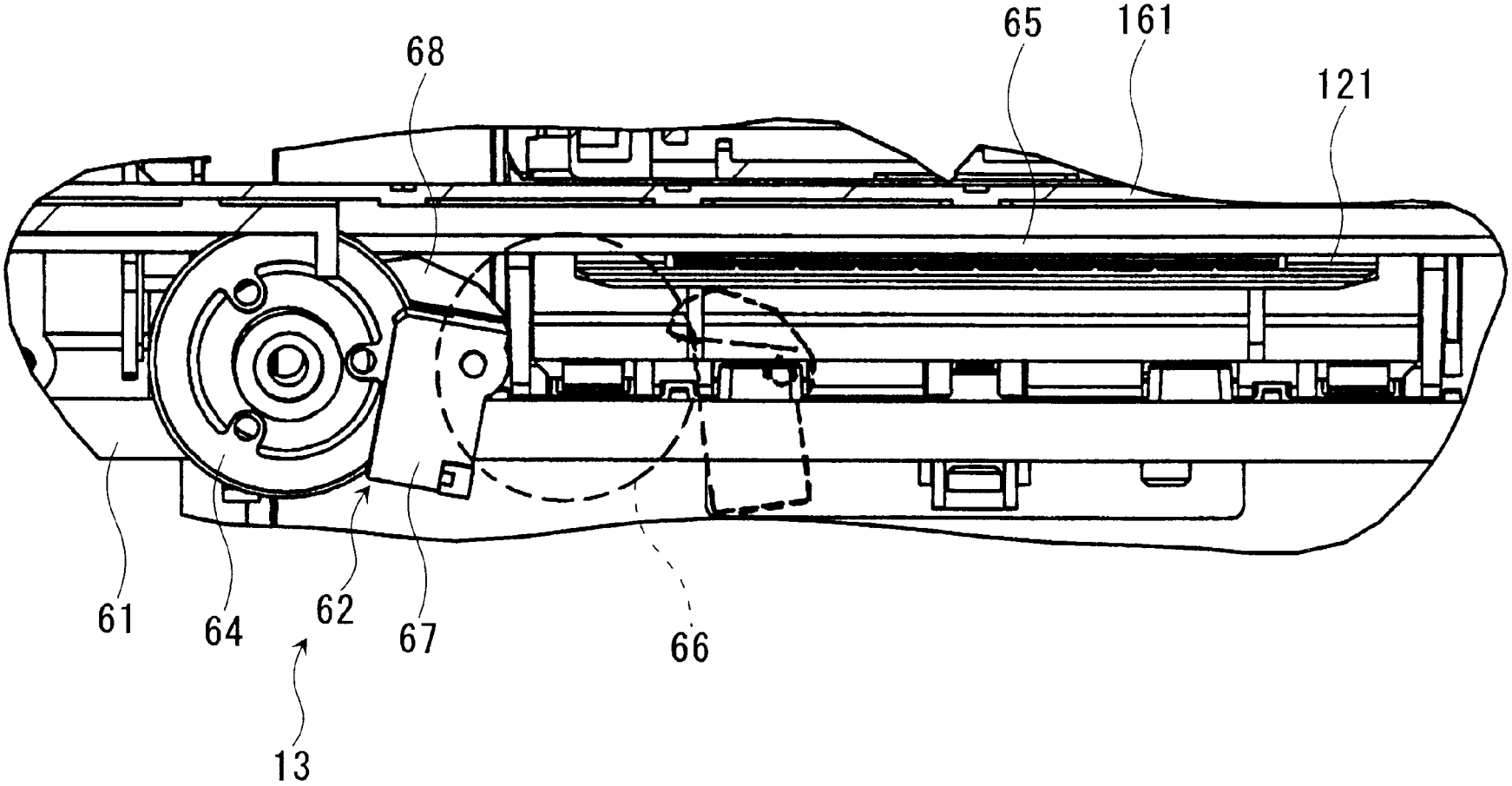
FIG. 5 is a front view of a cutting device of the tape printing apparatus and component parts associated with the cutting device.

As shown in FIGS. 2 and 5, the cutting device 13 is mounted on an underside surface of a forward end portion of an ejection plate 161, referred to hereinafter. The cutting device is comprised of a cutter frame 61, and a self-propelled cutter 62 arranged on the cutter frame 61 such that it can reciprocate along a cutting line 63 (see FIGS. 6 and 7) on the cutter frame 61. Further, the cutter 62 is comprised of a circular cutter blade (rotary cutter blade) 64 which rotates for cutting operation, a stationary blade 65 arranged in a manner opposed to the cutter blade 64 which is a movable blade, a cutter motor 66 for driving the cutter blade 64 for rotation as well as for serving as a drive source for the cutter 62 to drive itself, a tape retainer 67 for pressing the laminated printing tape T against the stationary blade 65 for the cutting operation of the cutter blade 64, and a common base 68 for supporting the component parts 64, 65, 66, and 67.

As described in detail hereinafter, the tape cartridge 4 has a tape-holding member 121 projecting downward from a bottom of the auxiliary holding block 4*b* in a state urged downward. The laminated tape T is guided by the tape-holding member 121 to be brought to the cutting device 13. A front end of the tape-holding member 121 and the cutting line 63 are arranged in parallel and close to each other, to allow the laminated printing tape T to be cut orthogonally to a direction of extension of the tape T at a location immediately forward of the tape-holding member 121.

Figure 6:
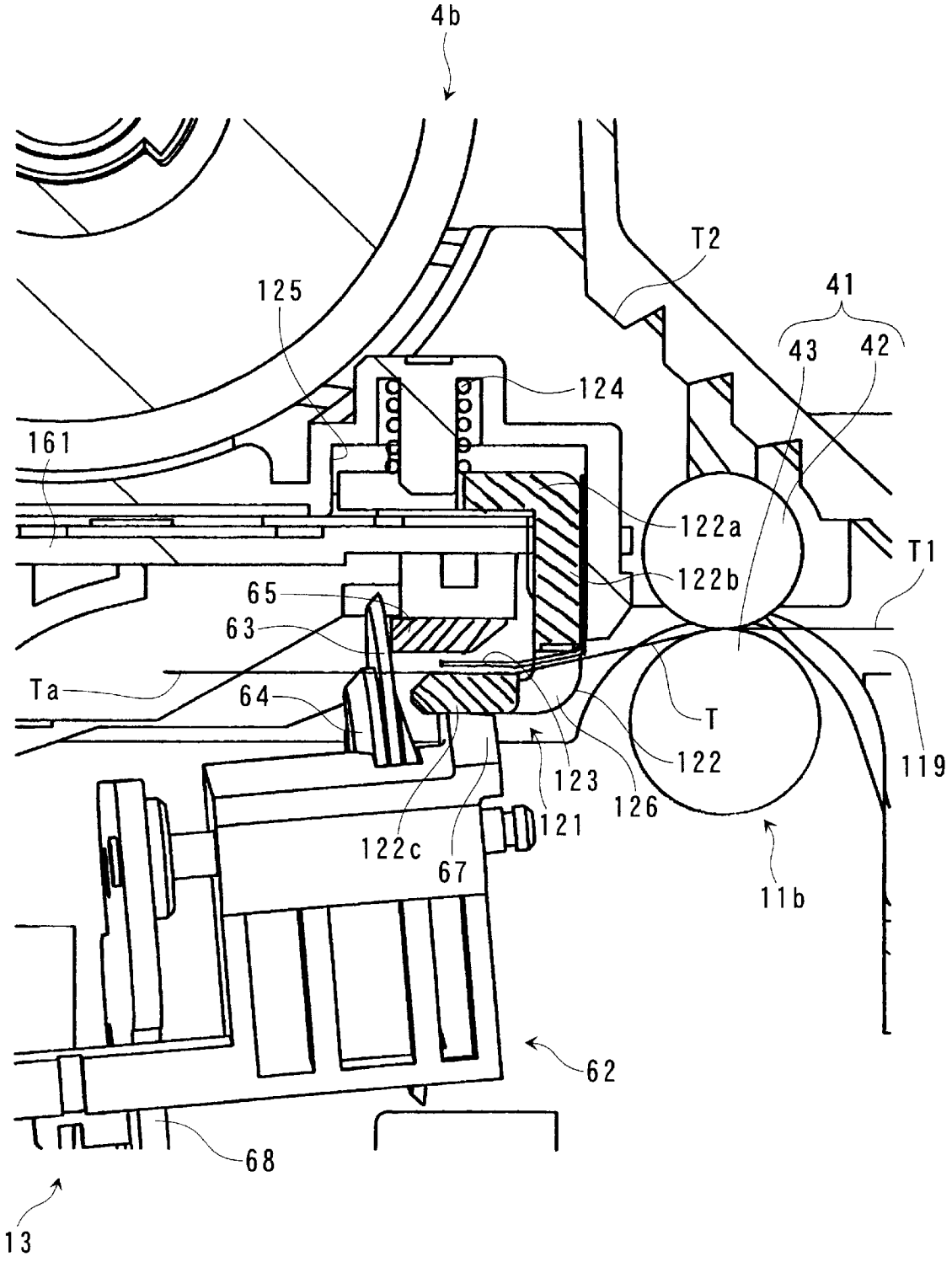
FIG. 6 is an enlarged side view of the cutting device and component parts associated therewith.
Figure 7:
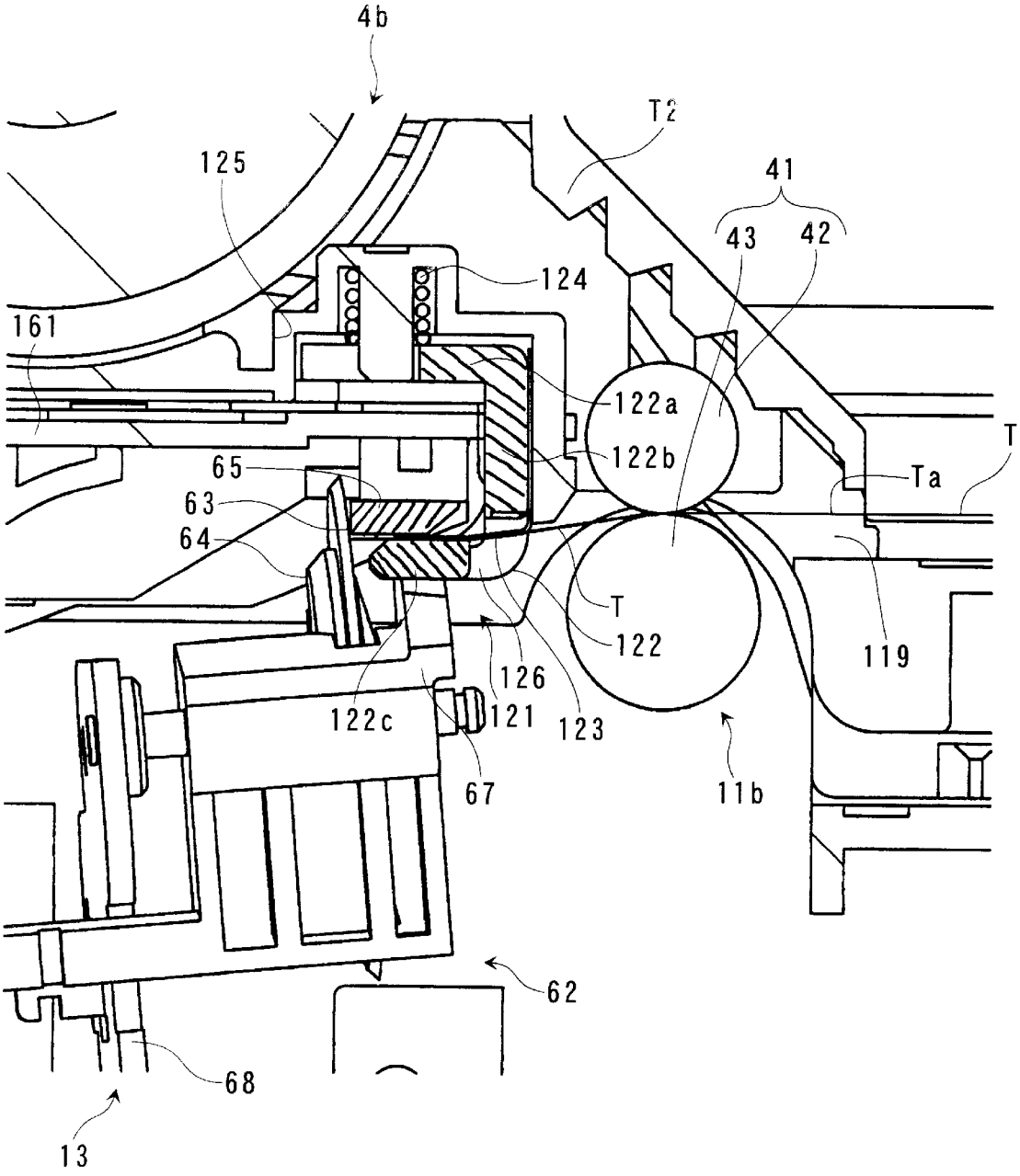
FIG. 7 is an enlarged side view which is useful in explaining operation of the cutting device and the component parts associated therewith.

As shown in FIGS. 6 and 7, the tape retainer 67 is pivotally mounted on the common base 68 in a state pivotally urged in one direction. As the cutter 62 travels (reciprocates), the tape retainer 67 is brought into engagement with the tape-holding member 121 and presses the same from below in sliding contact therewith. The tape-holding member 121 pressed by the tape retainer 67 presses the laminated printing tape T it holds against the underside surface of the stationary blade 65 to secure the same in a sandwiched manner between the stationary blade 65 and the tape-holding member 121 itself. In this case, the tape retainer 67 is brought to the laminated tape T prior to the cutter blade 64, so that the cutter blade 64 can cut off the laminated printing tape (printed portion) T secured in a sandwiched manner between the stationary blade 65 and the tape-holding member 121, while traveling.

After completion of printing operation, when the tape feed mechanism 11*b* sends the printing tape T1 by a predetermined number of steps (feed increments) corresponding to a predetermined distance, it is stopped, and at the same time, cutting operation is started. The cutting operation may be instructed manually through operation of a key of the keyboard 3. In the cutting operation, the cutter motor 66 operates such that the cutter 62 travels or moves along the cutting line 63. This movement enables the tape retainer 67 to retain or hold the laminated printing tape T continuously and at the same time the cutter blade 64 to cut off the same. When the cutting operation is completed, the laminated printing tape cut off by the cutter blade 64 is sent out of the apparatus by its own weight via the tape exit 10. On the other hand, the cutter 62 moves back along the cutting line 63 to its home or stand by position.

According to the embodiment, since the laminated printing tape T is cut off by the cutter blade 64 while being retained or held by the tape retainer 67, it is possible to cut the tape T in a stable state and accurately at the right angle as well as to give a smooth finish cut to the cut end of the same.

Now, detailed description will be made of the printing tape T1 and the laminating tape T2 accessed by the above-mentioned devices, the tape cartridge 4 for holding these tapes T1 and T2, and further the ejection mechanism 15 for properly mounting the tape cartridge 4 in the apparatus body 2.

The printing tape (printing tape body) T1 is comprised of a substrate tape, an adhesive layer coated on the back of the substrate tape, and a peel-off paper tape affixed to the adhesive layer. The substrate tape is formed of a material that readily absorbs ink, such as paper, paper having a coating, or a film having a coating. The adhesive layer is provided for affixing a printed portion of the printing tape to an object material, such as a file or the like, as a label, while the peel-off paper tape is provided for preventing dust or the like from adhering to the adhesive layer. The laminating tape (laminating tape body) T2 is comprised of a substrate tape and an adhesive layer coated on the back of the substrate tape. The substrate tape is formed of a transparent film having a thickness of approximately 16 to 18 $\mu$m.

The printing tape T1 and the laminating tape T2 to be laminated onto the printing tape T1 are configured to have an approximately identical width and affixed to each other in a state in which the sides of the two tapes T1 and T2 placed one upon the other are aligned. More specifically, the laminating tape T2 has a width slightly smaller (by approximately 0.3 mm) than the printing tape T1 such that slight lateral displacement of the laminating tape T2 can be accommodated when it is affixed to the printing tape T1. That is, the laminating tape T2 has a smaller width than the printing tape T1 by 0.15 mm from both edges of lateral sides of the printing tape T1 so as to accommodate errors in manufacturing the tapes to thereby prevent the laminating tape T2 from extending beyond the printing tape T1 in the direction of the width thereof.

Further, a whole length of the printing tape T1 mounted on the tape cartridge 4 is made slightly shorter than that of the laminating tape T2 such that the printing tape T1 is used up before using up the laminating tape T2, which prevents the printing operation from being carried out on the printing tape T1 when there is not sufficient laminating tape to completely cover the printing tape. It is preferable to inform the user that the remaining length of the printing tape T1 is small immediately before the printing tape T1 is used up. For example, a through hole is formed (or a black filled portion may be formed) in the rear end of the printing tape T1 to enable an optical sensor or the like to trigger an alarm.

Tape cartridges are provided that contain various (approximately eight to ten) kinds of printing tape T1 and laminating tape T2 with various tape widths of from 4.5 mm to 96 mm. More specifically, the tape cartridges 4 are classified into three types "S", "M", and "L" which are different in width, and out of the eight to ten kinds of printing tape T1 and laminating tape T2, several kinds with smaller widths are contained in the "S" type of tape cartridge, several kinds with medium widths in the "M" type, and several kinds with larger widths in the "L" type. It should be noted that there are provided still other printing tapes T1 different in material or having background colors other than white. Therefore, it is possible to use at least several tens of kinds of printing tape T1 and laminating tape T2 including ones to be adopted in the future.

Figure 8:
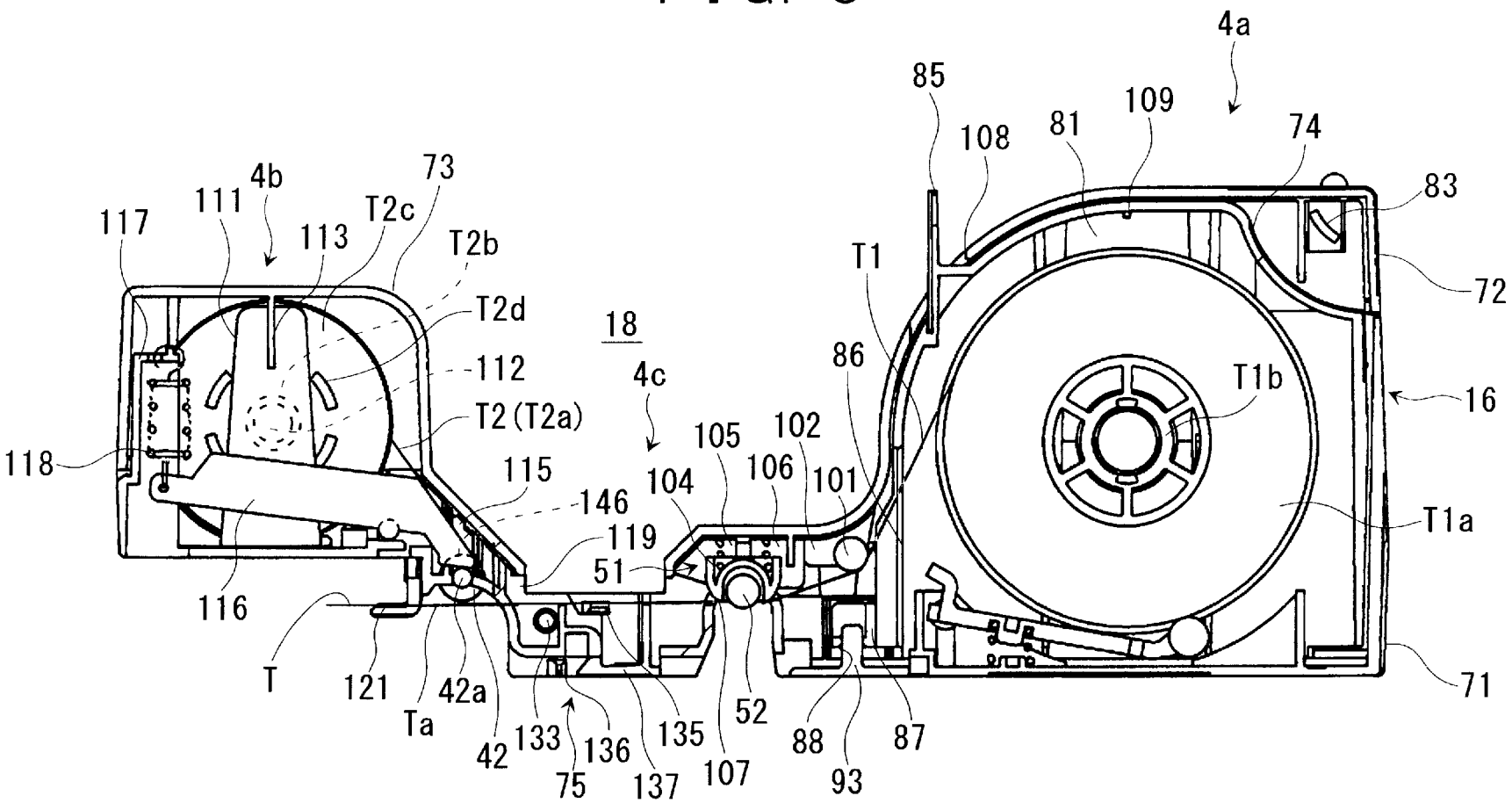
FIG. 8 is a sectional view of a tape cartridge according to the embodiment.
Figure 9:
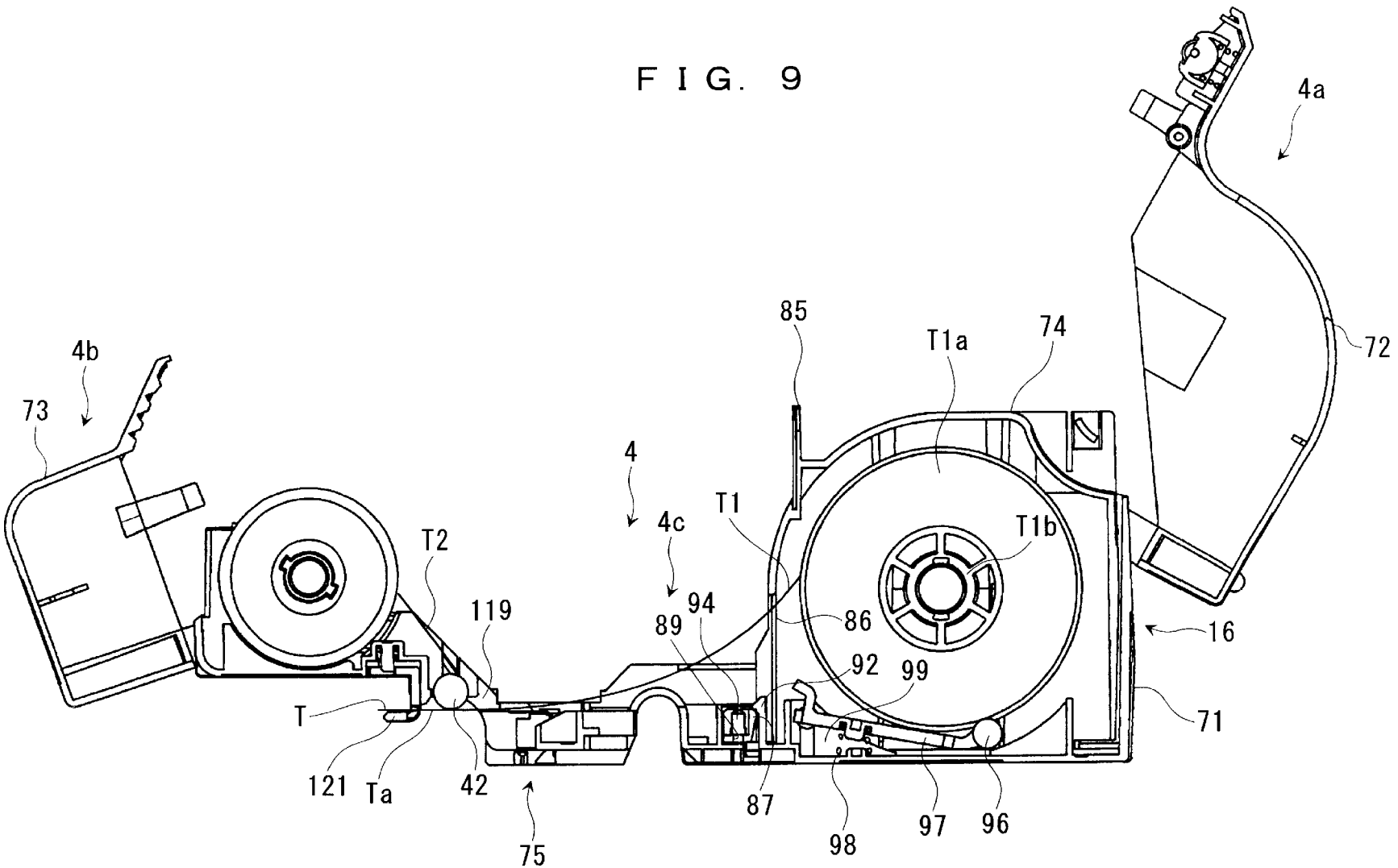
FIG. 9 is a sectional view of the FIG. 8 tape cartridge in a state in which main and auxiliary casing lids thereof are opened.
Figure 10:
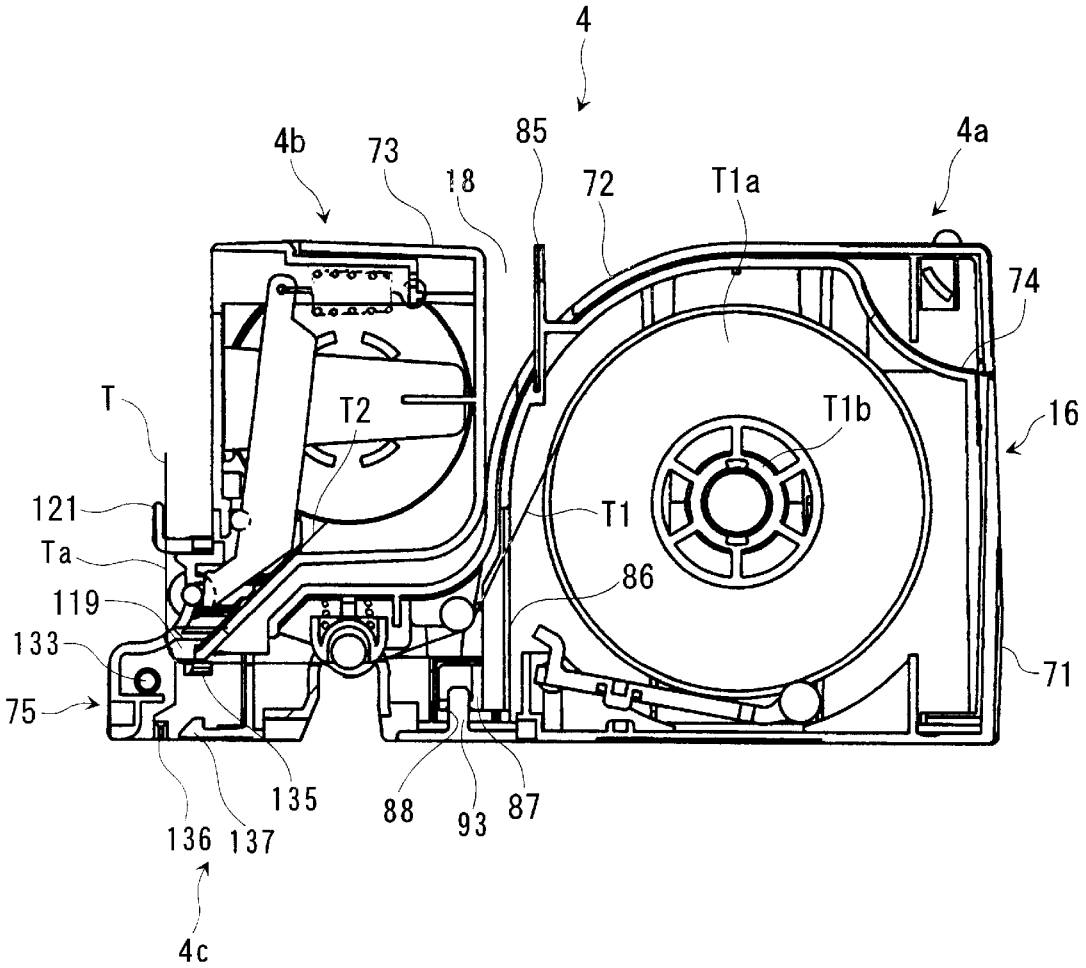
FIG. 10 is a sectional view of the tape cartridge in a folded state.

Next, the tape cartridge 4 will be described by taking the above "M" type of tape cartridge having the medium size as an example. In the tape cartridge 4, as shown in FIGS. 8, 9 and 10, the main holding block 4*a* holding the printing tape T1 and the auxiliary holding block 4*b* holding the laminating tape T2 are connected by the connecting block 4*c* at an intermediate location. Above the connecting block 4*c*, there is formed an upper space 18 having a generally concave shape in cross section, in which the print head unit 38 of the printing device is positioned.

A cartridge casing 16 housing these blocks is formed by a casing body 71, a main casing lid 72 on the main holding block side, and an auxiliary casing lid 73 on the auxiliary holding block side. The cartridge casing 16 is configured such that the user can open the main casing lid 72 and the auxiliary casing lid 73 to replace the printing tape T1 and the laminating tape T2 with new ones, respectively. The printing tape T1 and the laminating tape T2 are provided as a set in a state in which the printing tape T1 in the form of a roll is rotatably contained in a sub casing 74, and the laminating tape T2 also in the form of a roll is uncovered, with leading portions Ta of the respective tapes T1 and T2 provisionally affixed to each other (see FIG. 12), such that the user can mount them in the cartridge casing 16.

Figure 18:
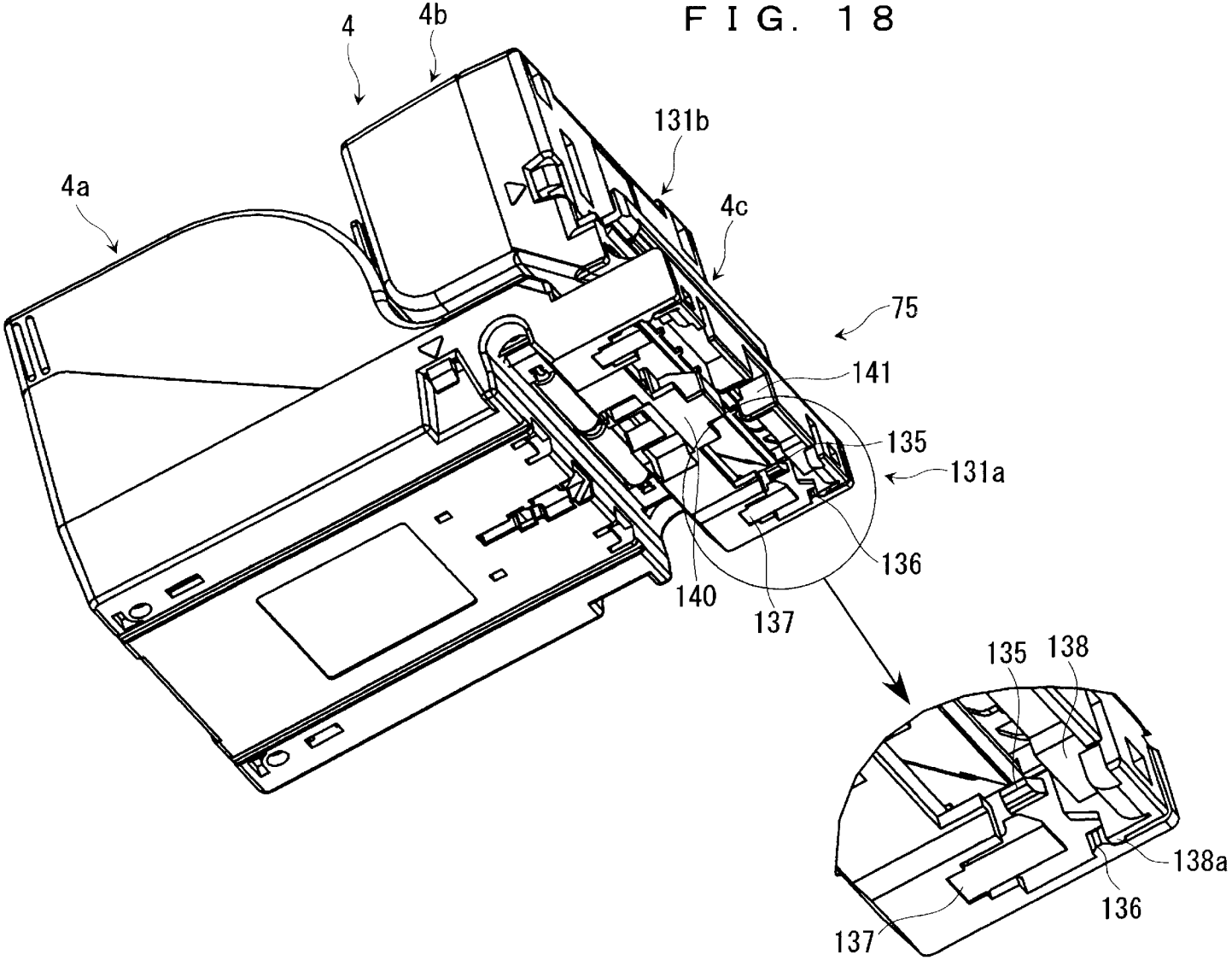
FIG. 18 is a perspective view of the folded tape cartridge, as viewed from below, which is useful in explaining the hinge mechanism and component parts associated therewith.

Further, the cartridge casing 16 is constructed such that the auxiliary holding block 4*b* can be folded to the main holding block 4*a* via a hinge mechanism 75 arranged in the connecting block 4*c* (see FIGS. 10 and 18). Thus, the tape cartridge 4 can be stored or transported in a folded state, except when it is mounted in the apparatus body 2 (which will be described in detail hereinafter).

The printing tape T1 in the form of a roll is stored in the main holding block 4*a* in a state contained in the sub casing 74, while the laminating tape T2 in the form of a roll is stored directly in the auxiliary holding block 4*b*. The roll of printing tape T1 is comprised of a tape core T1*b* and a printing tape body T1*a* wound into a roll around the tape core T1*b*. The printing tape T1 is rotatably supported in the sub casing 74 by the tape core T1*b*.

Figure 11:
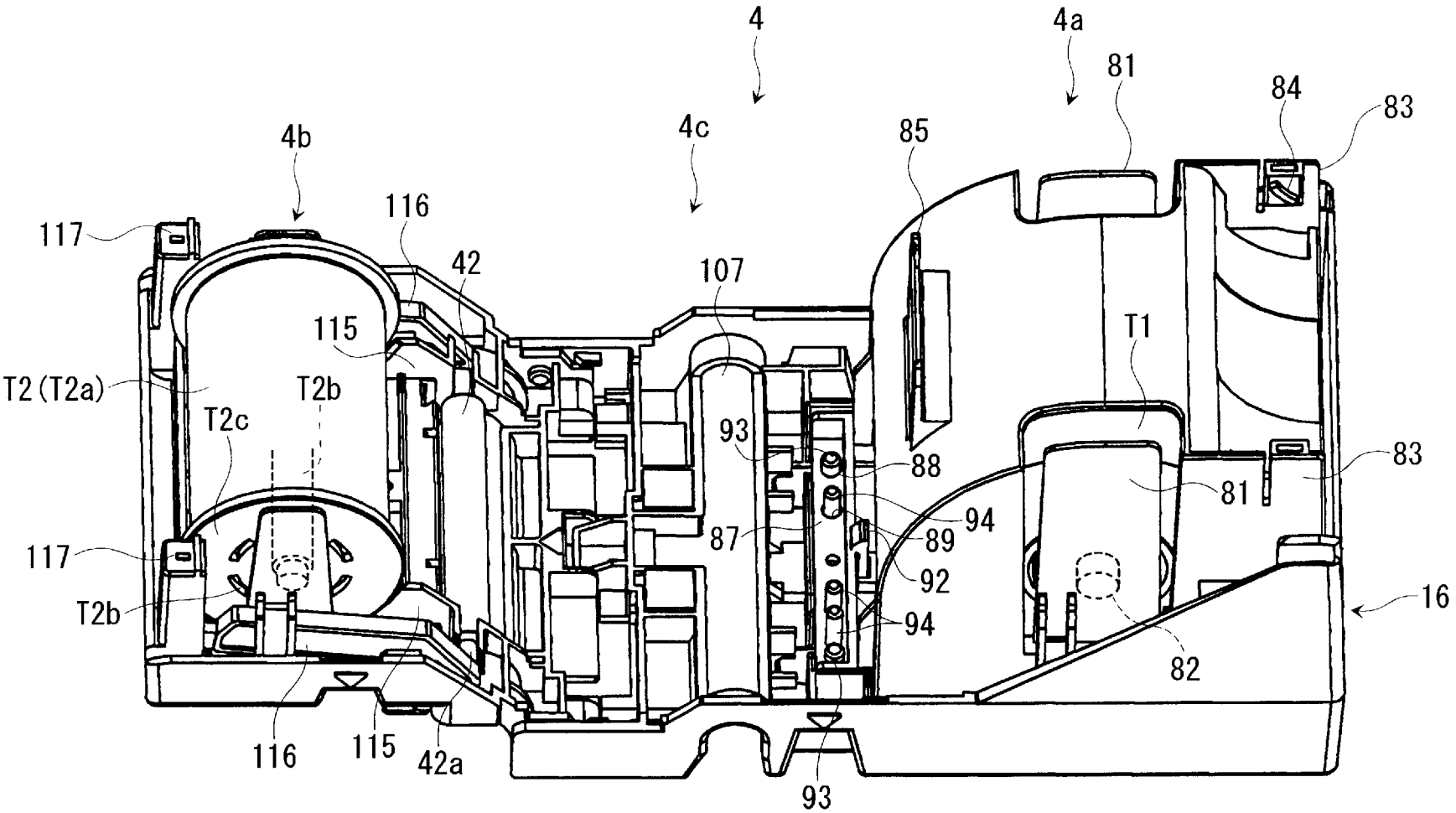
FIG. 11 is a perspective view of the tape cartridge, as viewed from above, in a state in which the main and auxiliary casing lids are removed.
Figure 12:
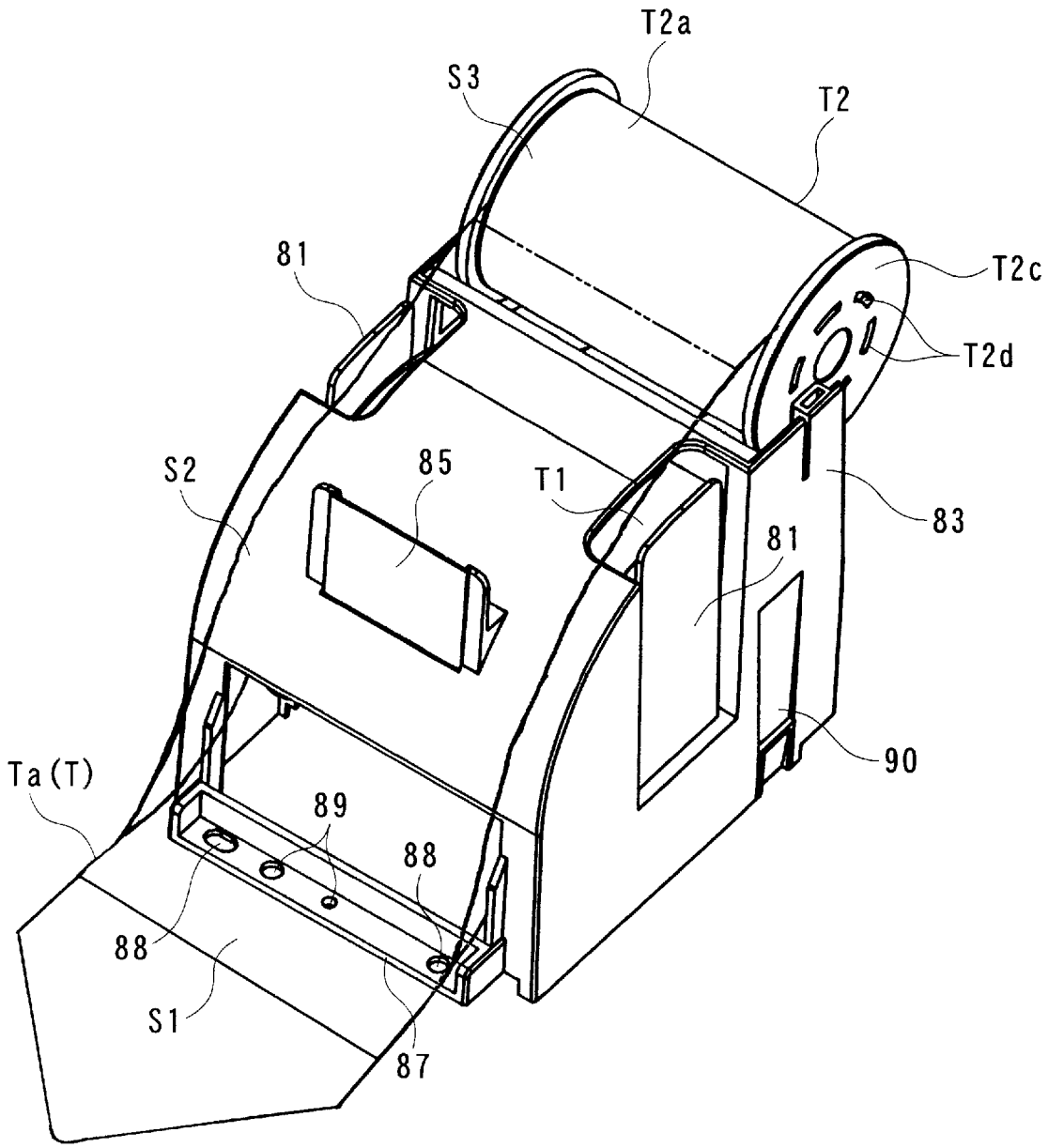
FIG. 12 is a perspective view showing a set of roll of printing tape and an uncovered roll of laminating tape, which is supplied to a user.

The sub casing 74 is a bottomless case having a complementary shape to the inner shape of the main holding block 4*a*. As shown in FIGS. 11 and 12, the sub casing 74 has left-side and right-side intermediate portions thereof each formed with a tape support member 81. The pair of left and right tape support members 81 and 81 are arranged at opposite locations for rotatably supporting the printing tape T1. Each of the tape support members 81 is formed to have a small thickness such that it is resilient and has a shaft projection 82 formed at a vertically intermediate portion thereof in a manner projecting inward. The printing tape T1 is fitted between the tape support members 81 and 81, with the shaft projections 82 and 82 fitted in opposite ends of the tape core T1*b*. Thus, the printing tape T1 is supported in the sub casing 74 in a state held between the tape support members 81 and 81.

On opposite sides of a upper rear portion of the sub casing 74, there are formed a pair of left and right mounting pieces 83 and 83 each having an arcuate projection 84 projecting inward. The uncovered roll of laminating tape T2 is mounted between the pair of mounting pieces 83 and 83 in a manner engaged with the arcuate projections 84 and 84 (as described in detail hereinafter). Further, as best shown in FIGS. 8, 9, and 10, on a upper front portion of the sub casing 74, there is mounted a sensing element 85 for sensing the type of a printing tape T1 and that of a laminating tape T2. The sensing element 85 is in the form of a rectangular plate and printed with a plurality of vertical lines similar to a bar code. During the reciprocating motion of the print head unit 38 described above, the photo interruptor 39 arranged thereon is brought to the sensing element 85 and reads the plurality of vertical lines to discriminate the type of the printing tape T1 and that of the laminating tape T2.

At a lower front portion of the sub casing 74, there is formed a feed opening 86 for sending the printing tape T1 out of the sub casing 74. Further, a setting member 87 projects forward from a lower edge of the feed opening 86. The feed opening 86 has an approximately identical width to that of the printing tape T1 and guides the tape T1 to be fed from the main holding block 4*a*. The setting member 87 is formed with a pair of left and right locating holes 88 and 88 in which a pair of locating pins 93 and 93 of the casing body 71, referred to hereinafter, are fitted, respectively. Further, between the pair of locating holes 88 and 88, there are formed improper mounting-inhibiting holes 89 in each of which an improper mounting-inhibiting pin 94 of the casing body 71 is fitted (see FIGS. 11 and 12). The number and diameter of the improper mounting-inhibiting holes 89 vary with the type (mainly width) of the printing tape T1, and the number and diameter of the improper mounting-inhibiting pins 94 also vary accordingly.

Although the cartridge casings 16 are largely classified into the three sizes "S", "M", and "L" as described above, in most cases, there is provided a cartridge casing of a particular size corresponding to the widths of a printing tape T1 and a laminating tape T2 to be used. Therefore, if the improper mounting-inhibiting pins 94 of the cartridge casing 16 does not match the improper mounting-inhibiting holes 89 of the sub casing 74, it is impossible to mount the sub casing 74 in the cartridge casing 16, which prevents the user from erroneously mounting a printing tape T1 with an improper width in the cartridge casing 16.

Figure 13:
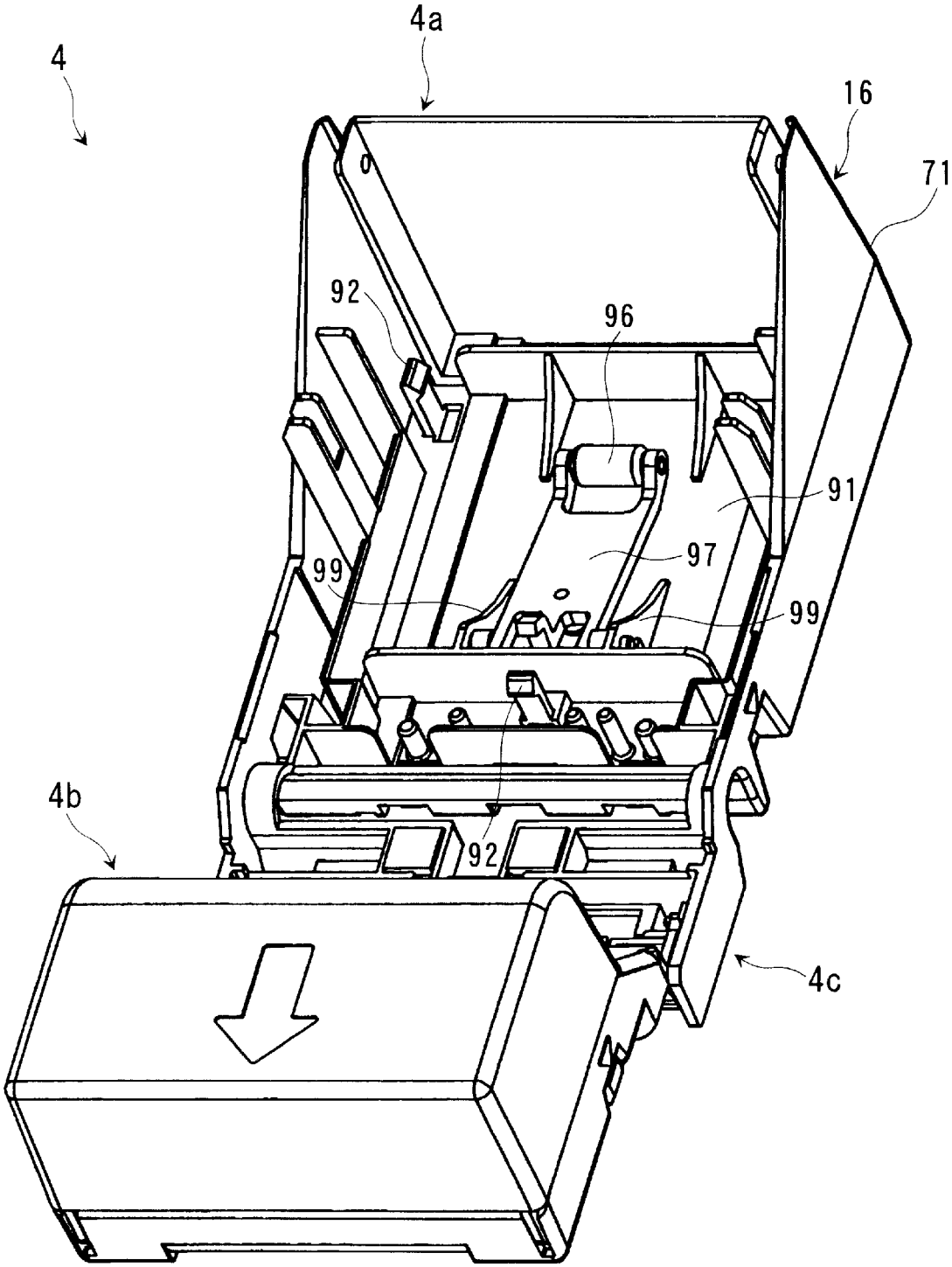
FIG. 13 is a perspective view of the tape cartridge, as viewed diagonally from above, in a state in which the main casing lid and the tape cartridge are removed.

As shown in FIG. 13, the main holding block 4*a* of the body casing 71 is formed with a seating portion 91 on which the sub casing 74 is seated when it is mounted in the cartridge casing 16. The seating portion 91 has three seating nails 92 erected thereon at three different locations, respectively. Two of the seating nails 92 are arranged at respective rear left and right corners of the seating portion 91, for engaging respectively with a pair of left and right shallow recesses 90 and 90 formed in respective lower rear portions of opposite outer side walls of the sub casing 74 (see FIG. 12). The other of the seating nails 92 is erected at a center of a front portion of the seating portion 91, for engaging with the setting member 87 of the sub casing 74 from inside (see FIG. 11). The three seating nails 92 prevent the sub casing 74 from being lifted from the seating portion 91. The locating pins 93 and the improper mounting-inhibiting pins 94 are erected at a location on the seating portion 91 corresponding to the setting member 87 of the sub casing 74 when the sub casing 74 is seated thereon.

Arranged on a central portion of the seating portion 91 are a contact roller 96 for rotating contact with the printing tape T1 rotatably supported in the sub casing 74, a roller arm 97 supporting the contact roller 96 in a rotatable manner, and an urging spring 98 for urging the contact roller 96 toward the printing tape T1 via the roller arm 97. The roller arm 97 is pivotally attached to a pair of left and right rib pieces 99 and 99 erected on the seating portion 91. The urging spring 98 is interposed between the roller arm 97 and a bottom plate of the seating portion 91, for urging the roller arm 97 upward. A path of pivotal motion of the contact roller 96 caused by the roller arm 97 is on a line radially passing through an axis of the roll of printing tape T1, such that the contact roller 96 can constantly radially press on the roll of printing tape T1, which is being radially reduced by consumption of the printing tape T1.

This construction makes it possible not only to prevent the roll of printing tape T1 from loosening within the sub casing 74 but also to prevent the leading portion Ta of the printing tape T1 sent out of the cartridge casing 16 from being drawn back into the same. It should be noted that if the roll of printing tape T1 loosens, the printing surface of the tape T1 can be brought into sliding contact with an inner wall of the sub casing 74 and become damaged. Further, if the leading portion Ta of the printing tape T1 is drawn back into the cartridge casing 16, the printing tape T1 can be separated from the laminating tape T2 at the leading portion Ta thereof.

Figure 14:
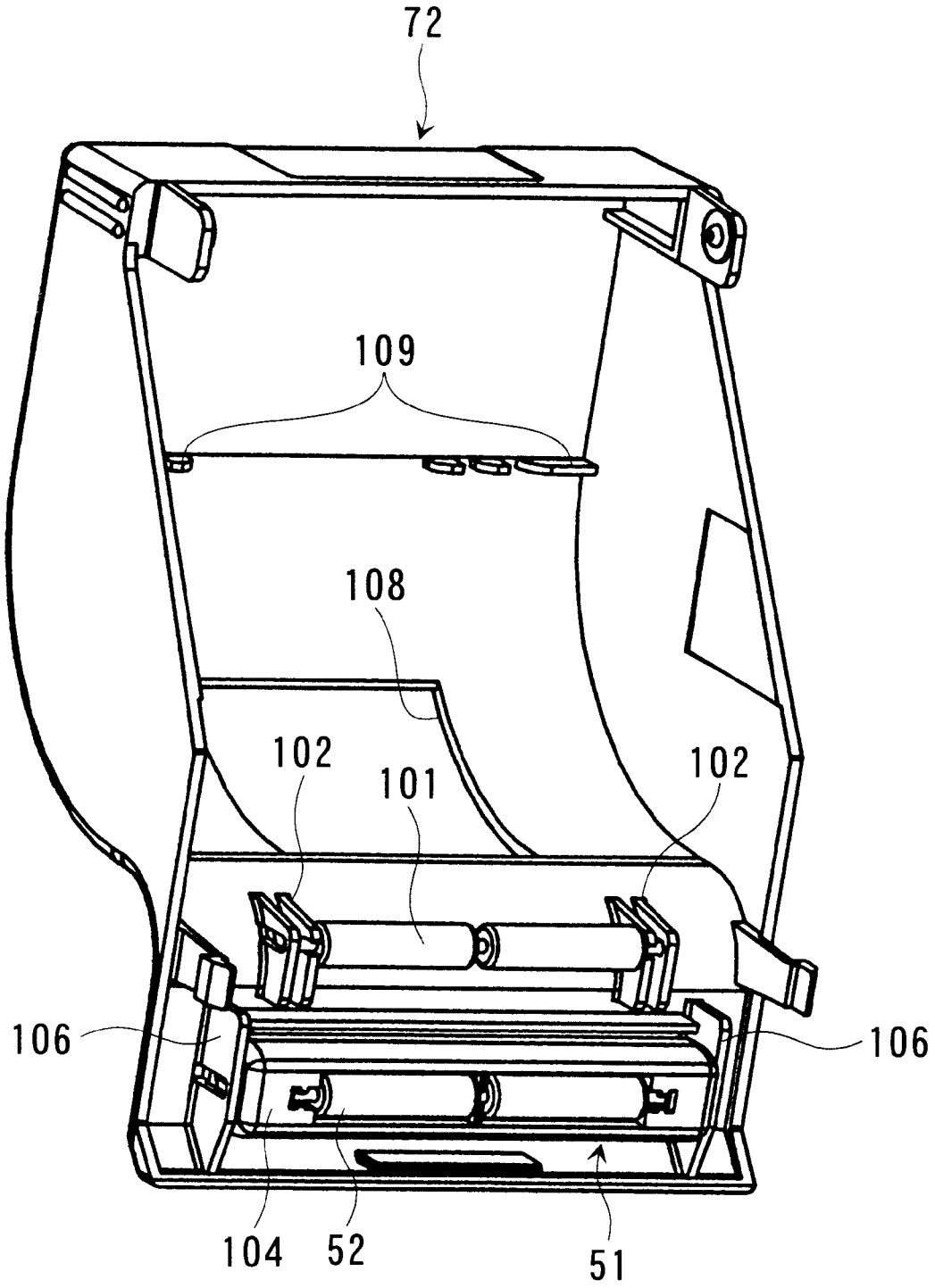
FIG. 14 is a perspective view of the main casing lid as viewed from an inner side thereof.

FIG. 14 shows the main casing lid 72 appearing in FIG. 8, as viewed from an inner side thereof. The main casing lid 72 has a front portion to which the printing surface-side braking member 51 and a guide roller 101 are attached. The guide roller 101 is rotatably supported by a pair of left and right first rib pieces 102 and 102 projecting inward from an inner wall of the main casing lid 72. The guide roller 101 rotates in contact with the printing tape T1 during feeding of the same, to thereby guide the tape T1 so as to keep the same from sliding contact with the an inner wall of the sub casing 74 and an inner wall of the main casing lid 72 (see FIG. 8), thereby preventing the printing surface of the tape T1 from being damaged.

The printing surface-side braking member 51 is comprised of the free roller 52, a roller holder for rotatably supporting the free roller 52, and a brake spring 105 (see FIG. 8) for urging the free roller 52 downward. The roller holder 104 has opposite ends thereof engaged with respective slots formed in a pair of left and right second rib pieces 106 and 106 projecting inward from the inner wall of the main casing lid 72. The roller holder 104 can move vertically along the slots. The brake spring 105 is interposed between the inner wall of the main casing lid 72 and the roller holder 104, for urging the free roller 52 toward the non-printing surface-side braking member 53 arranged in the apparatus body 2 (see FIG. 2).

The body casing 71 is formed with an access opening 107 through which the non-printing surface-side braking member 53 faces the free roller 52 (see FIG. 11). When the tape cartridge 4 is mounted in the apparatus body 2, the non-printing surface-side braking member 53 of the apparatus body is fitted through the access opening 107 and brought into contact with the free roller 52 in a state sandwiching the printing tape T1 between the free roller 52 and the non-printing surface-side braking member 53 itself. On the other hand, when the tape cartridge 4 is removed from the apparatus body 2, the free roller 52 and the roller holder 104 are projected downward to the maximum extent by the urging force of the brake spring 105, to press the printing tape T1 against an edge of the access opening 107. This also makes it possible to prevent the leading portion Ta of the printing tape T1 from being drawn back into the cartridge casing 4. Reference numeral 108 in FIGS. 8 and 11 designates a sensing window through which the sensing element 85 is inserted, and reference numeral 109 a pair of left and right stopper pieces for engagement with the pair of tape support members 81 and 81. The stopper pieces 109 are each formed with a slit for engagement with an upper end of a corresponding one of the tape support members 81, for preventing the tape support member 81 from being warped outward excessively.

As shown in FIGS. 8 and 11, the laminating tape T2 is formed of a tape core T2*b*, a laminating tape body T2*a* in the form of a roll wound around the core T2*b*, and a pair of flange portions T2*c* and T2*c* arranged on opposite ends of the tape core T2*b* in a manner axially sandwiching the laminating tape body T2*a* wound around the tape core T2*b*. Some laminating tapes (laminating tape bodies T2*a*) T2 are unevenly coated with an adhesive due to manufacturing process. In such a case, the shape of the roll of laminating tape (laminating tape body T2*a*) T2 can be axially changed or deformed from a cylindrical shape to an oblique cone shape due to an ambient temperature or the like. According to the present embodiment, since the laminating tape body T2*a* is sandwiched by the pair of flange portions T2*c* and T2*c*, the above-mentioned deformation can be prevented.

Each of the flange portions T2*c* has a side face thereof formed therein with a plurality of arcuate slits T2*d* arranged at predetermined circumferential intervals about the tape core T2*b*. When an uncovered roll of laminating tape T2 is fitted between the pair of mounting pieces 83 and 83, the arcuate projection 84 of each of the mounting pieces 83 is brought into engagement with any one of the arcuate slits T2*d*, whereby the laminating tape T2 is removably attached to the sub casing 4 (see FIG. 12).

The roll of laminating tape T2 configured as above is rotatably supported by a pair of left and right tape support members 111 and 111 each formed in the auxiliary holding block 4*b* in a erected manner. Similarly to the tape support members 81 for holding the printing tape T1, each of the tape support members 111 is formed to have a small thickness such that it is resilient and has a shaft projection 112 formed at a vertically intermediate location thereof in a manner projecting inward. The roll of laminating tape T2 is fitted between the tape support members 111 and 111, with the shaft projections 112 and 112 fitted in the respective opposite ends of the tape core T2*b*. Thus, the roll of laminating tape T2 is supported in the auxiliary holding block 4*b* in a state held between the tape support members 111 and 111. Further, similarly to the main casing lid 72, the auxiliary casing lid 73 has a pair of left and right stopper pieces 113 and 113 projecting downward from an inner top wall thereof for preventing the pair of tape support members 111 and 111 from being warped outward excessively (see FIG. 9).

The feed driven roller 42 is arranged in the auxiliary holding block 4*b* at a location close to the connecting block of the body casing 71. Further, at a location upstream of the feed driven roller 42, there are erected a pair of left and right guide walls 115 and 115 for guiding the laminating tape T2 such that the tape T2 is rolled out properly (see FIG. 11). The feed driven roller 42 which also serves as a tape-laminating roller has a shaft 42*a* thereof with which a pair of left and right tape-laminating arms 116 and 116 are engaged for urging the shaft 42*a* downward. Each of the tape-laminating arms 116 arranged at a location outward of a corresponding one of the tape support members 111 in a manner extending toward a front portion of the body casing 71 is pivotally attached to the body casing 71 at an intermediate location closer to the feed driven roller 42. Between a front end of each of the tape-laminating arms 116 and a corresponding one of spring-retaining portions 117 erected in opposite front corners of the body casing 71, there is interposed a tape-laminating spring 118. The feed driven roller 42 is urged downward by the tape-laminating springs 118 via the tape-laminating arms 116 to be brought into contact with the feed drive roller 43 for sandwiching the printing tape T1 and the laminating tape T2 between the feed drive roller 43 and the feed driven roller 42 itself (see FIG. 2).

Further, as shown in FIG. 9, the auxiliary holding block 4*b* has a guide opening 119 open to the connecting block 4*c* of the body casing 71, for guiding the printing tape T1 therethrough. The guide opening 119 is formed on a path extending from the feed opening 86. Similarly to the feed opening 86, the guide opening 119 has a width which is approximately equal to that of the printing tape T1. The printing tape T1 is fed from the main holding block 4*a* into the auxiliary holding block 4*b* while being guided by the two openings 86 and 119 open to respective opposite ends of the connecting block 4*c*.

On a bottom of the auxiliary holding block 4*b* of the body casing 71, there is mounted a tape-holding member 121 at a location forward of the feed driven roller 42 in a manner projecting downward from the bottom of the auxiliary holding block 4*b*. As shown in FIGS. 6 and 7, the tape-holding member 121 is comprised of a tape catch 122 which forms a main part thereof, a tape-retaining plate 123 arranged along the tape catch 122, an internal spring 124 urging the tape catch 122 downward. The bottom of the auxiliary holding block 4*b* of the body casing 71 is formed with a mounting recess 125 in which a base portion 122*a* of the tape catch 122 is mounted in a state urged downward by the internal spring 124, such that it can slide vertically and cannot fall off.

The tape catch 122 is a unitary member formed of the base portion 122*a*, a downward-projecting portion 122*b* extending downward from the base portion 122*a*, and a horizontal portion 122*c* extending forward from the downward-projecting portion 122*b*. In a boundary between the downward-projecting portion 122*b* and the horizontal portion 122*c*, there is formed a slit 126 having a width which is slightly wider than that of the laminated printing tape T. The leading portion Ta of the laminated printing tape T is guided onto the horizontal portion 122*c* through the slit 126 and retained on an upper surface of the horizontal portion 122*c*. The tape-retaining plate 123 which is generally mirrored L-shaped in cross section extends downward along the rear surface of the downward-projecting portion 122*b*, passes through the slit 126, and extends along the upper surface of the horizontal portion 122*c*. That is, a forward end portion of the leading portion Ta of the laminated printing tape T is retained in a manner sandwiched between the horizontal portion 122*c* of the tape catch 122 and the tape-retaining plate 123.

The tape cartridge 4 is supplied to the user in a folded state, as described hereinafter. However, regardless of whether the tape cartridge 4 is in a folded state or in an unfolded state, the leading portion Ta of the laminated printing tape T is retained by the tape-holding member 121 with its forward end slightly projected from an end of the tape catch 122, which prevents the leading portion Ta of the laminated printing tape T from falling off the tape-holding member 121. Further, since the leading portion Ta is held in a proper position by the tape-holding member 121, it is prevented from getting caught in members arranged in the apparatus body 2 when the tape cartridge 4 is inserted into the apparatus body 2.

As shown in FIG. 6, when the tape cartridge is mounted in the apparatus body 2, the tape-holding member 121 is brought to a position close to the cutting line 63 of the cutter 62 and in parallel with the same. Then, when the cutter 62 starts cutting operation as described hereinbefore, the tape retainer 67 of the cutter 62 presses on the tape-holding member 121 upward. This pressure causes the tape-holding member 121 to move upward against the urging force of the internal spring 124. As a result, the tape-holding member 121 holding the leading portion Ta in a state sandwiched between the tape catch 122 and the tape-retaining plate 123 is sandwiched between the stationary blade 65 and the tape retainer 67.

The printing tape T1 and the laminating tape T2 each wound in the form of a roll are rolled out by the feed driven roller 42 and the feed drive roller 43 (the laminating roller means 41) as described above. In this process, the printing tape T1 is guided to the laminating roller means 41 by the feed opening 86 formed in the sub casing 74 and the guide opening 119 formed in the body casing 71, while the laminating tape T2 is guided to the same by the pair of left and right guide walls 115 and 115.

Figure 15:
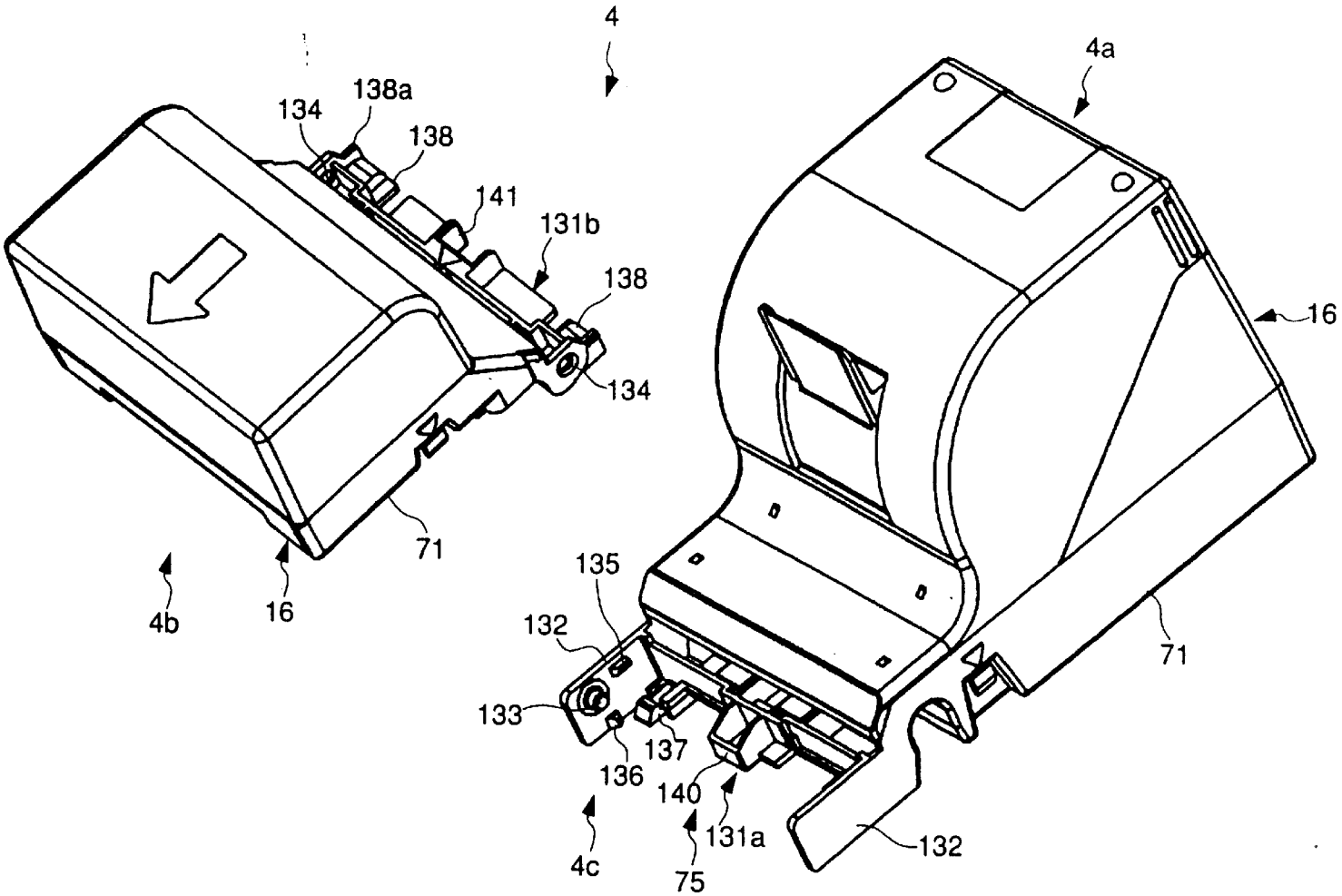
FIG. 15 is an exploded perspective view of the tape cartridge disassembled at a hinge mechanism thereof.

Next, the folding structure of the tape cartridge 4 will be described. As shown in FIG. 15, the tape cartridge 4 is divided at the connecting block 4*c* into the main holding block 4*a* and the auxiliary holding block 4*b*. The two blocks 4*a* and 4*b* can be folded against each other via the hinge mechanism 75 formed by a main holding block-side connecting block 131*a* and an auxiliary holding block-side connecting block 131*b*. When the tape cartridge 4 is unfolded as shown in FIG. 8, the upper space 18 having a generally concave shape in cross section is formed above the connecting block 4*c* and receives the print head unit 38 therein such that it faces the connecting block 4*c*. On the other hand, when the tape cartridge 4 is folded as shown in FIG. 10, the auxiliary holding block 4*b* occupies the upper space 18, whereby the tape cartridge 4 forms a generally rectangular shape. That is, an outer front surface of the main holding block 4*a* and an outer rear surface of the auxiliary holding block 4*b* which define the upper space 18 therebetween are formed to have shapes generally complementary to each other.

As shown in FIG. 15, the main holding block-side connecting block 131*a* and the auxiliary holding block-side connecting block 131*b* are connected in a manner such that a rear end portion of the connecting block 131*b* is sandwiched between a pair of left and right connecting pieces 132 and 132 projecting from a front end portion of the connecting block 131*a*. The hinge mechanism 75 is formed by a pair of pin projections 133 and 133 projecting inward from respective inner surfaces of the pair of connecting pieces 132 and 132 and a pair of left and right pin-receiving holes 134 and 134 formed in respective left-side and right-side outer surfaces of the rear end portion of the auxiliary holding block-side connecting block 131*b* in association with the respective holes 134 and 134. The auxiliary holding block 4*b* is folded against the main holding block 4*a* about the pair of pin projections 133 and 133. It should be noted that in assembling the tape cartridge 4, the auxiliary holding block 4*b* can easily be attached to the main holding block 4*a* simply by bending the pair of connecting pieces 132 and 132 slightly outward and then fitting the rear end portion of the auxiliary holding block 4*b* between the connecting pieces 132 and 132.

As described hereinbefore, formed at the boundary between the auxiliary holding block 4*b* and the auxiliary holding block-side connecting block 131*b* is the guide opening 119 for sending the laminated printing tape T out of the casing, and the leading portion Ta of the laminated printing tape T sent out through the guide opening 119 extends to the tape-holding member 121 arranged at a location downstream of the guide opening 119. The pin projections (folding pivot) 133 are arranged below the printing tape (leading portion Ta) T1, so that when the tape cartridge 4 is folded, the forward end of the leading portion Ta is bent and slides such that it projects forward from the tape-holding member 121 (see FIGS. 8 and 10). Therefore, the forward end of the leading portion Ta is prevented from falling off the tape-holding member 121.

Figure 16:
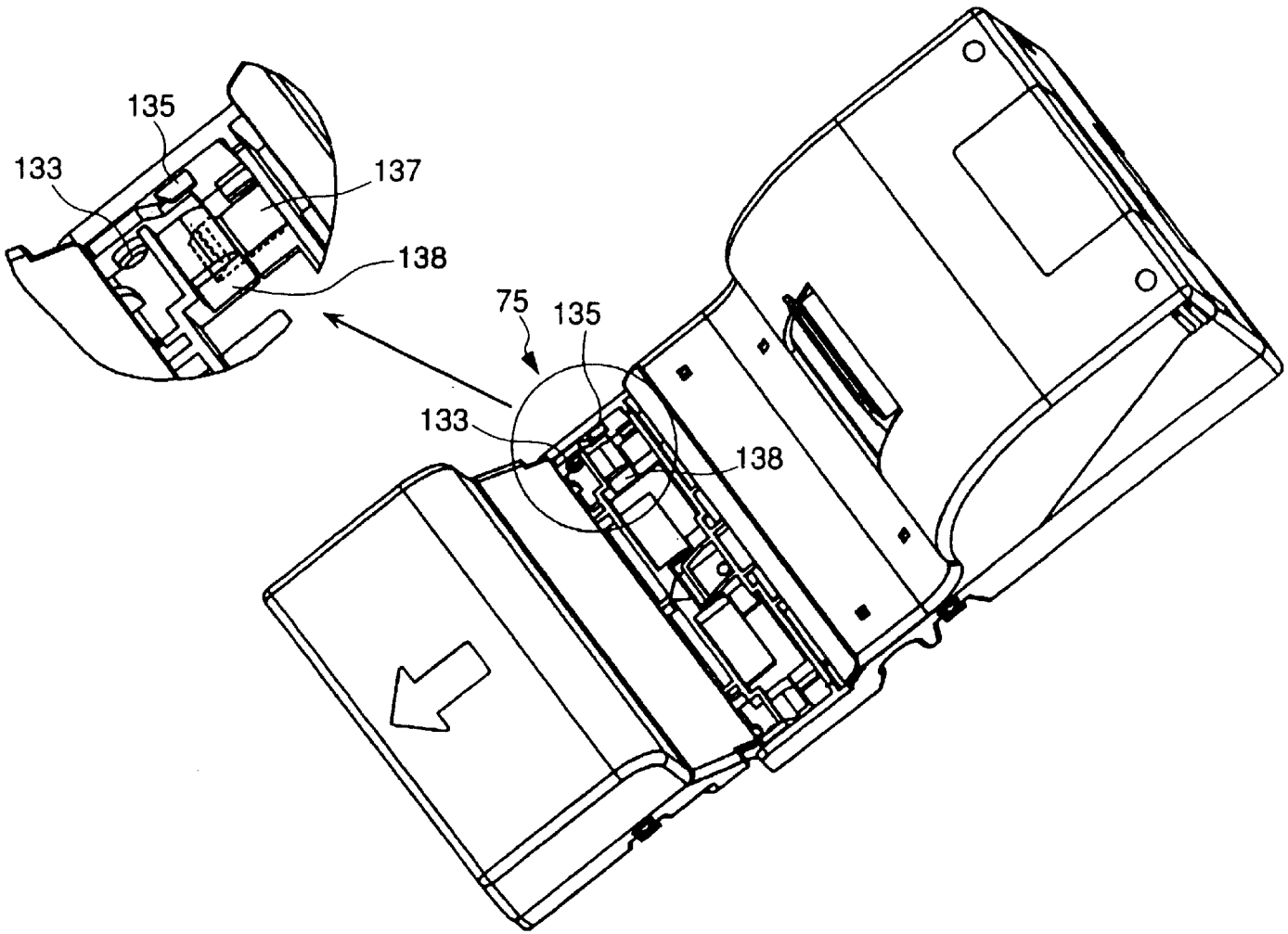
FIG. 16 is a perspective view of the tape cartridge, as viewed from above, which is useful in explaining the hinge mechanism and component parts associated therewith.

Projecting inward from the vicinity of each of the pin projections 133 of the connecting pieces 132 are an opening-limiting projection 135 and a click projection 136. Further, a pair of left and right spring nails 137 each extend forward from the front end of the main holding block-side connecting block 131*a* to the vicinity of a corresponding one of the click projections 136. The auxiliary holding block-side connecting block 131*b* has a pair of left and right engaging blocks 138 formed on the rear end thereof, for proper engagement with the opening-limiting projections 135, the click projections 136, and the spring nails 137. More specifically, when the main holding block 4*a* and the auxiliary holding block 4*b* are in their unfolded state as shown in FIG. 16, the engaging blocks 138 are brought into abutment with the respective opening-limiting projections 135 from below, and the spring nails 137 are brought into abutment with the respective engaging blocks 138 from below, whereby the auxiliary holding block 4*b* is inhibited from being folded toward the main holding block 4*a*. Thus, the two holding blocks 4*a* and 4*b* are held in their unfolded positions.

Figure 17:
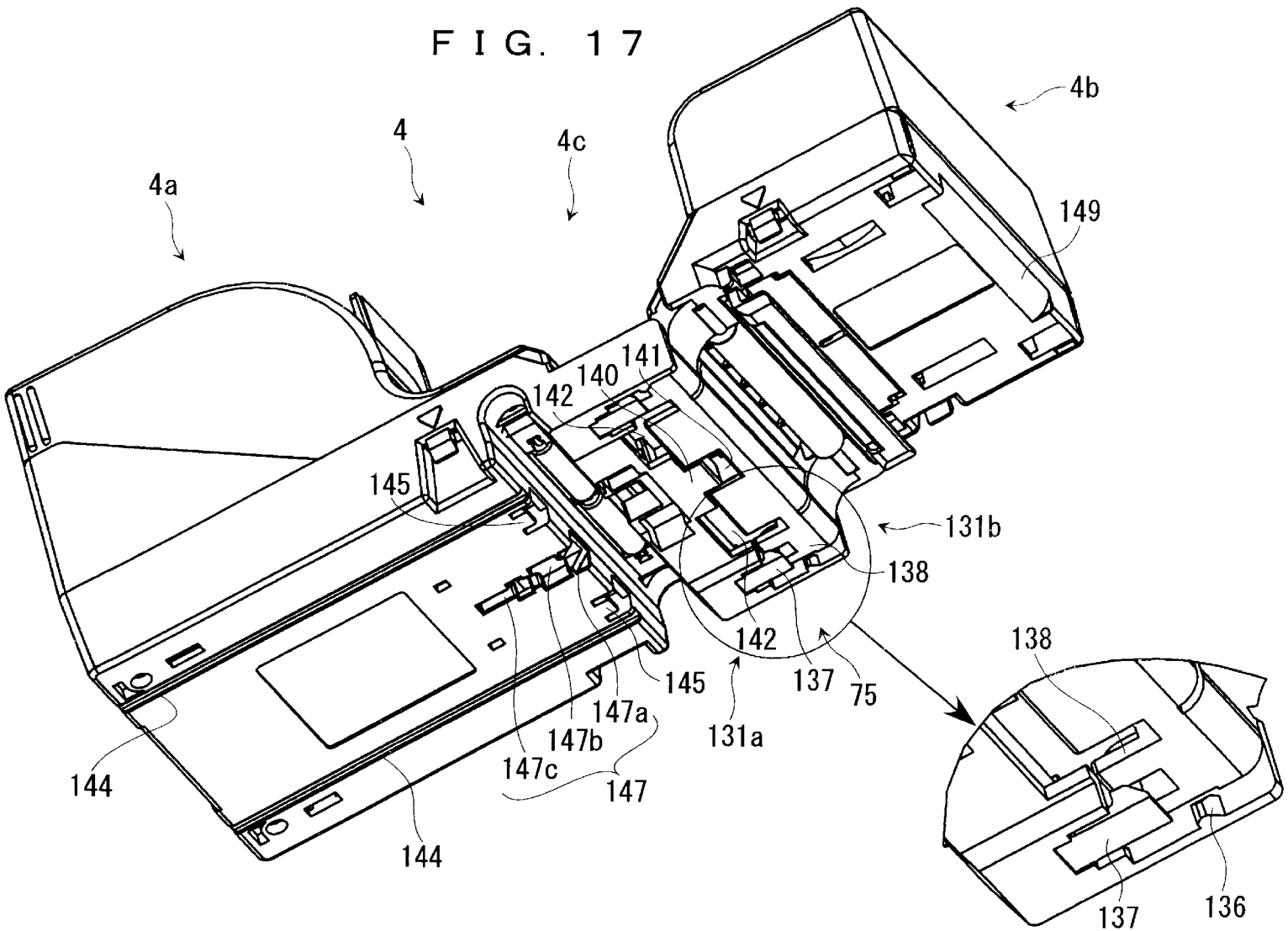
FIG. 17 is a perspective view of the tape cartridge, as viewed from below, which is useful in explaining the hinge mechanism and component parts associated therewith.

From this state, when the auxiliary holding block 4*b* is folded toward the main holding block 4*a*, each of the engaging blocks 138 bends a corresponding one of the spring nails 137 and overcomes the same (see FIGS. 17 and 18). Further, each of the engaging blocks 138 has an outer side face thereof formed with a projecting portion 138*a* having a resilient property, and the projecting portions 138*a* each press itself against a corresponding one of the click projections 136 and overcomes the same. Then, when the auxiliary holding block 4*b* is completely folded against the main holding block 4*a*, the rear end face of the former is brought into abutment with the front end face of the latter, and the projecting portions 138*a* are inhibited from moving by the respective click projections 136 after having overcome the same, whereby the two holding blocks 4*a* and 4*b* are held in their folded state.

Further, as shown in FIGS. 15, 17, and 18, the main holding block-side connecting block 131*a* has a positioning protrusion 140 protruding from a center of the front end thereof, while the auxiliary holding block-side connecting block 131*b* has a locating recess 141 formed at a center of the rear end thereof, in which the positioning protrusion 140 is fitted. When the tape cartridge 4 is unfolded, the positioning protrusion 140 is fitted in the locating recess 141 for proper mutual positioning of the main holding block 4*a* and the auxiliary holding block 4*b* in a left-right or lateral direction, whereby the printing tape T1 and the laminating tape T2 are also properly positioned in the direction of width. Thus, the printing tape T1 is accurately laminated with the laminating tape T2 without any displacement.

At opposite locations adjacent to the positioning protrusion 140 are formed a pair of ink collecting windows 142 (see FIG. 17). Each of the ink collecting windows 142 is square-shaped and arranged at a position from which a corresponding one of the lateral sides of the printing tape T1 being fed is exposed to the outside. Further, in the apparatus body 2 under each ink collecting window 142, there is arranged a waste ink absorber, not shown, for absorbing uselessly discharged ink. According to the tape printing apparatus 1, it is possible to print a background color in addition to characters, such as letters and the like. When the background color is printed, a printing operation (ejection of ink) is started from (and completed at) a position outward of the lateral edge of the printing tape T1, and hence ink for outside the lateral edge of the printing tape T1 is ejected toward each ink collecting window 108 and passes therethrough to be absorbed by the waste ink absorber.

As described above, the tape cartridge 4 has a foldable structure, so that it can be transported or stored in the folded state. Therefore, even if the tape cartridge 4 is large in size, it cannot take much space when transported or stored. Further, the tape cartridge 4 constructed as above cannot be easily damaged even when it receives some external force while being transported. It should be noted that reference numerals 144 and 144 appearing in FIG. 17 designate a pair of left and right guide grooves formed in an underside surface of the body casing 71, reference numerals 145 and 145 a pair of left and right nail-receiving recesses, and reference numeral 147 a slot, and further, numeral 146 in FIG. 8 designates a nail-receiving recess (each described in detail hereinafter).

As described hereinbefore, in replacing the printing tape T1 and the laminating tape T2 with respective new ones, it is possible to mount a roll of printing tape T1 in the tape cartridge 4 in a state contained in a sub casing 74 and a roll of laminating tape T2 in an uncovered state. In this case, since it is required to supply the tapes T1 and T2 to the user as a set in a state in which the forward end of the leading portion Ta of the printing tape T1 is laminated with the laminating tape T2, the uncovered roll of laminating tape T2 is attached to the sub casing 74 containing the printing tape T1, as shown in FIG. 12, and then the tapes T1 and T2 in this state are placed in a package and provided. In mounting the tapes T1 and T2 in the tape cartridge 4, the user detaches the laminating tape T2 from the sub casing 74, and then places the sub casing 74 containing the printing tape T1 in the main holding block 4*a*, and the laminating tape T2 in the auxiliary holding block 4*b*. Further, the laminated leading portion Ta of the two tapes T1 and T2 is inserted into the tape-holding member (slit 126) 121 of the body casing 71 via the guide opening 119 of the same, and then the main casing lid 72 and the auxiliary casing lid 73 are closed (see FIG. 9).

For accurate lamination or alignment between the printing tape T1 and the laminating tape T2, each leading portion Ta has a portion (formed of a film, which is different from the material of the printing tape T1, in this embodiment) which cannot be laminated with the laminating tape T2. More specifically, the leading portion Ta includes a provisional lamination portion S1, a lamination-inhibiting portion S2, and a main lamination- starting portion S3, which are arranged in the mentioned order from the leading edge of the leading portion Ta. The tape cartridge 4 is supplied in a state in which only the provisional lamination portions S1 are laminated. Therefore, after mounting the printing tape T1 and the laminating tape T2 in the tape cartridge 4, the user pinches the provisional lamination portions S1, draws the leading portions Ta straight (at a right angle with respect to the axes of the rolls of tapes T1 and T2 until the main lamination-starting portions S3 pass over the feed driven roller 42, thereby carrying out lamination of the main lamination-starting portion S3. The replacement of printing tapes T1 and laminating tapes T2 is thus completed.

In the present embodiment, as shown in FIG. 17, the auxiliary holding block 4*b* has a lamination guide groove 149 formed at a front lower edge thereof to have a width approximately equal to that of the laminated printing tape T. The lamination guide groove 149 is formed by chamfering a portion of the front lower edge such that the portion has an arcuate cross section. The user draws the leading portion Ta forward along the lamination guide groove 149 while guiding the same by opposite ends of the guide groove 149, for lamination of the main lamination-starting portion S3. Thus, the printing tape T1 is accurately laminated with the laminating tape T2 at the main lamination-starting portion S3 without any lateral or angular displacement.

The tape cartridge 4 constructed as above is set to a predetermined printing position in the apparatus body 2 by the ejection mechanism 15. When the tape cartridge 4 is set to the printing position, the feed driven roller 42 of the auxiliary holding block 4*b* catches the printing tape T1 and the laminating tape T2 to roll on the feed drive roller 43, while the printing surface-side braking member 51 of the main holding block 4*a* catches the printing tape T1 to roll on the non-printing surface-side braking member 53. The tape-holding member 121 faces the cutting device 13 in a state retaining the laminated printing tape T, and the print head unit 38 is brought to a position immediately above the connecting block 4*c* for reciprocating motion (see FIG. 2).

As shown in FIGS. 2, 3, and 4, the ejection mechanism 15 is arranged in a cartridge compartment 20 defined in the apparatus body 2. The ejection mechanism 15 includes an ejection plate 161 for holding the mounted tape cartridge 4, a mounting guide plate 162 attached to a rear end of the ejection plate 161, and an ejection plate-moving device 163 for moving the ejection plate 161 and the mounting guide plate 162. The ejection plate 161 is moved by the ejection plate-moving device 163 in a manner tiltable with respect to the cartridge compartment 20 between the horizontal printing position where the devices can access the tape cartridge 4 in the apparatus body 2 and a tilted position where the ejection plate is in a tilted state with its rear end lifted upward. The mounting guide plate 162 can pivotally move with respect to the ejection plate 161 in a manner interlocked with the same between a receiving position at which the mounting guide plate 162 receives the tape cartridge 4 in a state tilted such that the mounting guide plate 162 extends outward from the apparatus casing 6 and a non-receiving position at which it is erected within the apparatus casing 6. When the ejection plate 161 moves to the tilted position, and the mounting guide plate 162 to the receiving position, top surfaces of the two plates 61 and 62 become flush with each other.

When the ejection plate-moving device 163 is operated in a state in which the lid 7 of the apparatus body 2 is opened, the ejection plate 161 is moved to the tilted position with its rear end lifted upward, and at the same time, the mounting guide plate 162 falls or pivots outward to the receiving position for receiving the tape cartridge 4. In this state, the tape cartridge 4 is slidingly guided along the mounting guide plate 162 and set on the ejection plate 161. Then, when the ejection plate-moving device 163 is operated in reverse, the ejection plate 161 returns to the printing position, while the mounting guide plate 162 returns to the state erected at the non-receiving position, whereby the tape cartridge 4 is completely mounted in the apparatus body 2. Then, the lid 7 is closed to place the tape printing apparatus 1 in a printing wait state.

Figure 19:
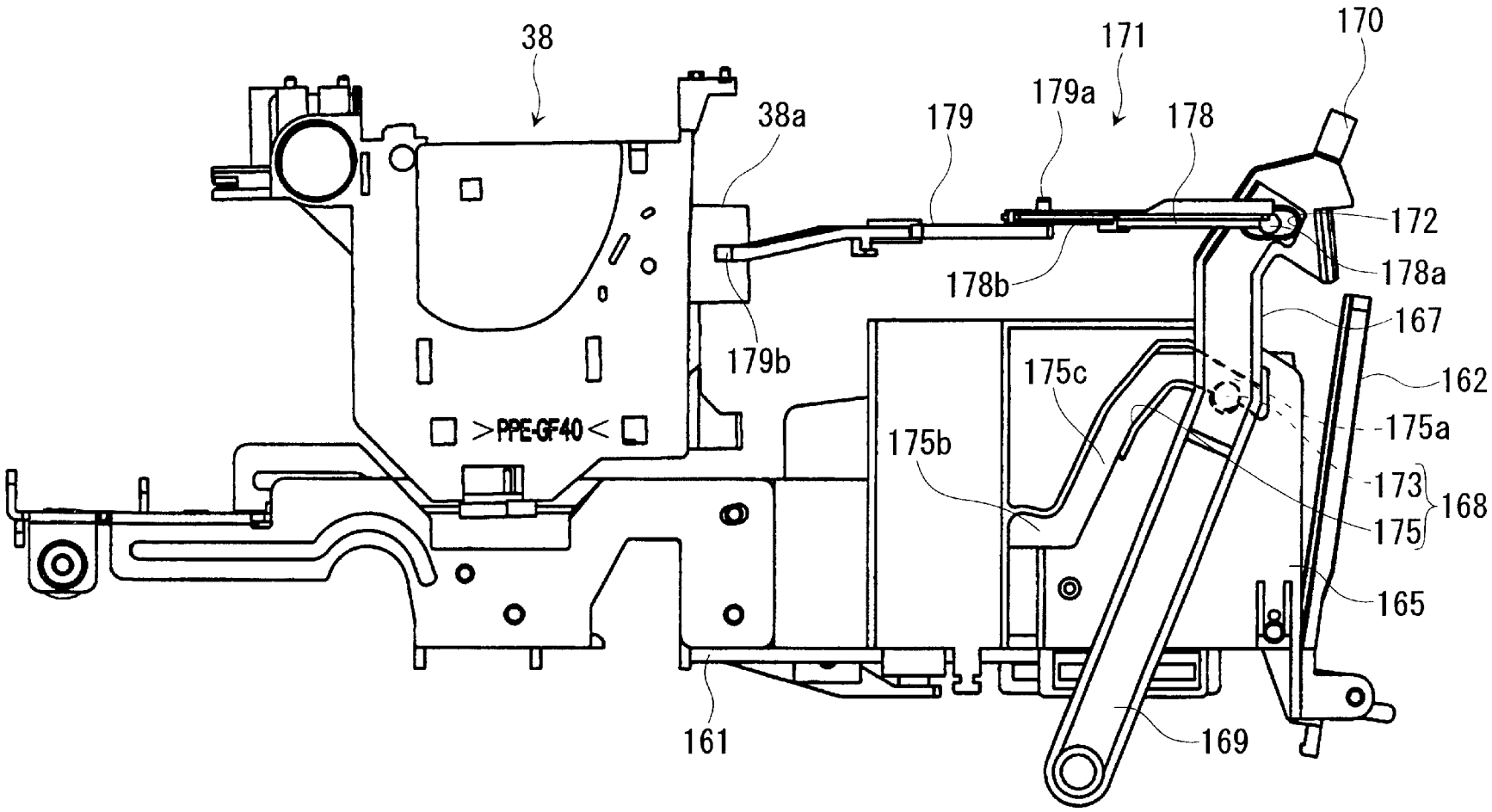
FIG. 19 is a side view of an ejection mechanism.
Figure 20:
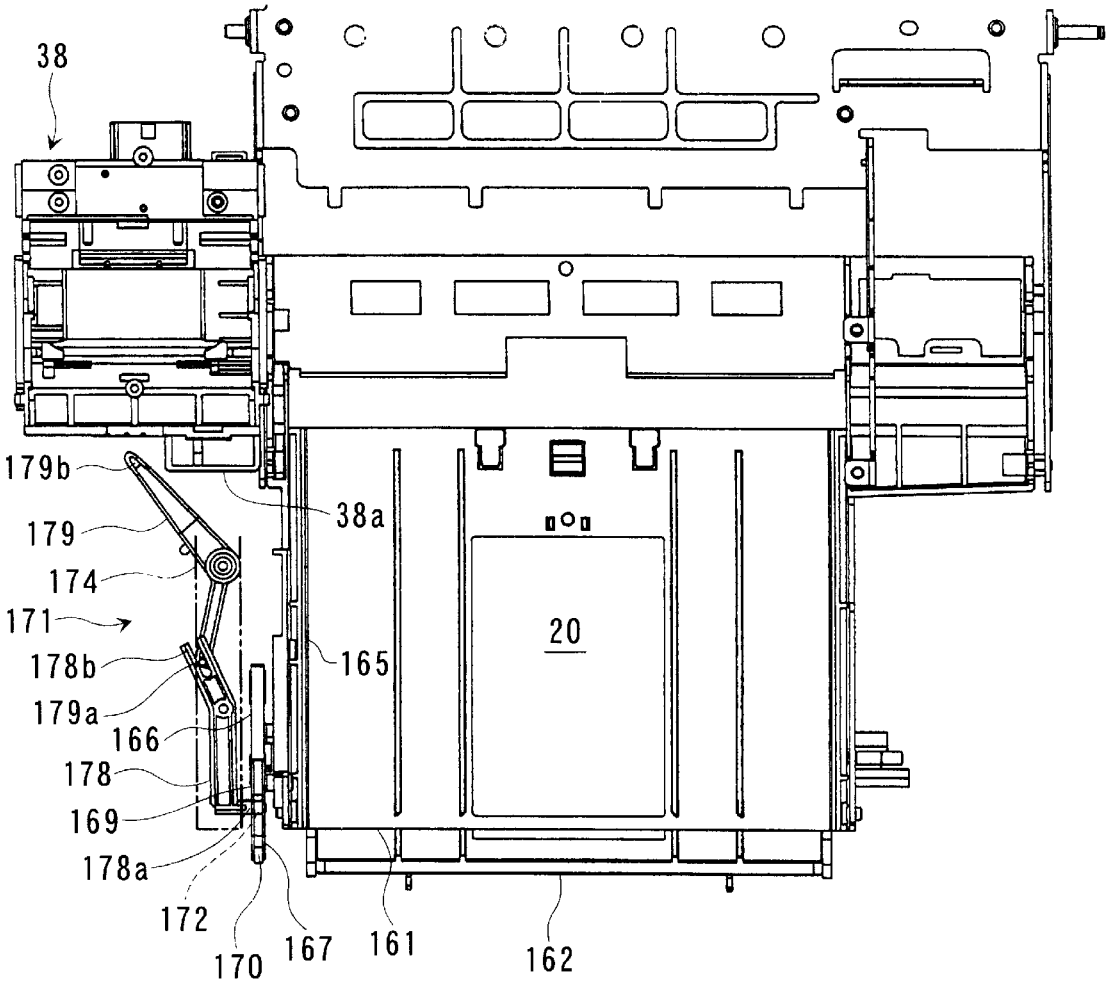
FIG. 20 is a plan view of the ejection mechanism.

As shown in FIGS. 4, 19, and 20, the ejection plate-moving device 163 includes one of side plates 165, referred to hereinafter, of the ejection plate 161, an ejection lever 167 having a lower end thereof pivotally attached to a holder frame 166 extending from the frame 17, and a cam mechanism 168 interposed between the side plate 165 and the ejection lever 167. The ejection lever 167 is comprised of a lever body 169 and an ejection knob 170 attached to an upper end of the lever body 169. The lever body 169 has an upper portion thereof formed with a lock-receiving hole 172 for engagement with and disengagement from a lock mechanism 171, referred to hereinafter, and an intermediate portion thereof formed with a cam projection 173 projecting toward the side plate 165. The ejection lever 167 can be operated for pivotal motion performed between a forward-tilted position and a rearward-tilted position in a state guided by the holder frame 166.

The side plate 165 is formed with a cam slot 175 for engagement with the cam projection 173. The cam slot 175 has a generally S shape formed by a horizontal position-holding portion 175*a* for holding the ejection plate 161 in a horizontal position, an tilted position-holding portion 175*b* for holding the ejection plate 161 in the tilted position, and a plate-tilting portion 175*c* extending between the horizontal position-holding portion 175*a* and the tilted position-holding portion 175*b*, for tilting the ejection plate 161. That is, the cam mechanism 168 includes the cam projection 173 and the cam slot 175.

Figure 21A:
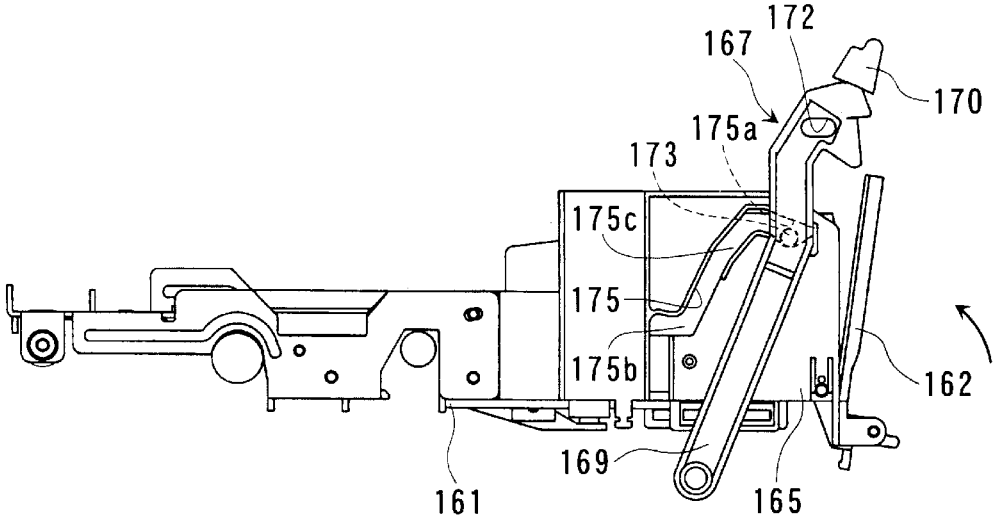
FIGS. 21A and 21B are side views which are useful in explaining operation of the ejection mechanism.
Figure 21B:
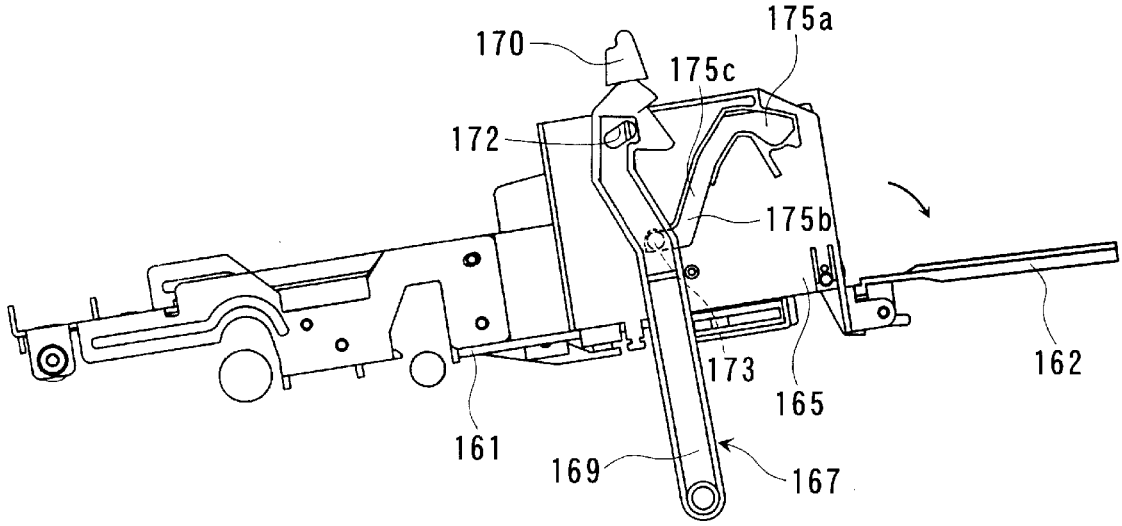

As shown in FIG. 21A, when the ejection lever 167 is in the rearward-tilted position, the cam projection 173 is engaged with the horizontal position-holding portion 175*a* of the cam slot 175, and the ejection plate is in the printing position. From this state, when the ejection lever 167 is pivoted to the forward-tilted position, the cam projection 173 is moved from the horizontal position-holding portion 175*a* through the plate-tilting portion 175*c* to the tilted position-holding portion 175*b*, whereby the ejection plate 161 is tilted from the printing position to the tilted position (see FIG. 21B). In this state, the cam projection 173 is engaged with the tilted position-holding portion 175*b*, and the ejection plate 161 is held in the tilted position with its rear end lifted upward. More specifically, when the user pushes the ejection lever forward, the ejection plate 161 is lifted with its rear end upward, whereby it is possible to mount the tape cartridge 4. From this state, when the ejection lever 167 is pulled rearward, the rear end of the ejection plate 161 is lowered, whereby the tape cartridge 4 is placed in the cartridge compartment 20, and mounting of another tape cartridge 4 is inhibited.

In this tape printing apparatus 1, the print head unit 38 moves from its home position to perform reciprocating motion immediately above the connecting block 4*c* of the mounted tape cartridge 4 for printing operation. When the print head unit 38 is at its home position, it is laterally displaced from the tape cartridge 4, whereas at most positions other than the home position, the print head unit 38 is positioned immediately above the connecting block 4*c*. Therefore, if the ejection lever 167 is operated accidentally when the print head unit 38 is at a position other than the home position, to tilt the tape cartridge 4, there may occur interference between the tape cartridge 4 and the print head unit 38. To solve this problem, according to the present embodiment, there is provided the lock mechanism 171. When the print head unit 38 is moved to a position other than the home position, the lock mechanism 171 is brought into engagement with the lock-receiving hole 172 of the ejection lever 167 to thereby inhibit the pivotal operation of the ejection lever 167.

As shown in FIGS. 4, 19, and 20, the lock mechanism 171 has a linkage including a first lock arm 178 and a second lock arm 179 each pivotally attached to a lock frame 177 adjacent to a holder frame 174. The first lock arm 178 has a longitudinally intermediate portion thereof pivotally attached to the rock frame 177, one end portion thereof formed therein with a lock nail 178*a* for engagement with or disengagement from the lock-receiving hole 172, and another end portion thereof formed with a slide portion 178*b* with which the second lock arm 179 is slidably engaged. Similarly to the first lock arm 178, the second lock arm 179 has a longitudinally intermediate portion thereof pivotally attached to the rock frame 177. One end portion of the second lock arm 179 has a slide pin 179*a* extending therefrom for engagement with the slide portion 178*b*, and another end portion of the same is formed with an engaging piece portion 179*b* for engagement with or disengagement from a protrusion 38*a* of the print head unit 38 which performs reciprocating motion. Further, the lock mechanism 171 has a spring, not shown, for pivotally urging the first lock arm 178 in a direction for engagement of the lock nail 178*a* with the lock-receiving hole 172.

Figure 22:
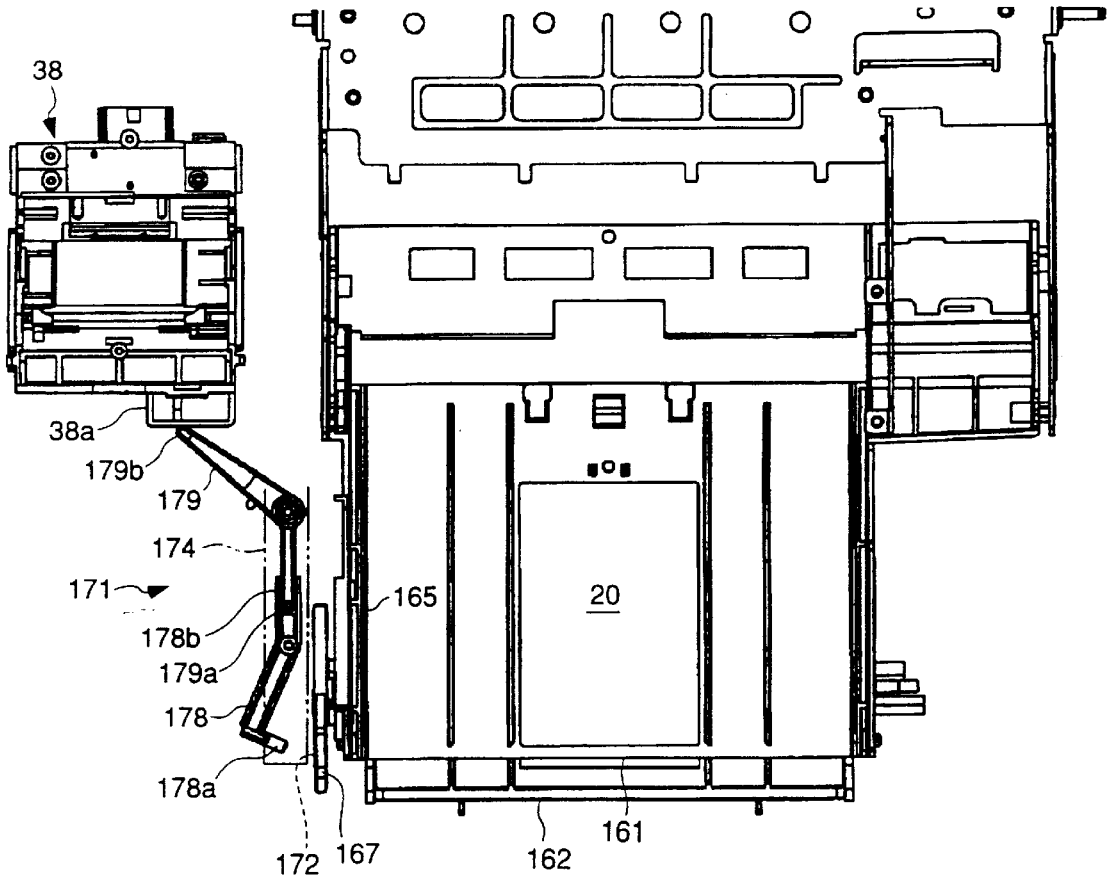
FIG. 22 is a plan view of the ejection mechanism, which is useful in explaining a lock mechanism thereof.

As shown in FIG. 22, when the print head unit 38 is at its home position, the engaging piece portion 179*b* of the second lock arm 179 is held in contact with the protrusion 38*a* of the print head unit 38, whereby the second lock arm 179 and the first lock arm 178 are pivotally moved to respective unlocking positions against urging force of the spring. In this state, the lock nail 178*a* is disengaged from the lock-receiving hole 172, and hence the pivotal operation of the ejection lever 167 is permitted. In short, when the print head unit 38 is at its home position, the ejection plate 161 is allowed to tilt.

On the other hand, as shown in FIG. 20, when the print head unit 38 is moved from its home position, the engaging piece portion 179*b* of the second lock arm 179 is kept from contact with the protrusion 38*a*, whereby the second lock arm 179 and the first lock arm 178 are pivotally moved to respective locking positions by the urging force of the spring. In this state, the lock nail 178*a* is engaged with the lock-receiving hole 172, and hence the pivotal operation of the ejection lever 167 is inhibited. In short, when the print head unit 38 is at a position other than its home position, the ejection plate 161 is inhibited from tilting.

By the construction described above, only when the print head unit 38 is at its home position, the ejection plate-moving device 163 is allowed to be operated, so that it is possible to prevent wrong operation of the ejection lever 167 when the print head unit 38 is at a position other than its home position. Thus, the construction makes it possible to prevent interference between the tape cartridge 4 and the print head unit 38.

Figure 23A:
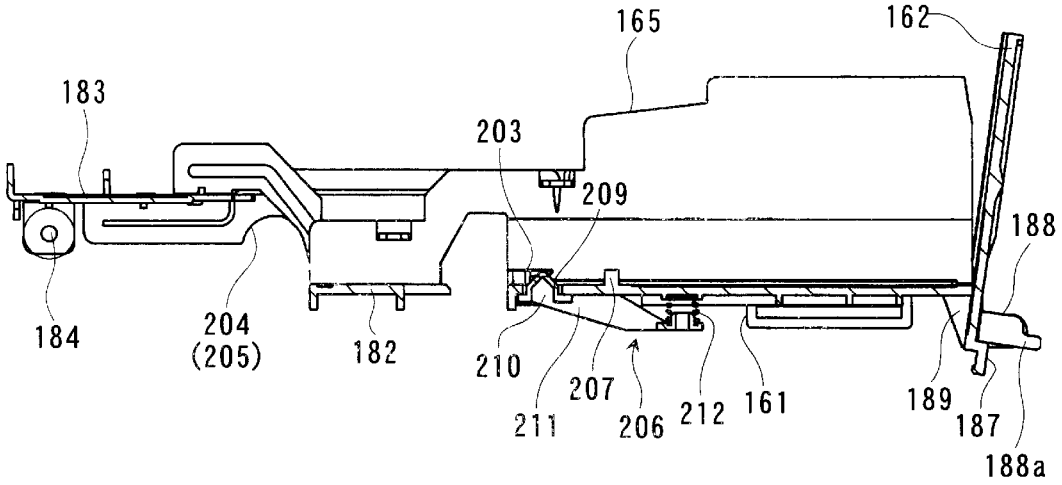
FIG. 23A is a side sectional view of the ejection mechanism.
Figure 23B:
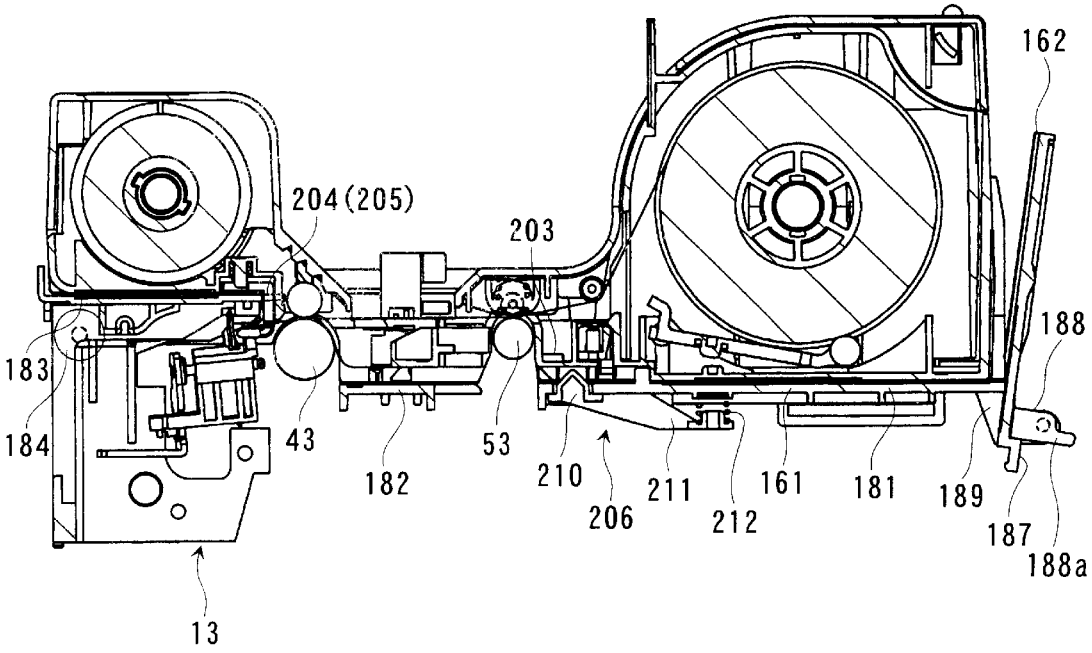
FIG. 23B is a side sectional view of the ejection mechanism and the tape cartridge mounted thereon.
Figure 24:
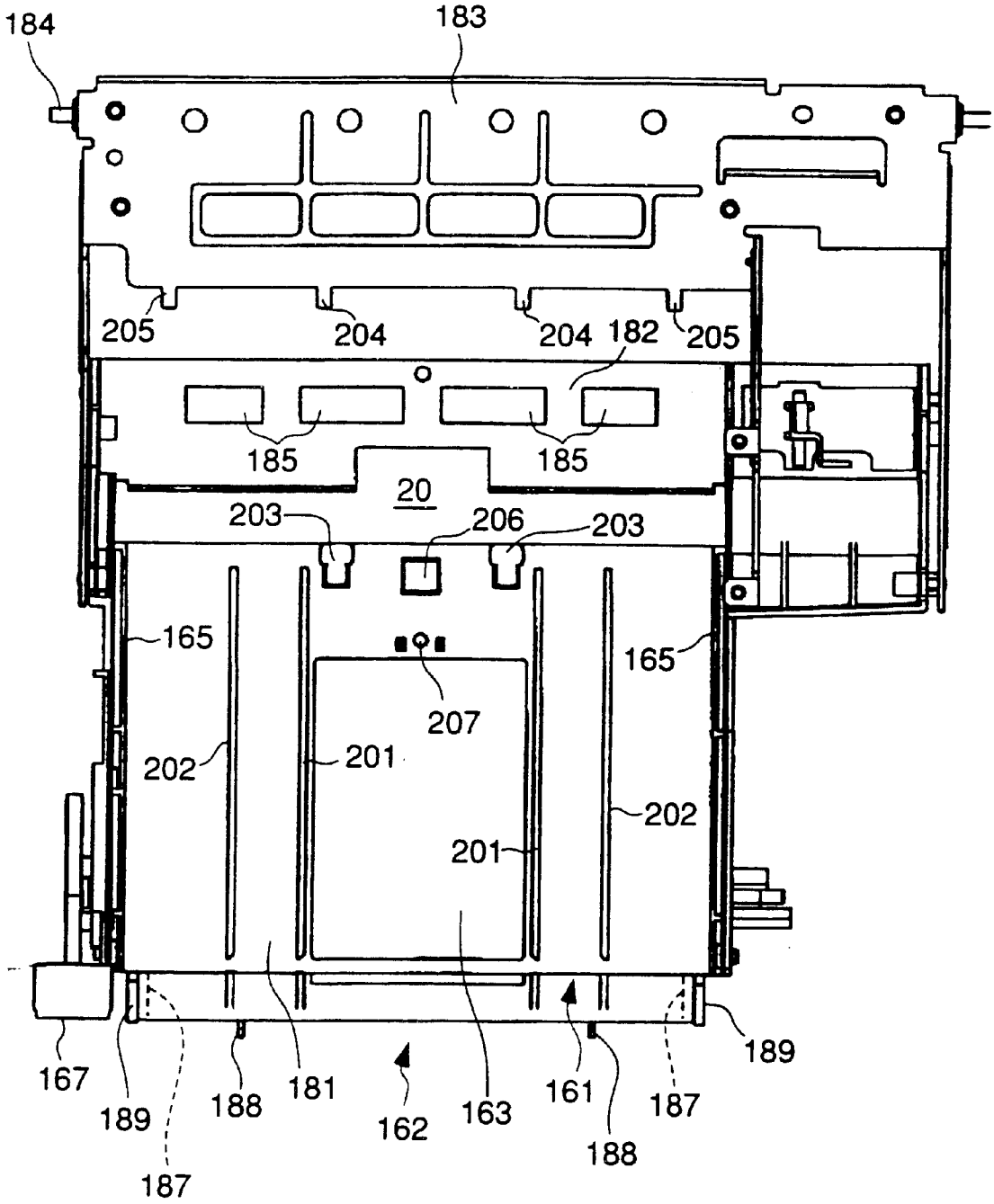
FIG. 24 is a plan view showing an ejection plate and a mounting guide plate of the ejection mechanism.

Next, the ejection plate 161 and the mounting guide plate 162 will be described in detail. As shown in FIGS. 3, 23, and 24, the ejection plate 161 is comprised of a main holding block-receiving plate 181 for receiving the main holding block 4*a* thereon, a connecting block-receiving plate 182 for receiving the connecting block 4*c* thereon, an auxiliary holding block-receiving plate 183 for receiving the auxiliary holding block 4*b* thereon, and the pair of left and right side plates 165 and 165 each connecting the three plates 181, 182 and 183. The non-printing surface-side braking member 53 is fitted in a clearance between the main holding block-receiving plate 181 and the connecting block-receiving plate 182, while the feed drive roller 43 is fitted in a clearance between the connecting block-receiving plate 182 and the auxiliary holding block-receiving plate 183. Further, arranged under the auxiliary holding block-receiving plate 183 are a tilt shaft 184 extending in the left-right direction for serving as an axis of tilting motion of the ejection plate 161 and the cutting device 13 described hereinbefore. The connecting block-receiving plate 182 is formed with ink collecting openings 185 continuous with the respective ink collecting windows 142.

The mounting guide plate 162 is pivotally attached to a rear end of the main holding block-receiving plate 181. The plate 162 has a generally square shape which is slightly smaller in width than the main holding block-receiving plate 181. The mounting guide plate 162 has a pair of left and right shaft-receiving portions 187 and 187 projecting outward from a lower end portion thereof. A pair of left and right trigger pieces 188 and 188 are formed between the pair of shaft-receiving portions 187 and 187 and also projecting outward from the lower end portion of the mounting guide plate 162. On the other hand, the rear end portion of the main holding block-receiving plate 181 is formed with a pair of left and right shaft pin-retaining portions 189 and 189 corresponding to the respective shaft-receiving portions 187 and 187 and extending obliquely downward. The pair of shaft-receiving portions 187 and 187 are pivotally supported by the pair of shaft pin-retaining portions 189 and 189 in a manner sandwiched between the same.

Each of the trigger pieces 188 has an end portion formed with a trigger hook 188*a*. The trigger hook 188*a* abuts against a hook catch 190 formed on the apparatus casing 6 and pivotally moves such that the mounting guide plate 162 falls or extends outward immediately before the ejection plate 161 tilting with its rear end upward is brought to the tilted position. On the other hand, when the ejection plate 161 is moved from the tilted position to the printing position, a rear surface of the mounting guide plate 162 is caught by an upper edge portion 191 continuous with an upper end of the hook catch 190 and pivotally moved such that the mounting guide plate 162 is received inward (see FIG. 25). Thus, a guide plate-pivoting mechanism comprised of the trigger hooks 188*a*, the hook catches 190, the mounting guide plate 162, and the upper edge portion 191 of the apparatus casing 6 is arranged between the ejection plate 161 and the apparatus casing 6.

Figure 25:
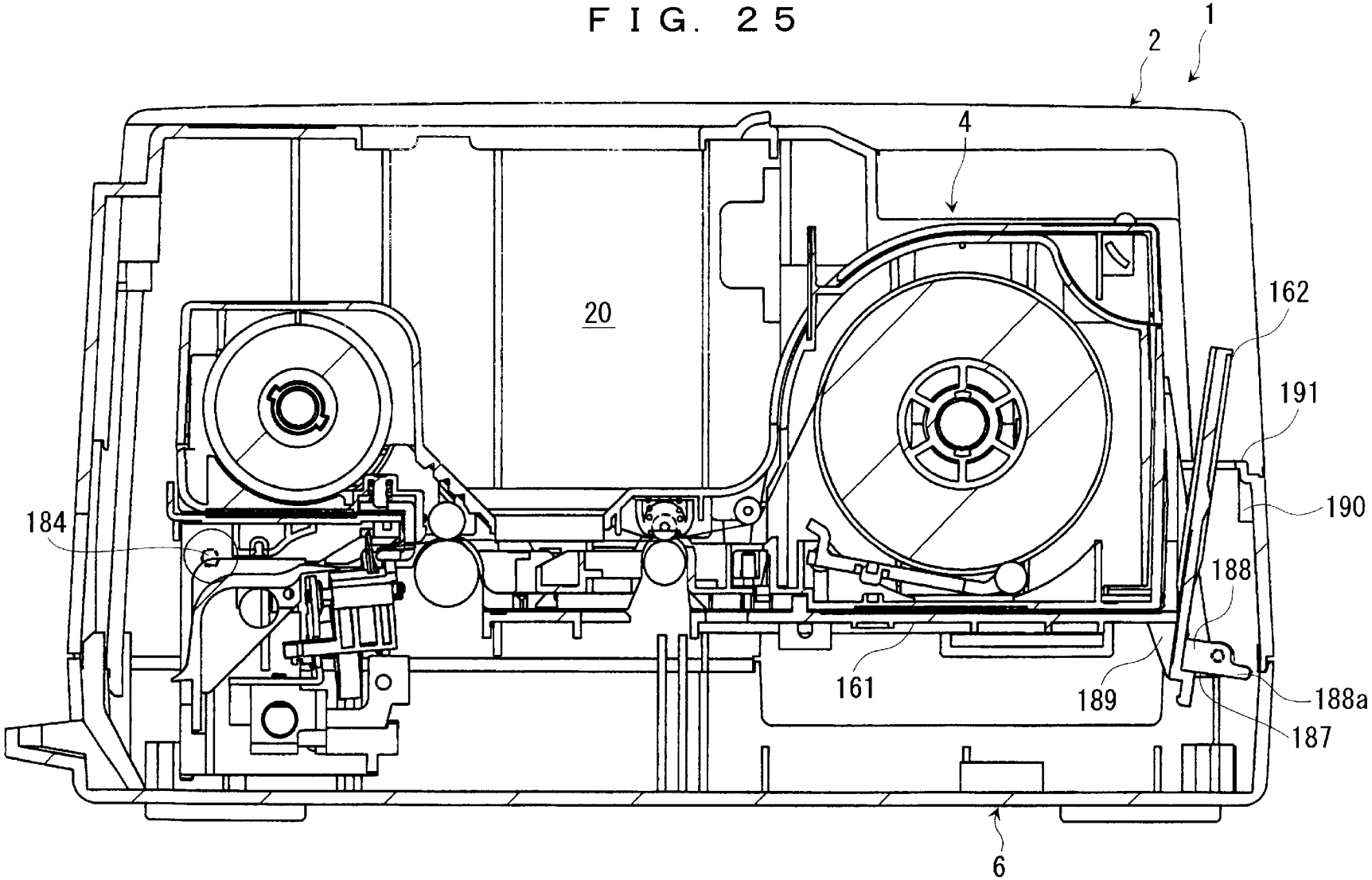
FIG. 25 is a view which is useful in explaining an operation of the ejection mechanism.
Figure 26:
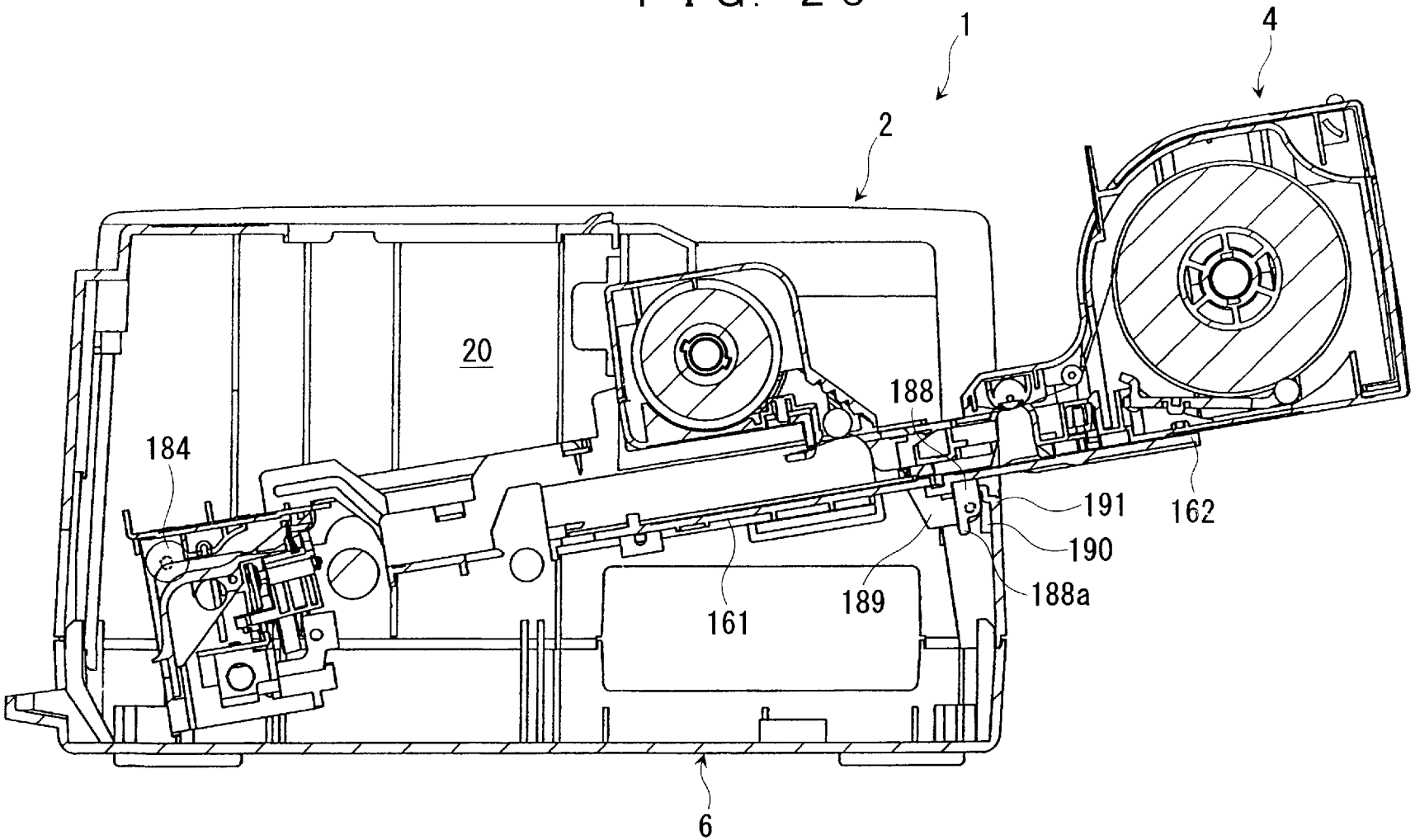
FIG. 26 is a view which is useful in explaining another operation of the ejection mechanism.
Figure 27:
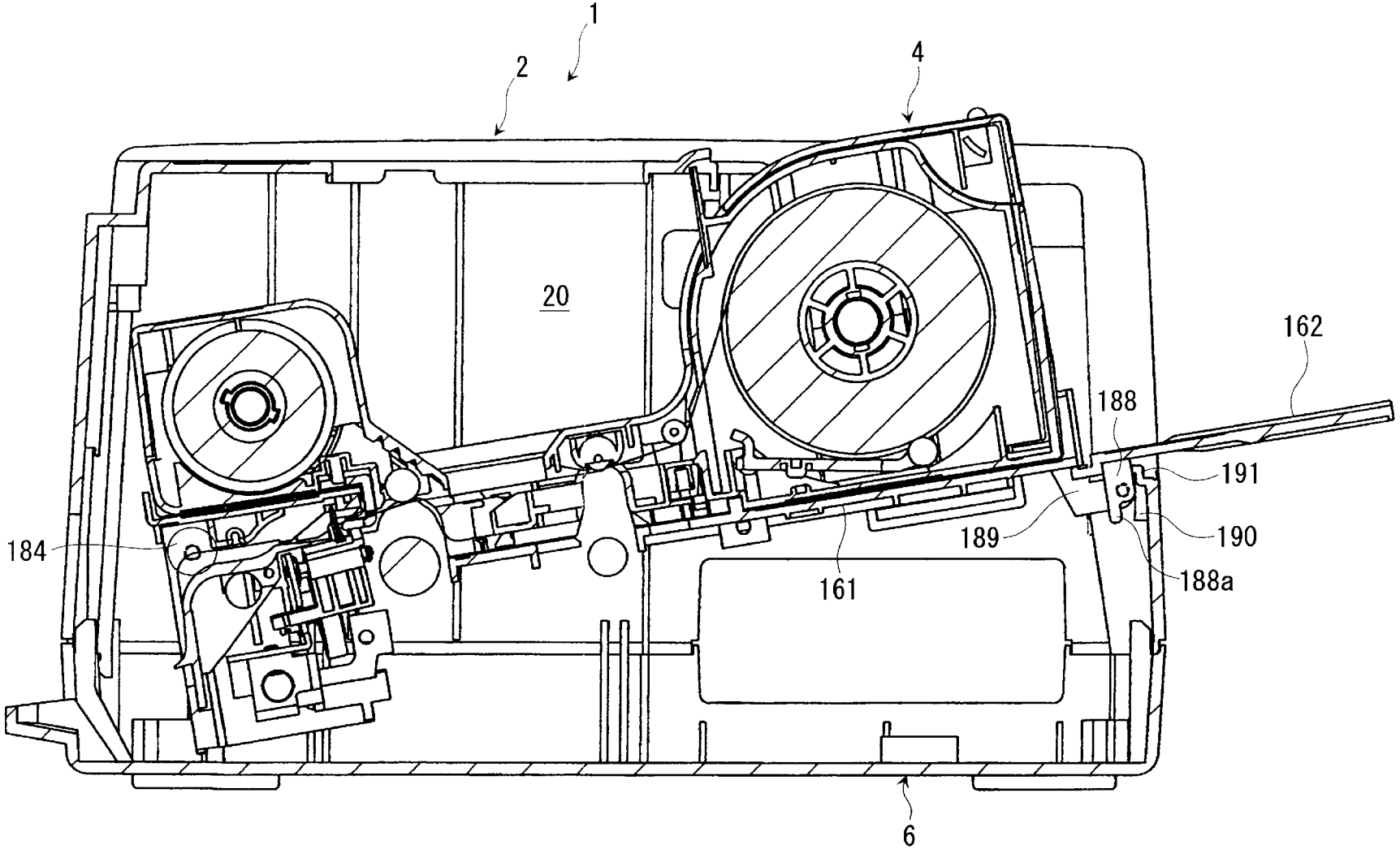
FIG. 27 is a view which is useful in explaining another operation of the ejection mechanism.

From the state shown in FIG. 25 in which the lid (not shown in the figure) is opened, when the ejection lever 167 is pivoted forward, the ejection plate 161 is tilted from the printing position to the tilted position, and at the same time the mounting guide plate 162 is pivotally moved from the non-receiving to the receiving position (see FIG. 26). In this state, the ejection plate 161 and the mounting guide plate 162 each inclined with its rear end lifted upward are arranged in a line, so that the upper surface of the former and that of the latter are flush with each other. The tape cartridge 4 is placed on the upper surface of the mounting guide plate 162 by utilizing the inclination (see FIG. 26) and then pushed along the mounting guide plate 162 and the ejection plate 161, whereby it is inserted to a predetermined innermost position of the cartridge compartment 20 (see FIG. 27).

Figure 28:
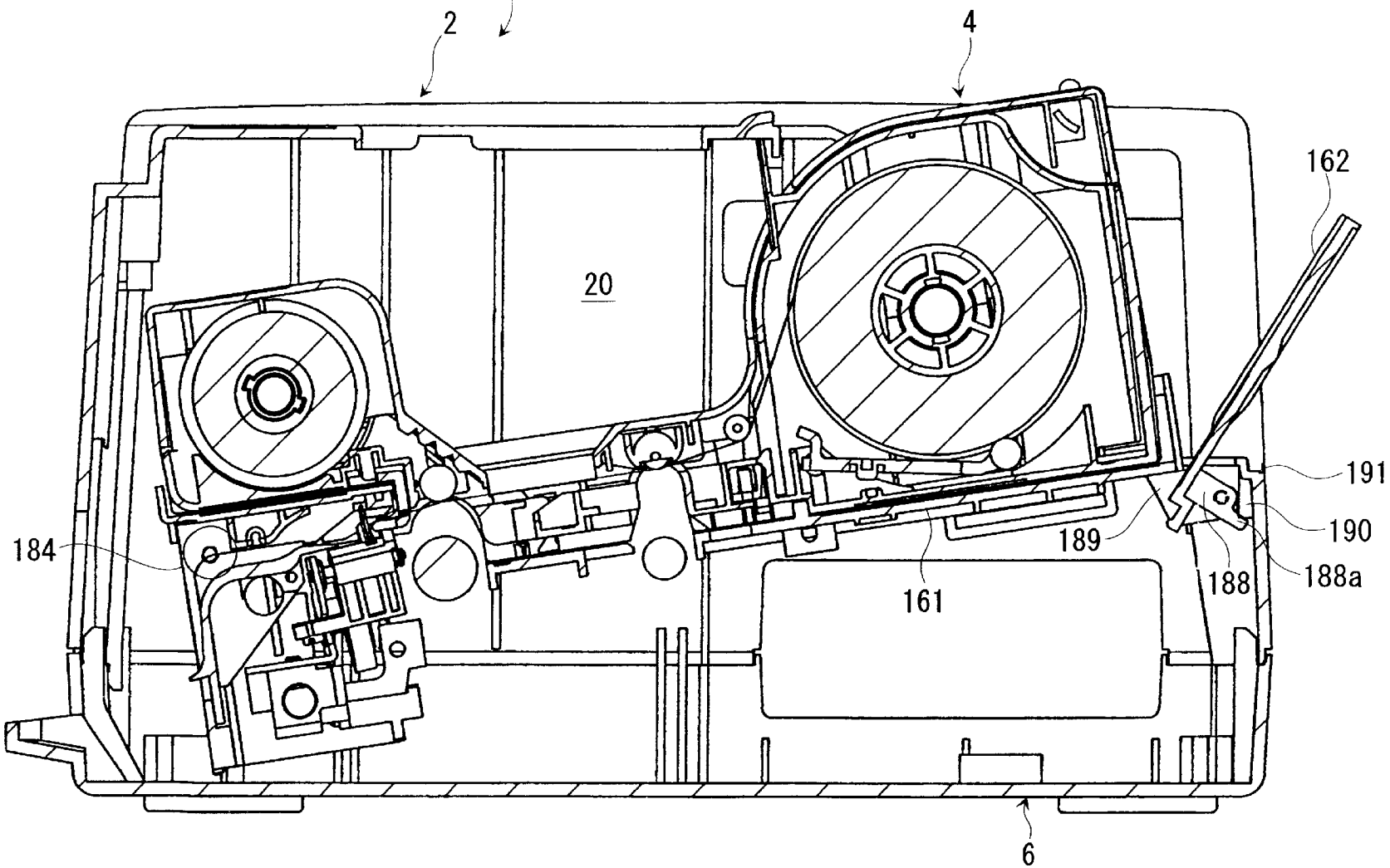
FIG. 28 is a view which is useful in explaining another operation of the ejection mechanism.

After the tape cartridge 4 is inserted to the innermost position of the cartridge compartment 20, the ejection lever 167 is pivoted rearward, whereby the ejection plate 161 is moved from the tilted position to the printing position as shown in FIGS. 28 and 25. As the ejection plate 161 is moved from the tilted position to the printing position, the mounting guide plate 162 is pivotally moved from the receiving position to the non-receiving position. At the non-receiving position, the mounting guide plate 162 is held in the erected state within the apparatus casing 6 such that it can be accommodated under the lid 7 when the lid 7 is closed. To replace the tape cartridge 4 with a new one, the tape cartridge 4 is drawn out along the ejection plate 161 and the mounting guide plate 162, and then the new one is inserted.

Since in mounting or removing the tape cartridge 4 in or from the cartridge compartment 20, the mounting guide plate 162 pivotally attached to the ejection plate 161 is tilted such that the two plates 161 and 162 become flush with each other, as described above, so as to lengthen a mounting guide path for guiding the tape cartridge 4, it is possible to insert or draw the tape cartridge 4 smoothly from the side of the apparatus body 2 by sliding the same in accordance with an inclination of the ejection plate 161. Therefore, even a tape cartridge 4 with a relatively large length can be mounted or removed without any troublesome operation.

Figure 29:
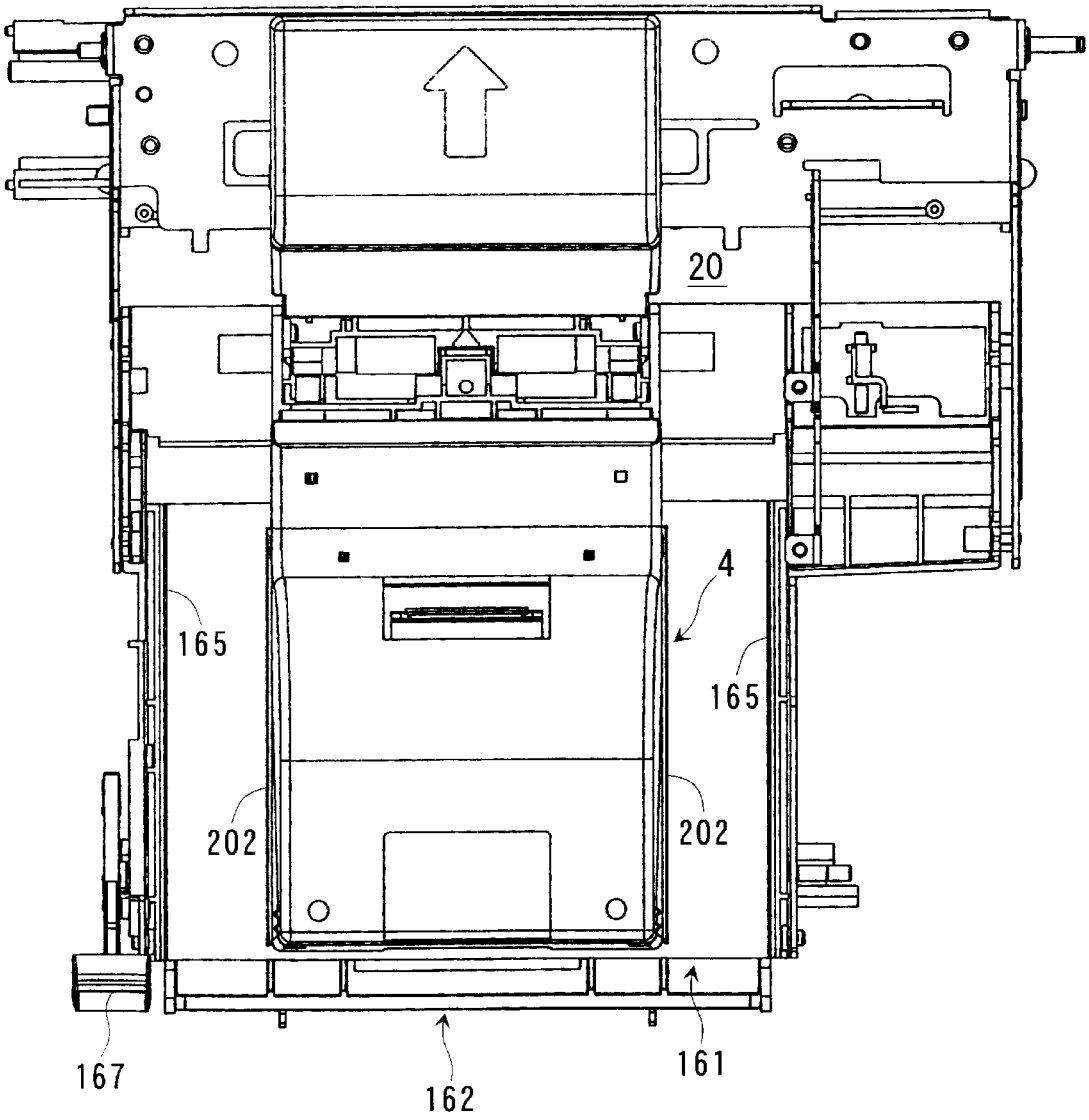
FIG. 29 is a plan view showing a state in which the tape cartridge has been inserted to an innermost position on the ejection plate via the mounting guide plate.

As described hereinbefore, the tape cartridges 4 are classified into the three types "S", "M", and "L" which are different in width from each other. Each of the three types of tape cartridges 4 is mounted after having its lateral center aligned with those of the ejection plate 161 (main holding block-receiving plate 181, to be more precisely) and the mounting guide plate 162. For this alignment, as shown in FIGS. 24 and 29, the main holding block-receiving plate (ejection plate 161) 181 and the mounting guide plate 162 are each formed thereon with a pair of inner guide ridges 201 and 201 for guiding the "S" or "M" type of tape cartridge 4 as well as a pair of outer guide ridges 202 and 202 for guiding the "L" type of tape cartridge 4.

The pair of inner guide ridges 201 and 201 are arranged in parallel with each other such that the distance between inner edges thereof corresponds to the width of the cartridge casing 16 of the tape cartridge 4 of the "S" type, and the distance between longitudinal centers thereof to that between longitudinal centers of a pair of guide grooves 144 and 144 formed in the tape cartridge 4 of the "M" type (see FIG. 17). Similarly, the pair of outer guide ridges 202 and 202 are arranged in parallel with each other such that the distance between inner edges thereof corresponds to the width of the cartridge casing 16 of the tape cartridge 4 of the "M" type, and the distance between longitudinal centers thereof to that between longitudinal centers of a pair of guide grooves 144 and 144 formed in the tape cartridge 4 of the "L" type.

That is, the "S" type of tape cartridge 4 having no guide grooves formed therein is mounted (slid) with opposite left and right edges thereof being guided between the inner edges of the pair of inner guide ridges 201 and 201. The "M" type of tape cartridge 4 is slid and mounted in a state in which the pair of guide grooves 144 and 144 formed therein are engaged with the pair of inner guide ridges 201 and 201, and at the same time, secondarily, the "M" type of tape cartridge 4 is mounted with opposite left and right edges thereof being guided between the inner edges of the pair of outer guide ridges 202 and 202. Similarly, the "L" type of tape cartridge 4 is slid and mounted in a state in which the pair of guide grooves 144 and 144 formed therein are engaged with the pair of outer guide ridges 202 and 202, and at the same time, secondarily, the "L" type of tape cartridge 4 may be mounted by being guided between inner surfaces of the side plates 165 and 165 of the ejection plate 161.

Although the plurality of types of tape cartridges 4 are each mounted on the ejection plate 161 in a center-aligned manner as described above, they are center-aligned in design to the cartridge compartment 20 when mounted therein. Further, the feed drive roller 43, the non-printing surface-side braking member 53, and the like for accessing the mounted tape cartridge 4 are also arranged with their centers in alignment with the lateral center of the cartridge compartment 20. Therefore, the feed driven roller 42 and the printing surface-side braking member 51 of the tape cartridge 4 which is formed in accordance with the tape width are held in contact with the feed drive roller 43 and the non-printing surface-side braking member 53, respectively, in a center-aligned manner, which enables forces to act axially evenly between the respective corresponding ones of the component parts in contact with each other, thereby preventing unsymmetrical wear of the feed drive roller 43 and the non-printing surface-side braking member 53.

Further, since the tape cartridge 4 is mounted in the cartridge compartment 20 by being guided by the pair of inner guide ridges 201 and 201 or the pair of outer guide ridges 202 and 202, it is possible to carry out lateral positioning of the tape cartridge 4 in the cartridge compartment 20 with ease. It should be noted that the ejection plate 161 has a hook, not shown, formed on an underside surface of a rear portion thereof, for engaging with a component of the apparatus body 2 when the ejection plate 161 is moved to the printing position, to thereby prevent the ejection plate 161 from being lifted when it is in the printing position.

As described hereinbefore, the tape cartridge 4 set at the printing position is urged upward by the feed drive roller 43 and the non-printing surface-side braking member 53. Accordingly, it is not only required to prevent the ejection plate 161 from being lifted, as describe above, but also to prevent the tape cartridge 4 from being lifted from the ejection plate 161. Further, it is required to reliably insert the tape cartridge 4 placed on the mounting guide plate 162 and the main holding block-receiving plate 181 of the ejection plate 161 in a center-aligned manner to the innermost position on the ejection plate 161, thereby positioning the same with accuracy.

To meet the requirement, as shown in FIGS. 4, 23, and 24, the main holding block-receiving plate 181 of the ejection plate 161 has a pair of left and right nails 203 and 203 raised on a front end portion thereof, while the auxiliary holding block-receiving plate 183 has a pair of left and right inner nails 204 and 204 and a pair of left and right outer nails 205 and 205 each protruding from a rear end thereof. Further, the main holding block-receiving plate 181 has a latch mechanism 206 arranged at a center of the front end portion thereof and a locating pin 207 erected in the vicinity of the latch mechanism 206.

The pair of nails 203 are each raised on the main holding block-receiving plate 181 in a manner facing rearward, for engagement with a corresponding one of the pair of left and right nail-receiving recesses 145 and 145 formed in the body casing 71 of the tape cartridge 4 (see FIG. 17). The pair of left and right inner nails 204 and 204 and the pair of left and right outer nails 205 and 205 are each formed by cutting the rear end portion of the auxiliary holding block-receiving plate 183 into a projection. The pair of inner nails 204 and 204 correspond to the tape cartridge 4 of the "S" or "M" type, and the pair of inner nails 204 and 204 and the pair of left and right outer nails 205 and 205 to the "L" type. More specifically, the body casing 71 of each of the "S" type of tape cartridge 4 and the "M" type of tape cartridge 4 is formed with the pair of nail-receiving recesses 146 and 146 (behind the tape-holding member 121 in FIG. 8), for engagement with the pair of inner nails 204 and 204. On the other hand, the body casing 71 of the "L" type of tape cartridge 4 is formed with four nail-receiving recesses 146 for engagement with the pair of inner nails 204 and 204 and the pair of outer nails 205 and 205.

The tape cartridge 4 is thus retained on the ejection plate 161 at the two longitudinally (front-rear) different locations and the two different laterally (left-right) different locations, so that the tape cartridge 4 inserted to the innermost position on the ejection plate 161 can be immovably secured in the apparatus body 2, without being lifted from the ejection plate 161. It should be noted that the nail-receiving recesses 145 and the nail-receiving recesses 146 each have a sloped nail-receiving surface, not shown, and hence, when the tape cartridge 4 is slid toward the innermost position on the ejection plate 161, it is brought into a loosely engaged state immediately before reaching the innermost position and then into a rigidly engaged state in the innermost position.

The latch mechanism 206 is arranged in an underside of the front end portion of the main holding block-receiving plate 181. The latch mechanism includes a latch body 210 which can be projected and retracted from a square opening 209 formed in the front end portion of the main holding block-receiving plate 181, a latch holder 211 for holding the latch body 210, and a latch spring 212 for urging the latch body 210 in the direction of projection via the latch holder 211. The locating pin 207 having a cylindrical shape is formed integrally with the main holding block-receiving plate 181 and erected at a location slightly rearward of the square opening 209. The slot 147 is formed in the body casing 71 of the tape cartridge 4 for association with the locating pin 207 (see FIG. 17). As shown in the figure, the slot 147 has a latch braking portion 147*a*, a latch-receiving groove 147*b*, and a locating groove 147*c* which are arranged in the mentioned order from an extreme front end (innermost end) of the slot 147.

When the tape cartridge 4 is slid toward the innermost position on the ejection plate 161, the latch body 210 relatively climbs over the latch braking portion 147*a* to be brought into engagement with the latch-receiving groove 147*b*, and at the same time, the locating pin 207 is fitted in the locating groove 147*c*. As a result, the user determines by the touch that the tape cartridge 4 has been properly mounted in the innermost position on the ejection plate 161. At this time, the tape cartridge 4 is automatically mounted on the ejection plate 161 in a center-aligned manner.

Next, a construction for sensing replacement of tape cartridges 4 and eliminating looseness of the printing tape T1 of a new tape cartridge 4 will be described with reference to FIGS. 3, 30 and 31. As described hereinbefore, the tape cartridge 4 is supplied to the user in a state having the leading portion Ta of the printing tape T1 fed out of the cartridge casing 16. Therefore, when the tape cartridge 4 is mounted in the apparatus body 2, there is looseness in a portion of the printing tape T1 opposed to the print head 36. If a printing operation is started in this state, the print head (print head unit 38) 36 can be caught in the printing tape T1. To overcome this problem, according to the present embodiment, when a tape cartridge 4 is replaced with a new one (or when an identical tape cartridge 4 is remounted), the replacement or the remounting is detected, and the printing tape T1 is slightly fed for tensioning of the same (this operation will be hereinafter referred to as "tensioning feed"). More specifically, when the tape cartridge 4 is mounted, the printing tape T1 and the laminating tape T2 are fed an inch or so, and an unnecessary leading portion thereof is cut off.

Figure 31:
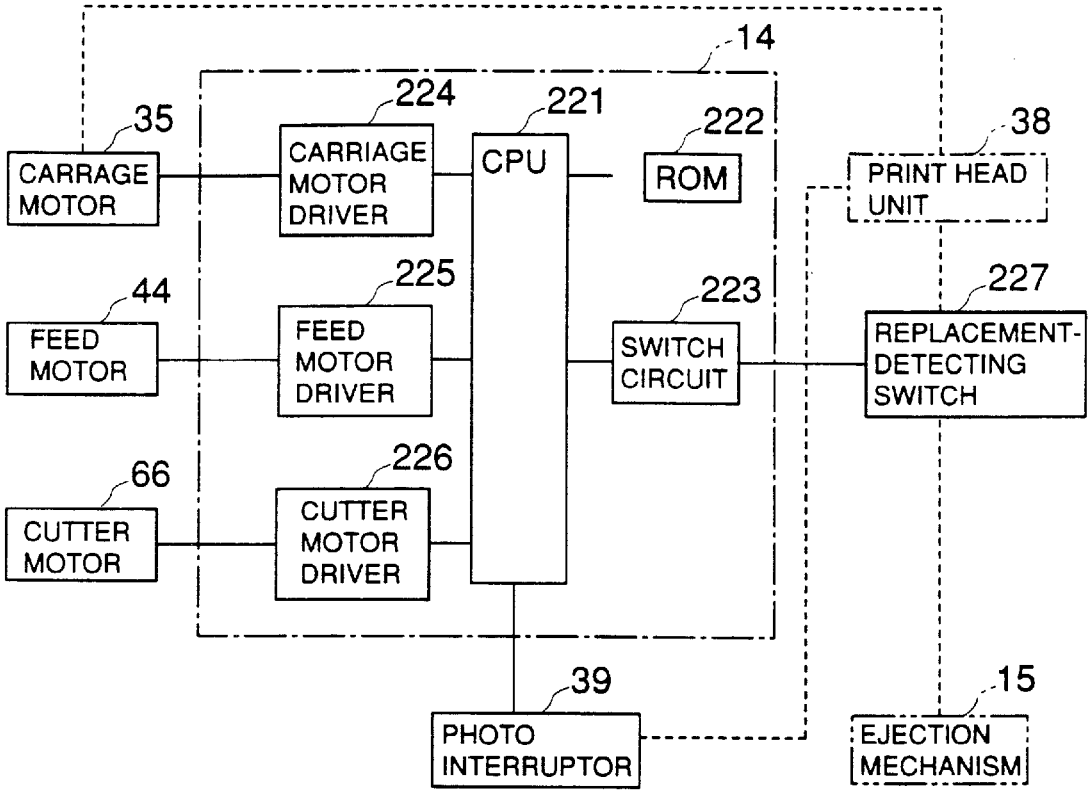
FIG. 31 is a block diagram of a control system for use in tensioning feed of the printing tape.

As shown in FIG. 31, a control system for carrying out the tensioning feed includes a CPU221, a ROM 222, a switch circuit 223, a carriage motor driver 224, a feed motor driver 225 and a cutter motor driver 226, a replacement-detecting switch 227 connected to the switch circuit 223, the photo interrupter 39 connected to the CPU 221, the carriage motor 35 connected to the carriage motor driver 224, the feed motor 44 connected to the feed motor driver 225, and the cutter motor 66 connected to the cutter motor driver 226.

As described in more detail hereinbelow, when the replacement-detecting switch 227 detects the replacement of the tape cartridges 4, the feed motor 44 is driven for tensioning feed of the printing tape T1. Then, the carriage motor 35 is driven prior to a printing operation, whereby the print head unit 38 performs reciprocating motion (provisional motion) over the tape cartridge 4 in a transverse direction to the direction of feeding of the printing tape T1. During this reciprocating motion, the photo interrupter 39 installed on the print head unit 38 senses a tape type of the printing tape T1, and at the same time, the print head unit 38 operates the replacement-detecting switch 227 mechanically to erase a replacement record of the tape cartridge 4. More specifically, the operation for replacement of the tape cartridge 4 is utilized for storing the replacement record, and then, after the tensioning feed of the printing tape T1, the operation by the print head unit 38 for the type detection is utilized to erase the replacement record.

Figure 30A:
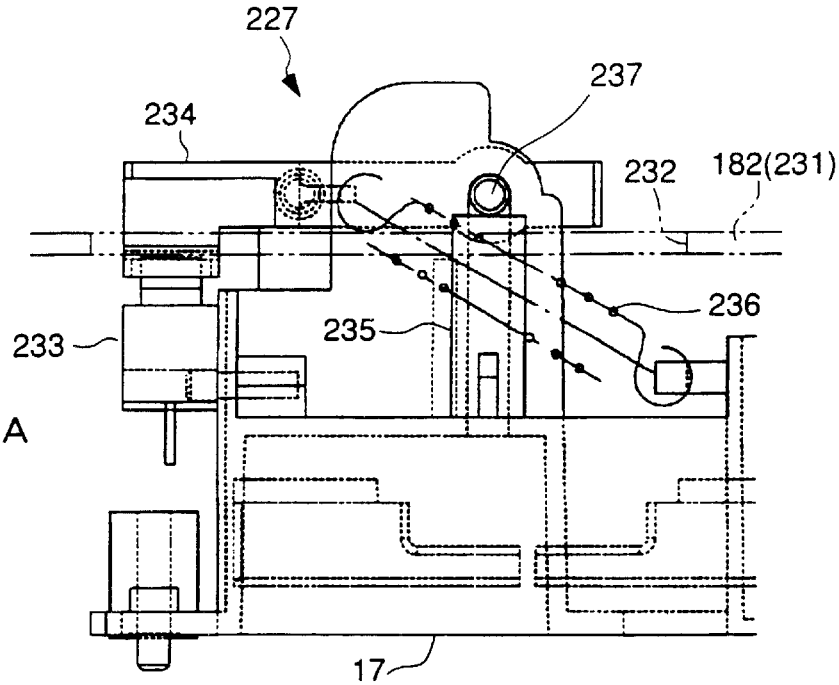
FIGS. 30A and 30B are side views which are useful in explaining a replacement-detecting switch and operation thereof.
Figure 30B:
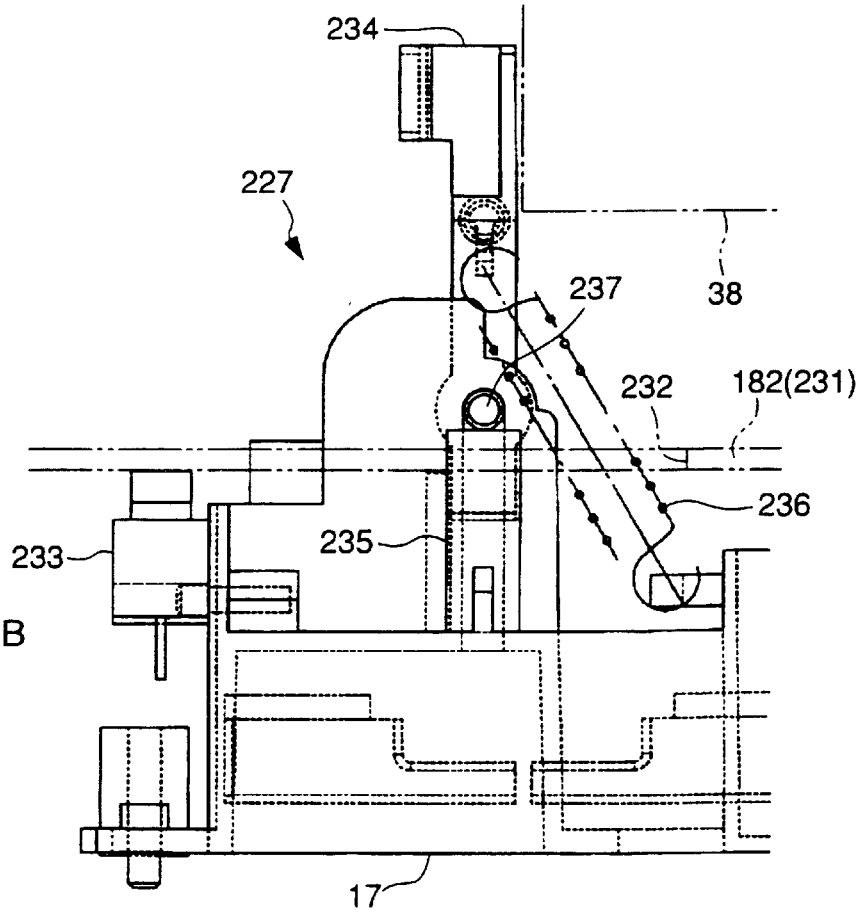

As shown in FIGS. 3 and 30, the replacement-detecting switch 227 is arranged on the frame 17 at a location adjacent to a lateral side of the ejection plate (connecting block-receiving plate 182) 161 in a manner projecting upward from a switch opening 232 formed in an extended plate portion 231 of the connecting block-receiving plate 182. The replacement-detecting switch 227 is comprised of a switch body 233 attached to the frame 17, a switch-operating member 234 for switching the switch body 233 between an ON state and an OFF state, a column member 235 erected on the frame 17, for supporting the switch-operating member 234 such that the switch-operating member 234 can be selectively brought to a vertical position or a horizontal position, and an extension spring 236 for urging the switch-operating member 234 toward the vertical position.

The switch-operating member 234 is attached to the column member 235 via a support shaft 237 in a manner pivotally movable between the vertical position and the horizontal position. The switch-operating member 234 switches on the switch body 233 by its end portion when brought to the horizontal position. The extension spring 236 extends between an intermediate portion of the switch-operating member 234 and the frame 17. When the switch-operating member 234 is brought to the vertical position, the extension spring 236 urges the switch-operating member 234 in such a direction as to hold the same in the position. Further, the extension spring 236 crosses over the support shaft 237, (i.e. crosses over a dead center position thereof) during pivotal movement of the switch-operating member 234 toward the horizontal position, to urge the switch-operating member 234 moved to the horizontal position such that it is held in the position. That is, the switch-operating member 234 is urged by the extension spring 236 toward the vertical position or the horizontal position and held in a selected one of the two positions by the crossing of the extension spring 236 over the dead center position.

When the ejection plate-moving device 163 is operated in a state in which the switch-operating member 234 is placed in the horizontal position, so as to cause the ejection plate 161 to tilt with its rear end upward, a portion of an edge of the switch opening 232 pushes the switch-operating member 234 upward to move the same to the vertical position, whereby the switch body 233 is turned off. On the other hand, when the carriage motor is driven in a state in which the switch-operating member 234 is placed in the vertical position, to cause the print head unit 38 to perform reciprocating motion, the print head unit 38 pushes the switch-operating member 234 down to the vertical position, whereby the switch body 233 is turned on.

The OFF state of the switch body 233 means that the ejection plate-moving device 163 has been operated and that replacement of tape cartridges 4 has been detected. Further, the OFF state means that the replacement record has been stored based on the detection of the replacement of the tape cartridges 4. On the other hand, the ON state of the switch body 233 means that the print head unit 38 has performed reciprocating motion after the tensioning feed of the printing tape T1, i.e. that completion of the tensioning feed has been detected. Further, the ON state means that the replacement record has been erased based on the detection of the completion of the tensioning feed. Therefore, in the ON state of the switch body 233, even when the power of the tape printing apparatus 1 is turned on, no tensioning feed or detection of a cartridge type is carried out.

As described above, since the tensioning feed of the printing tape (laminated printing tape T) T1 is carried out immediately after replacement of tape cartridges 4, the print head 36 is protected from being caught in the printing tape T1 during printing operation, which prevents the printing tape T1 from jamming and the print head 36 from being damaged. Further, since the replacement record of the tape cartridge 4 is mechanically stored, it is not required to carry out tensioning feed during operation having no relation to the replacement of tape cartridges 4, which makes it possible to avoid waste of the printing tape T1 and the laminating tape T2.

It is further understood by those skilled in the art that the foregoing are preferred embodiments of the invention, and that various changes and modification may be made without departing from the spirit and scope thereof.

What is claimed is:

1. A tape cartridge including:

a casing accommodating at least one roll of tape such that said at least one roll of tape can be unrolled therefrom, wherein said casing comprises a hinge mechanism arranged at a longitudinally intermediate portion thereof, for allowing said tape cartridge to be folded, and wherein said at least one roll of tape comprises a first roll of tape and a second roll of tape, said first roll of tape and said second roll of tape being unrolled, and sent out from said casing in a state positioned one upon another, the tape cartridge including a first tape-accommodating block for accommodating said first roll of tape;

a second tape-accommodating block for accommodating said second roll of tape; and a connecting block for connecting said first tape-accommodating block and said second tape-accommodating block, wherein said hinge mechanism is incorporated in said connecting block, for permitting said first tape-accommodating and said second tape-accommodating block to be folded to each other.

2. A tape cartridge according to claim 1, wherein when said first tape-accommodating block and said second tape-accommodating block are unfolded, space is formed as an recessed portion between said first tape-accommodating block and said second tape-accommodating block, wherein said first tape-accommodating block and said second tape-accommodating block can be folded in a direction of reducing said space.

3. A tape cartridge according to claim 2, wherein said first tape-accommodating block and said second tape-accommodating block has portions formed to have respective shapes complementary to each other, for being brought into contact with each other when said first tape-accommodating block and said second tape-accommodating block are folded.

4. A tape cartridge according to claim 1, wherein said first roll of tape has an unrolled portion unrolled from said first tape-accommodating portion and extending over said connecting block toward said second tape-accommodating portion, wherein said hinge mechanism has an axis of pivotal motion of said first tape-accommodating block and said second tape-accommodating block, said axis of pivotal motion being located outward of said unrolled portion with respect to a direction of folding of said unrolled portion occurring when said first tape-accommodating block and said second tape-accommodating block are folded.

5. A tape cartridge according to claim 1, wherein said connecting block has a first connecting portion located on a first tape-accommodating block side and having a first pair of side portions, and a second connecting portion located on a second tape-accommodating block side and having a second pair of side portions, said first connecting portion and said connecting portion are connected to each other via said hinge mechanism, and wherein said hinge mechanism comprises a pair of pins protruding inwardly from one pair of said first pair of side portions and said second pair of side portions, and a pair of pin-receiving recess respectively formed in another pair of said first pair of side portions and said second pair of side portions, and engaged with said pair of pins for permitting pivotal motion of said pair of said pins.

6. A tape cartridge according to claim 1, wherein said connecting block has a first connecting portion located on a first tape-accommodating block side and having a first end, and a second connecting portion located on a second tape-accommodating block side and having a second end, said first connecting portion and said connecting portion are connected to each other at said first end and said second end via said hinge mechanism such that said first connecting portion and said second connecting portion can be folded to each other, and wherein one of said first end and said second end has a locating recess, and another of said first end and said second having has a locating projection for being fitted in said locating recess when said first tape-accommodating block and said second tape-connecting block are unfolded.

7. A tape cartridge according to claim 1, wherein said first roll of tape is a roll of printing tape having a printing surface for being printed, and said second roll of tape is a roll of laminating tape whose unrolled portion is laminated to said printing surface of an unrolled portion of said roll of printing tape.

8. A tape printing apparatus comprising:

a tape cartridge removably mounted therein, the tape cartridge including a casing accommodating at least one roll of tape such that said at least one roll of tape can be unrolled therefrom, wherein said casing comprises a hinge mechanism arranged at a longitudinally intermediate portion thereof, for allowing said tape cartridge to be folded, and wherein said at least one roll of tape comprises a first roll of tape and a second roll of tape, said first roll of tape and said second roll of tape being unrolled, and sent out from said casing in a state positioned one upon another, said tape cartridge including:

wherein said at least one roll of tape comprises a first roll of tape and a second roll of tape, said first roll of tape and said second roll of tape being unrolled, and sent out from said casing in a state positioned one upon another, said tape cartridge including:

a first tape-accommodating block for accommodating said first roll of tape;

a second tape-accommodating block for accommodating said second roll of tape; and a connecting block for connecting said first tape-accommodating block and said second tape-accommodating block, wherein said hinge mechanism is incorporated in said connecting block, for permitting said first tape-accommodating and said second tape-accommodating block to be folded to each other.

* * * * *